US005570633A

United States Patent [19]

Schultz et al.

[11] Patent Number: 5,570,633

[45] Date of Patent: Nov. 5, 1996

[54] AUTOMATED PRINTING PRESS WITH REINSERTION REGISTRATION CONTROL

[75] Inventors: John E. Schultz; John M. Schultz, both of Loveland, Ohio

[73] Assignee: COMCO Machinery, Inc., Milford, Ohio

[21] Appl. No.: 410,920

[22] Filed: Mar. 27, 1995

Related U.S. Application Data

[63] Continuation of Ser. No. 102,093, Aug. 4, 1993, abandoned, which is a continuation-in-part of Ser. No. 70,078, Jun. 1, 1993, abandoned.

[51] Int. Cl.[6] ..... B41F 5/06; B41F 13/40

[52] U.S. Cl. ..... 101/182; 101/247; 101/484

[58] Field of Search ..... 101/181, 182, 101/183, 247, 248, 184, 185, 174, 136, 137, 138, 139, 140, 143, 144, 145, 484, 485, 486, 211, 351, 352

[56] References Cited

U.S. PATENT DOCUMENTS

| | | | |
|---|---|---|---|
| 2,866,407 | 12/1958 | Hackel et al. . | |
| 3,163,109 | 12/1964 | Stelling, Jr. . | |
| 3,594,552 | 7/1971 | Adamson et al. . | |
| 3,701,464 | 10/1972 | Crum . | |
| 4,007,683 | 2/1977 | Dickerson . | |
| 4,072,104 | 2/1978 | Schaffer . | |
| 4,309,945 | 1/1982 | Marion | 101/247 |
| 4,318,176 | 3/1982 | Stratton et al. . | |
| 4,363,270 | 12/1982 | Ury et al. . | |
| 4,413,560 | 11/1983 | Rogge . | |
| 4,449,450 | 5/1984 | Barny et al. . | |
| 4,495,583 | 1/1985 | Punater . | |
| 4,514,819 | 4/1985 | Punater et al. . | |
| 4,690,051 | 9/1987 | Kishine et al. . | |
| 4,731,542 | 3/1988 | Doggett . | |
| 4,896,600 | 1/1990 | Rogge et al. . | |
| 5,060,570 | 10/1991 | Braedle et al. . | |
| 5,074,205 | 12/1991 | Morgan . | |
| 5,092,242 | 3/1992 | Knauer . | |
| 5,125,339 | 6/1992 | Rogge | 101/247 |

FOREIGN PATENT DOCUMENTS

| | | |
|---|---|---|
| 0051037 | 5/1982 | European Pat. Off. . |
| 0096564 | 12/1983 | European Pat. Off. . |
| 63-56483 | 3/1988 | Japan . |

*Primary Examiner*—J. Reed Fisher
*Attorney, Agent, or Firm*—Wood, Herron & Evans, P.L.L.

[57] ABSTRACT

An automated printing press (10) is provided with a plurality of printing stations (13), each having a printing mechanism (60) which prints at least one component image at spaced apart locations along a web (11). Each printing mechanism (60) is positionable to one side of the press for servicing. The print roller (61) is driven through a swingable gear assembly (268) that maintains gear spacing as the print roller to impression roller spacing varies and that engages and disengages tangentially to improve meshing. Microprocessor based computer controllers (400, 405) at each station (13) precisely and repeatably control positions of the printing mechanism (60) and precisely register the component images being printed at the stations (13). Each station controller (407) precisely maintains registration of the printing rollers (61) among the stations (13) and with respect to a preprinted component part of a composite image on a web (11) that may have been removed from and reinserted into the press (10) and deformed such that repeat lengths along the length of the web (11) may have changed. Measurements are made by sensors (350) of a series of repeat lengths on the web (11), a regression analysis is performed and a prediction is made of a constant or recurring component to be corrected in the next image to be encountered at each respective station (13). The circumferential speed of each print roller (61) is separately controlled in accordance with a respective error prediction to control the length of the image printed at the station to that already on the web (11). The speed is controlled by difference pulses sent to a stepper motor (327) of a harmonic drive (275) at each station (13). Correction pulses are spaced evenly over the print length of the image.

55 Claims, 41 Drawing Sheets

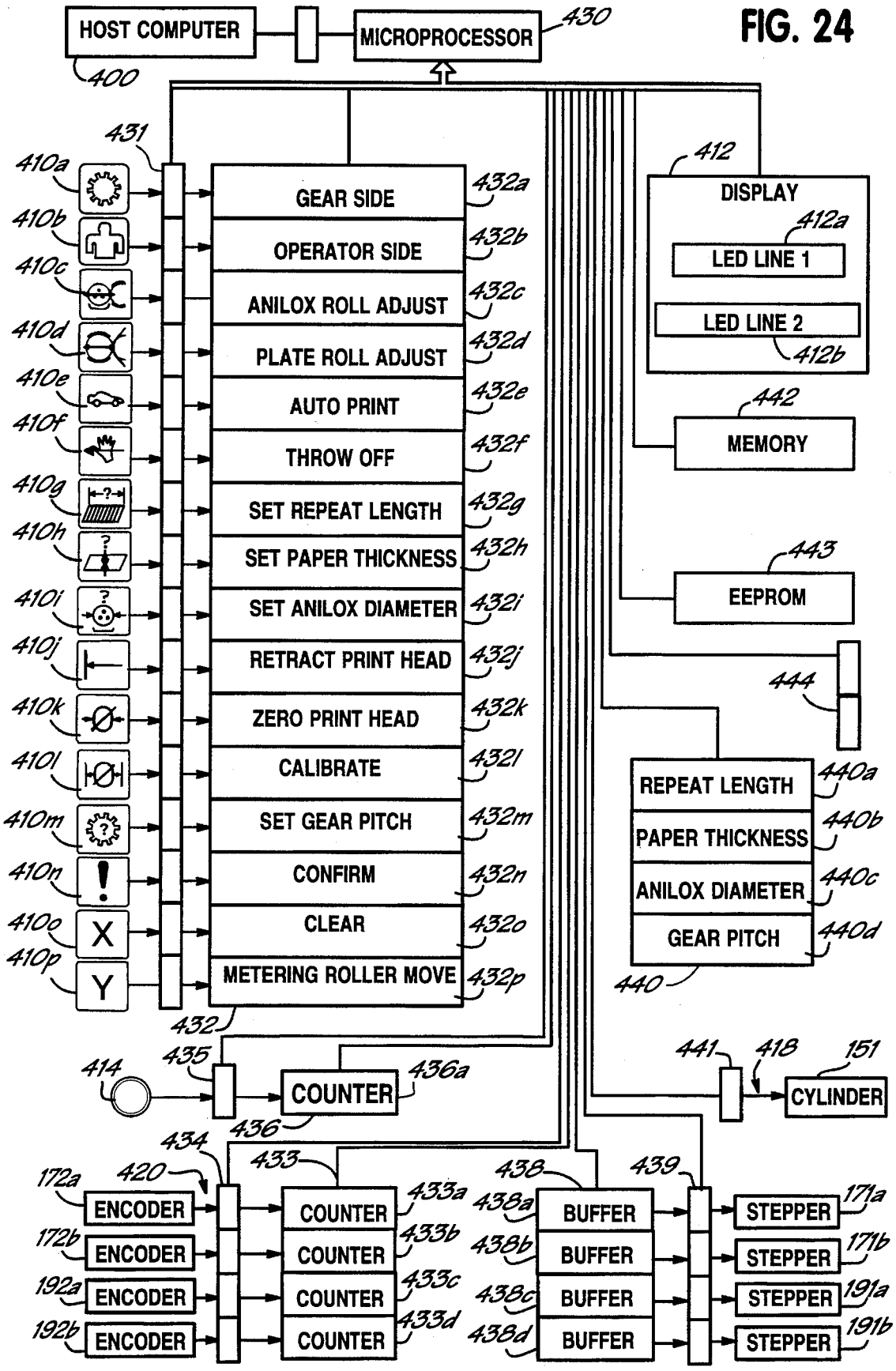
FIG. 24
HOST COMPUTER
400
MICROPROCESSOR
430
431
410a
410b
410c
410d
410e
410f
410g
410h
410i
410j
410k
410l
410m
410n
410o
410p
GEAR SIDE
OPERATOR SIDE
ANILOX ROLL ADJUST
PLATE ROLL ADJUST
AUTO PRINT
THROW OFF
SET REPEAT LENGTH
SET PAPER THICKNESS
SET ANILOX DIAMETER
RETRACT PRINT HEAD
ZERO PRINT HEAD
CALIBRATE
SET GEAR PITCH
CONFIRM
CLEAR
METERING ROLLER MOVE
432a
432b
432c
432d
432e
432f
432g
432h
432i
432j
432k
432l
432m
432n
432o
432p
432
412
DISPLAY
412a
LED LINE 1
LED LINE 2
412b
442
MEMORY
443
EEPROM
444
REPEAT LENGTH
PAPER THICKNESS
ANILOX DIAMETER
GEAR PITCH
440a
440b
440c
440d
440
414
435
COUNTER
436a
436
441
418
151
CYLINDER
434
420
433
438
439
172a
172b
192a
192b
ENCODER
ENCODER
ENCODER
ENCODER
COUNTER
COUNTER
COUNTER
COUNTER
433a
433b
433c
433d
438a
438b
438c
438d
BUFFER
BUFFER
BUFFER
BUFFER
STEPPER
STEPPER
STEPPER
STEPPER
171a
171b
191a
191b

AUTOMATED PRINTING PRESS WITH REINSERTION REGISTRATION CONTROL

This application is a continuation of U.S. patent application Ser. No. 08/102,093, filed Aug. 4, 1993, now abandoned, which is a continuation-in-part of U.S. patent application Ser. No. 08/070,078 filed Jun. 1, 1993, now abandoned.

FIELD OF THE INVENTION

The present invention relates to rotary printing presses having multiple printing stations, in particular, to automated versions of such rotary printing press and more particularly to such automated rotary printing presses for processing continuous substrates.

BACKGROUND OF THE INVENTION

Rotary printing presses with multiple printing stations having various degrees of computer controlled automation for processing continuous substrates or webs are known. The printing stations of such presses are often lined up in a row, with the stations being fixed to one another. Each station usually has its own gear train driven by a drive shaft common to all the stations. Each station has a printing mechanism including some form of rotatable printing element, such as a printing roller, for applying at least one component image of ink or other transferable image forming fluid at spaced apart locations along the length of the web (i.e., every revolution of the rotatable printing element). An impression mechanism having a backing face is used for backing the web while the image is being applied. For many rotary printing presses, such as rotary flexographic printing presses, the printing mechanism includes a printing plate mounted to the printing roller for applying the image to the web and an anilox roller with some form of inking mechanism (such as a metering roller or doctor blade assembly and ink reservoir) for dispensing measured amounts of ink or other such fluid to the printing plate. The impression mechanism is typically a rotatable impression cylinder roller. The gear train of each station usually drives the rotation of each of these rollers. With such multiple station presses, a single colored portion (i.e., component image) of a final composite image is printed at each station. Each of the component images are intended to be printed in register with respect to one another both longitudinally and transversely on the web.

Once one printing job has been completed, the printing mechanism of each of the printing stations (being used for the next printing job) will likely need to be changed or otherwise serviced in some way and repositioned for printing. For example, the printing roller may be replaced and the printing mechanism moved into a new position for printing. Such printing presses have to be shut down in order to prepare or set up the applicable printing stations for the next printing job. Oftentimes, the time it takes an operator to set up the printing press for the next printing job takes longer than the printing run itself. Every minute that the printing press is shut down in order to set up for the next printing job is time not spent running a printing job and generating revenue.

A number of prior printing presses have included automated systems for reducing set up times. These systems have varied in their degree of automation. Some of these automated set up systems have included positioning mechanisms for automatically moving rollers of the printing mechanism to and from various positions during preparation of the press for printing. Two such systems are disclosed in U.S. Pat. Nos. 4,413,560 and 5,060,570.

Attempts to reduce set up times have also included combining the printing mechanism of each printing station into a removable unit or cassette which may be replaced with another unit, previously prepared for the next printing job. See for example, U.S. Pat. Nos. 4,462,311 and 5,060,569.

While these prior efforts in reducing set up times have had some success, there is still a need for a more automated multiple station rotary printing press which can be changed from running one printing job to another in a shorter period of time.

A major problem encountered with multiple station rotary printing presses is consistently maintaining the quality of the images being printed, both print quality and image registration. Print quality problems, such as barring, have been known to chronically plague multiple station rotary printing presses. The registration of each partial or component image must be monitored and maintained to insure the quality of the final composite images. A number of prior printing presses have included computer controlled registration systems for automatically maintaining registration. The degree of success in consistently maintaining registration (i.e., positioning of the component images) over the length of the web has been found to generally vary from system to system. Inconsistency in maintaining print quality and registration control may increase the length of web that has to be scraped (i.e., the scrap rate) and limit the type of printing jobs that can be adequately run on a given press.

The assignee of the present invention has utilized a computer controlled registration system 500, illustrated in FIG. 22, for controlling longitudinal positioning of the component images on the web 501 (i.e., circumferential registration of the printing roller) in a previously manufactured multiple station flexographic rotary printing press 502 for processing narrow webs (i.e., webs having widths of about 19 inches (48 cm) or less). That flexographic printing press typically had two sets 503, 504 of six printing stations 505–510 and 511–516 with each set having one computer 550 controlling circumferential registration. Each station had a frame 517 with a gear train side 518 and an operator side 519 with the printing mechanism rollers 520, 521 therebetween. For each station, the shaft 525 mounting the impression roller 520 was powered off of a common drive shaft 526 through a worm gear set 527 located outside the gear train side of the station frame. The printing plate roller 521 of each printing station was individually rotated by the common drive shaft through a separate branch 528 of the station gear train driving a gear 535 on the printing roller 521. Circumferential registration of each station's component image was controlled by slowing down or speeding up the rotation of the printing roller 521 while maintaining the speed of the web 501 through the station. A single harmonic gear assembly 530, similar to that disclosed in U.S. Pat. No. 3,724,368, was connected within the separate gear train branch 528. The single harmonic gear assembly 530 was mounted on one end of a jack shaft 531 outside the gear train side 518 of the station frame 517 and downline of the impression roller 520. The jack shaft 531 was journaled at either end to the sides of the station frame. A gear 532 fixed to the impression roller shaft 525, between the worm gear set 527 and the gear train side 518 of the station frame 517, engaged and drove an outer gear 533 on the single harmonic gear assembly 530. The single harmonic gear assembly 530, in turn, rotated the jack shaft 531, driving a tooling gear 534 fixed to the jack shaft just inside the gear train side 518 of the station frame 517. The jack shaft tooling gear 534 drove another tooling gear 535 fixed to the shaft of the printing roller 521 through an idler tooling gear 536 mounted for free rotation about the impression roller shaft. Only the printing roller 521 was driven by the single harmonic gear assembly 530. All three tooling gears 534, 535 and 536 were spur gears, generally coplanar and located just inside of the gear train side 518 of the station frame 517. The single harmonic gear assembly 530 had a one percent difference in gear ratios. In order to compensate for this difference, the gear ratio between the impression roller gear 532 and the outer gear 533 on the single harmonic gear assembly 530 was made 100:101. A standard DC motor 537 was connected to a drive shaft 526 inside the single harmonic gear assembly which, when activated caused the jack shaft 531, and thereby the printing roller 521, to rotate at a different speed than the impression roller 520 or the common drive shaft 526. The impression roller 520 helped carry the web 501 through the printing station (505, . . . , 516). Thus, actuation of the single harmonic gear assembly 530 effected phase changes between the rotational speed of the printing roller 521 and the speed of the web 501.

To bring the component images of this earlier version of the assignee's Flexographic Rotary Printing Press into initial circumferential registration (i.e., preregistration), an operator would adjust the relative circumferential position of each printing roller 521 by activating the DC motor 537 of the appropriate single harmonic gear assembly 530 at switch 539. Preregistration was effected manually and took place with the press shut down. In controlling circumferential registration with the web 501 running through the press 502, the plate roller 521 of the first printing station 505 would print a mark 538 (a transverse bar) on the web 501 every revolution of the printing roller 521. The printing roller 521 at each subsequent printing station 506–516 downline from the first station had a separate mark 540 which rotated along with the printing roller. Two optical sensors 541, 542 were mounted to each station frame 517, one 541 for monitoring each of the web marks 538 as they passed by and the other 542 for monitoring the rotation of the station's printing roller mark 540. An encoder 544 was connected to the common drive shaft 526 of the printing press 502. This encoder 544 generated a certain number of electrical pulses every revolution of the common drive shaft 526 as well as the rollers driven thereby, including the impression rollers 520. Each computer 550 had a counter 551 for counting these pulses. Each sensor 541, 542 was basically a switch that turned on and off when a mark 538, 540 was sensed. Each computer 550 was programmed to read a pulse count directly from its counter 551 each time a mark 538, 540 triggered its respective sensor 541, 542 for any of the six stations connected to the respective computer 550. Each computer 550 was also programmed to read one pulse count and then the other pulse count for the pair of marks 538, 540 each revolution of the printing roller 521 at each of its six stations. These pulse count readings were then each stored in a register or section of memory 561, 562 respectively corresponding to the relative position of a mark 538, 540 for each respective station connected to the respective computer 550. After obtaining a pulse count for each mark from a station, the appropriate computer 550 subtracted the two numbers to obtain a difference count equal to the number of pulses between the two marks. This difference count was also stored in a register 563 for the respective station. The sequence in which the computer 550 acquired and analyzed the pulse count for the marks 538, 540 at each of the different printing stations depended upon the order in which each station's marks were sensed. The computer would not begin a new cycle of searching for the marks, acquiring pulse counts and analyzing the data at all six stations until the marks at each station for the previous cycle were analyzed or three unsuccessful attempts at searching for the marks had been made. If both marks at a given station were not sensed in one revolution, for whatever reason, the computer 550 was programmed to continue searching for up to three revolutions of the printing roller 521 before abandoning the search and starting a new cycle.

The setting of optimum circumferential position of each printing roller in a given set of stations relative to the web was stored in a corresponding location in a memory 555 in the respective computer 550 as a number of pulses (i.e., a count) between the sensing of the printing roller mark 540 and each web mark 538. This optimum position was subtracted from the difference count to produce an error value that was stored in a register 564 or memory location corresponding to the respective station. The optimum position of each printing roller 521 was a quality determination previously made by an operator. This error count was compared with a tolerance range value stored in a memory 556. If the pulse count between the marks fell outside of an acceptable range initially determined by the operator and stored in the memory 556 by the operator, the computer 550 sent a corresponding signal to a driver 565 that actuated the DC motor 537 on the appropriate single harmonic gear assembly 530 of the corresponding station to thereby effect a phase change and rotate the applicable plate roller 521 back into registration. In making these registration corrections, the appropriate DC motor 537 would be turned on by the applicable computer 550 at the beginning of a repeat length (i.e., the distance between successive web marks) and allowed to continue running for a period of time programmed to be approximately equal to the number of pulses (i.e., counts) the image was out of register. The period of time programmed to correspond to one count could be varied. Thus, each computer 550 acquired the data (i.e., the pulse count) for the marks 538, 540 at each of the six stations 505–510 and 511–516 in its respective set 503, 504, analyzed the data (i.e., compared it with the optimum count) and then made the appropriate corrections.

It is often desirable to subject a web to more than one printing run. For example, it may be desirable to run the web through a flexographic printing press, subject the web to an intermediate printing operation, and then reinsert the web through the flexographic printer for another printing run. When a web is subjected to multiple printing runs, the web is likely to go through dimensional changes which often vary along the length of the web. As the web changes dimensionally, so do the images previously printed on the affected areas of the web. Therefore, besides circumferential registration control, there is a need for a computer control system capable of making corrections for such dimensional changes during subsequent printing operations (i.e., reinsertion control).

The previously manufactured multiple station flexographic rotary printing press 502 of the assignee of the present invention included a reinsertion control system. In the prior reinsertion control system, a central computer took one or more readings of the registration errors from each operating printing station in the press and then averaged all of these values to arrive at a reinsertion error. The average of consecutive registration errors represented the repeated differences between the repeat length of the press and spaces between preprinted web marks (i.e., actual repeat lengths). This difference is attributed to dimensional changes in the web and is defined as the reinsertion error. The original web marks 538 printed during the initial printing run were sensed for the registration control during the subsequent printing runs. This central reinsertion computer was alternatively provided with the programming option of giving current readings more weight than older readings or weighing the readings from each station the same. Based on the average of these readings, the reinsertion control computer would simultaneously make the same reinsertion error correction for this average error at each operating printing station, on a continuous basis. The correction was applied as a signal that was added to the circumferential registration control signal. As with the prior circumferential registration control correction, the reinsertion corrections were made by circumferentially adjusting the appropriate printing roller 521 with the single harmonic gear assembly 530 driven by a motor responsive to analog pulse width control signals.

Notwithstanding the prior art, there remains a continuing need for an even more fully automated and cost effective multiple station rotary printing press that is able to even more consistently maintain print quality and image registration, even when the web is reinserted, and which takes less set up time to change from running one printing job to another.

SUMMARY OF THE INVENTION

It has been an objective of the present invention to provide a more fully automated and cost effective multiple station rotary printing press.

Another objective of this invention has been to provide a printing press which is able to more consistently maintain print quality and image registration, even during the printing of a previously printed web.

Still another objective of this invention has been to provide a printing press which takes less set up time to change from running one printing job to another.

The rotary printing press of the present invention which accomplishes these objectives includes a plurality of printing stations for transferring at least one composite image at spaced apart locations along the length of a continuous substrate being run through the plurality of printing stations. Each printing station of this printing press has a frame, a printing mechanism carried by the frame for applying at least one component image at spaced apart locations along the length of the continuous substrate and an impression mechanism, also carried by the frame, to back the continuous substrate each time a component image is being applied by the printing mechanism. The continuous substrate is carried within the frame with its path directed through the station between the printing mechanism and the impression mechanism.

The printing mechanism of this printing press includes some form of rotatable printing element, such as a printing roller, mounted for rotation within the frame for applying at least one component image of transferable image forming fluid, like ink, to the continuous substrate. It is envisioned that the rotatable printing element may be any one of a variety of printing rollers, such as those used in flexographic, offset, rotary letter press and other types of printing. Use of a tubular stencil like that used in rotary screen printing is also envisioned. The printing mechanism also includes some form of fluid dispensing system for dispensing the transferable image forming fluid to the rotatable printing element. For example, an anilox roller can be used to dispense a measured amount of a fluid, such as ink, from an inking mechanism (such as a metering roller or doctor blade assembly and ink reservoir) to the printing roller.

Each station includes a circumferential adjustment mechanism, such as a harmonic gear assembly, for adjusting the rotational speed of the rotatable printing element independent of the speed of the continuous substrate as it runs through the printing station. A computer controlled circumferential registration system controls the actuation of the circumferential adjustment mechanism in order to automatically change the circumferential orientation of the rotatable printing element relative to the continuous substrate. The rotatable printing element is automatically adjusted circumferentially in order to correct for circumferential registration errors of the component images being applied to the continuous substrate. Circumferential adjustment of the rotatable printing element relative to the continuous substrate is preferably accomplished by actuating the circumferential adjustment mechanism with the proper number of correction pulses through a DC stepper motor. Such pulsing of the stepper motor increases or decreases the rotational speed of the rotatable printing element enough, relative to the continuous substrate, to bring printing of the images back into registration.

The present computer controlled circumferential registration system maintains more accurate image registration than previous computer controlled circumferential registration systems. This system can make such corrections within about one repeat length or less after an error has been detected.

The computer controlled registration system of the present invention is provided with a special reinsertion feature for situations in which the continuous substrate has gone through dimensional changes which vary along the length of the substrate. For example, this may occur when the continuous substrate is subjected to multiple printing runs. Where the substrate changes dimensionally, so do old composite images previously printed on the affected areas of the substrate. The reinsertion feature makes corrections for such dimensional changes to the continuous substrate. In order to bring newly printed component images into closer circumferential registration with the old composite images, the reinsertion feature stretches or shrinks the newly printed component images as they are being applied to the continuous substrate. This is accomplished by independently measuring the spacing between web marks at each printing station and statistically analyzing the errors with the separate printing station computers to determine the reinsertion error component. The reinsertion error is corrected by evenly spacing circumferential registration correction pulses over the repeat length at each individual printing station and thereby varying the speed at which the rotatable printing element is rotated relative to the traveling speed of the continuous substrate. The host computer is preferably a monitoring system capable of making adjustments (i.e. changing variables) in the program of each printing station. The host computer, preferably does not control logic operations of the individual printing stations. The host computer may also alternatively analyze data from each of the printing stations and supplement the logic from the individual computers to more intelligently predict the reinsertion error at each station and the progression of changes in the error through the printing stations of the press.

Preferably, each printing station of this printing press may also includes a positioning mechanism for bringing the printing mechanism to a desired position relative to the impression mechanism. One such position is a printing position where the printing mechanism is in position to apply at least one component image of the transferable image forming fluid to the continuous substrate every revolution of the rotatable printing element. Another position includes at least one non-printing position where the printing mechanism is not in a position to apply a component image to the continuous substrate. A computer control positioning system is used to control the actuation of the positioning mechanism in order to automatically bring the printing mechanism into and out of position for printing.

The positioning mechanism preferably includes a first positioning mechanism for moving the rotatable printing element relative to the impression mechanism and a second positioning mechanism for moving the fluid dispensing system relative to the rotatable printing element. The computer control positioning system of this invention controls the actuation of each positioning mechanism in order to bring the printing mechanism in and out of position for printing.

In a preferred embodiment, the positioning mechanism includes two spaced apart upper carriages slidable along two plane rectilinear slides mounted above respective lower carriages. The lower carriages are, in turn, slidable along two plane rectilinear slides mounted on either side of a base platform. The rotatable printing element is mounted at either end to the lower carriages. The fluid dispensing system is mounted between the upper carriages. For a printing mechanism where the rotatable printing element is a printing roller, the fluid dispensing system includes some form of rotatable fluid dispensing element, such as an anilox roller, and some form of inking mechanism, and the impression mechanism is an impression roller, with the carriages designed so that at least the impression roller, printing roller and anilox roller are coplanar. This coplanar relationship has been found to facilitate computer control positioning of the printing mechanism. A DC stepper motor is used to adjust the position of each carriage. An encoder is connected to each stepper motor to provide feedback to the computer control positioning system on whether its respective stepper motor is actuated and how much the position of its respective carriage is adjusted.

Each printing station has a gear train with a separate branch for driving the rotation of the rotatable printing element. To reduce the likelihood of gear backlashing, and resulting print quality problems, it is desirable for the gear train to include a movable gear assembly which is movable in and out of position to engage and drive a gear mounted to the rotatable printing element. Preferably, the movable gear assembly includes a leading gear which is swingable in and out of position to engage and drive the gear mounted to the rotatable printing element. When both the printing and fluid dispensing elements of the printing mechanism are rotatable and coplanar, the gear train preferably includes another branch capable of driving the rotation of the fluid dispensing element at either the printing or non-printing positions while still enabling the coplanar relationship to be maintained. In one embodiment, this other branch of the gear train includes an articulating gear assembly with a separate motor for driving the rotation of the rotatable fluid dispensing element independent of the balance of the gear train.

In a preferred embodiment, each printing station also includes an axial adjustment mechanism for simultaneously adjusting the transverse position of the rotatable printing element and the fluid dispensing system within the frame. A computer control axial registration system controls the actuation of the axial adjustment mechanism in order to automatically and simultaneously move transversely the rotatable printing element and the fluid dispensing system relative to the web substrate. The rotatable printing element and the fluid dispensing system are moved to a desired transverse position to correct for axial registration errors of the component images being applied to the continuous substrate. Thus, with this embodiment of the present printing press, both registration of the component images (axial and circumferential registration) and adjustment of the printing mechanism (in and out of position for printing) may be automatically controlled.

It is preferable for each printing station of the present printing press to include an auxiliary frame having a base platform which is transversely movable from side-to-side across the frame and carries the rotatable printing element and the fluid dispensing system. An off-line adjustment mechanism is used to transversely move the base platform. The base platform can be moved to an operational position in which the rotatable printing element and the fluid dispensing system are within the frame. The base platform can also be moved to a stand-aside position in which a sufficient portion of the base platform extends out beyond one side of the frame to enable at least the rotatable printing element and the fluid dispensing system to be serviced. In addition, the base platform is self-supportive within the frame when in the stand-aside position. The rotatable printing element and the fluid dispensing system are also carried completely on the base platform when in the stand-aside position. A computer control off-line adjustment system is used to control the actuation of the off-line adjustment mechanism in order to automatically move the auxiliary frame to and from the operational position and stand-aside position.

Most multiple color printing jobs usually employ no more than six printing stations (i.e., six different colored component images). The present printing press typically includes 12 printing stations. Thus, in one embodiment of the present printing press, the printing mechanism (at least the rotatable printing element and fluid dispensing system) can be automatically moved out of position for printing and out beyond one side of the frame, enabling a number of the printing mechanisms to be serviced and set up for the next printing run while the balance of the printing stations are running a different printing job.

It is also preferable for each of the printing stations to include a computer control pre-registration system. This system controls the actuation of the circumferential adjustment mechanism in order to automatically rotate the rotatable printing element to a pre-programmed circumferential orientation which brings the rotatable printing element into approximate circumferential registration with the other rotatable printing elements. This automatic pre-registration occurs before the printing press begins a printing run.

The above and other objectives, features and advantages of the present invention will become further apparent upon consideration of the following description taken in conjunction with the accompanying drawings.

BRIEF DESCRIPTION OF THE DRAWINGS

FIG. 24 is a block diagram of a preferred embodiment of the positioning controller of the computer control system of FIG. 23.

DETAILED DESCRIPTION OF THE INVENTION

Figure 1:
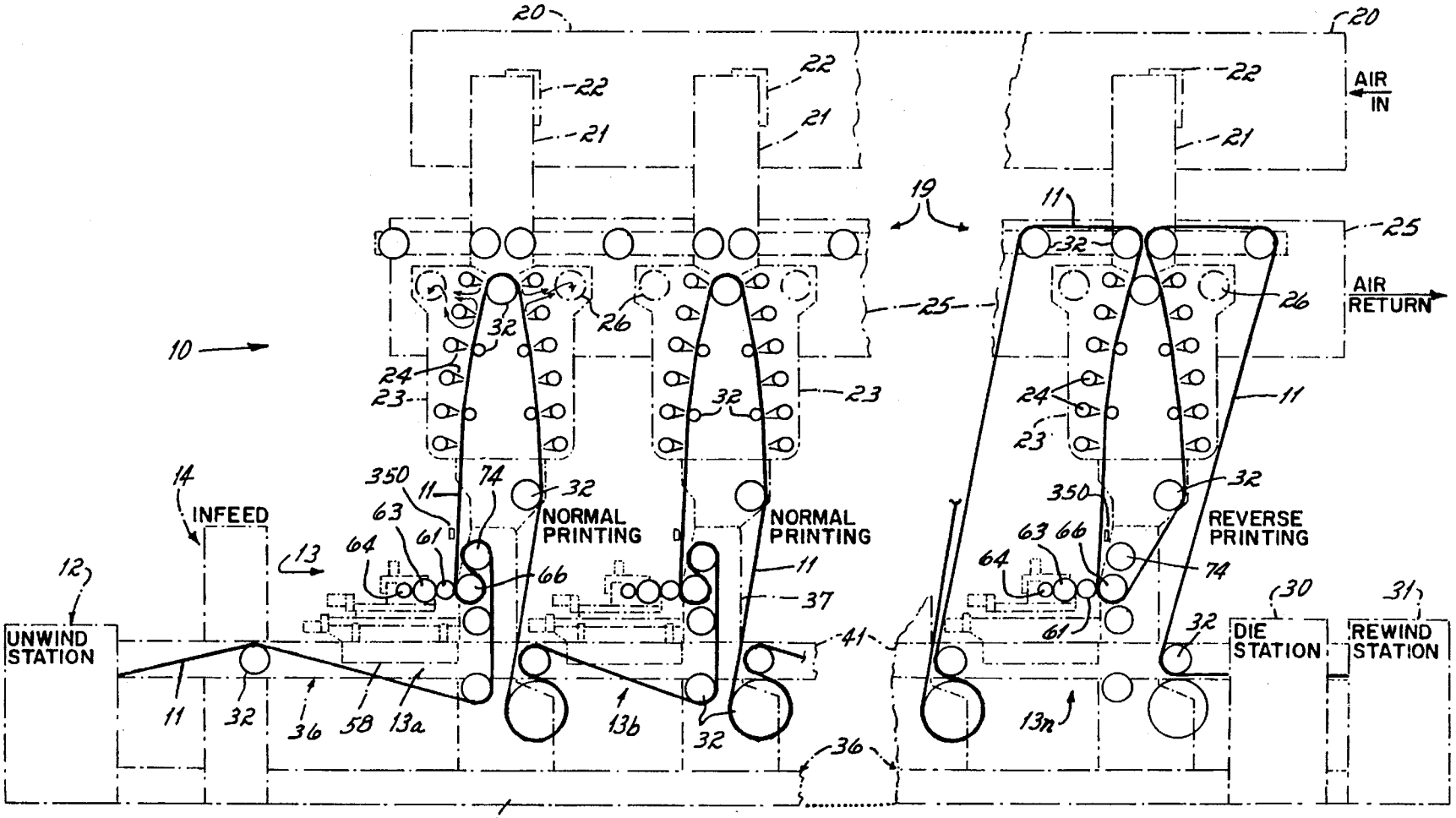
FIG. 1 is an operator side view of one preferred embodiment of the automated printing press of the present invention.
Figure 2:
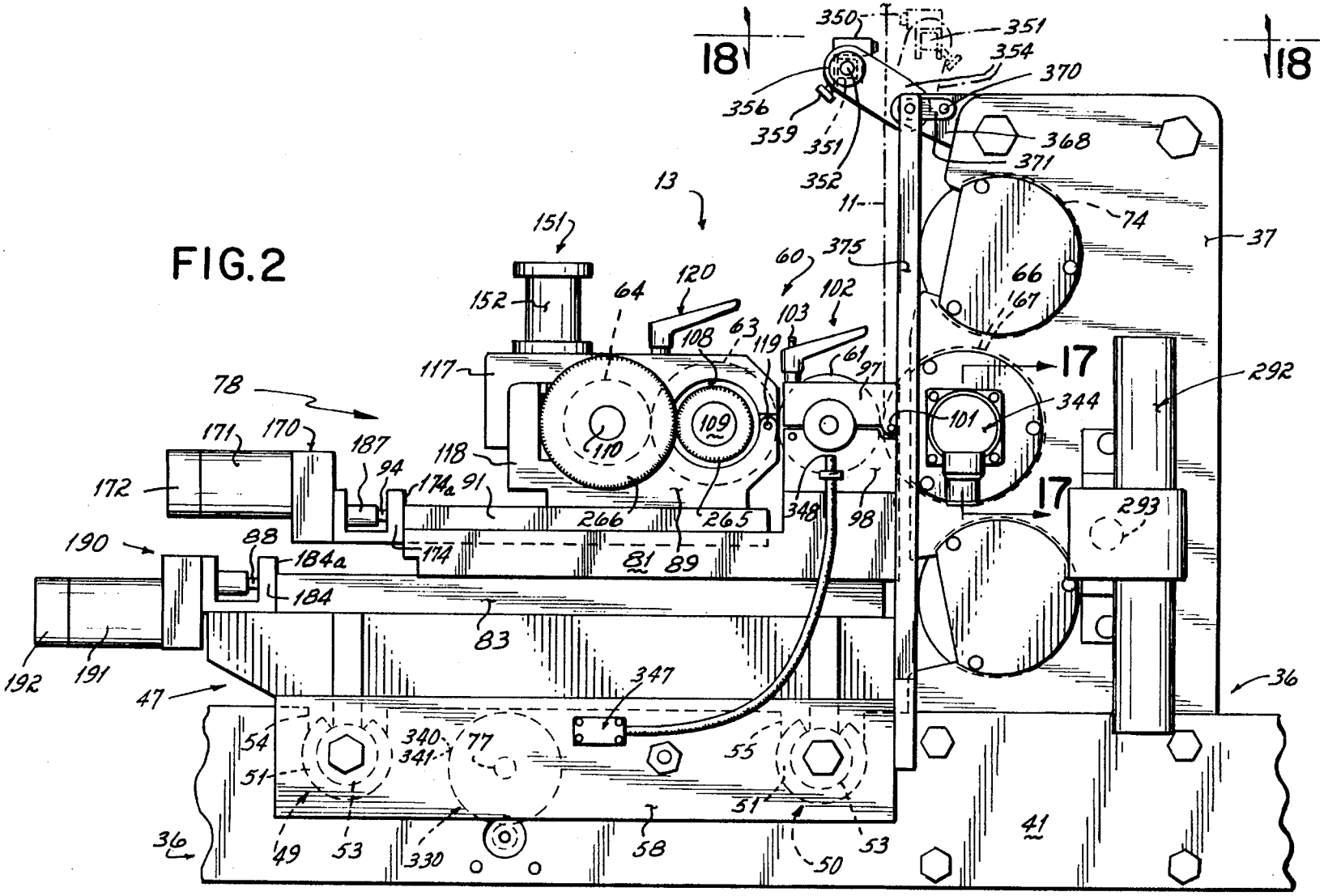
FIG. 2 is an enlarged operator side view of a portion of one of the printing stations of the automated printing press of FIG. 1.

Referring to FIG. 1, an automated rotary printing press 10 is shown, according to the present invention, for printing at least one composite image at spaced apart locations along the length of a continuous substrate or web 11. The particular printing press 10 herein disclosed by way of example is a flexographic rotary printing press 10 for processing webs 11 with a width of about 19 inches (48 cm) and smaller. It is believed that the basic design of this exemplary press 10, as described in detail hereafter, would be suitable for a printing press capable of handling up to 40 inch (101 cm) wide webs 11. The webs 11 used in such flexographic printing presses 10 come in spools (not shown). The press 10 includes an unwind station 12 for carrying the spool of web 11 during unwinding of the web 11 and an infeed station 14 for feeding the web 11 into the press 10. Such unwind and infeed stations 12 and 14 are well known in the industry. The press 10 also has a plurality of printing stations 13 lined up in a row with a first printing station **13*a* and a plurality of subsequent printing stations 13*b*–13*n* downline of the first printing station 13*a*. As herein used, downline refers to the direction toward which the web 11 travels through the press 10 (i.e., away from the unwind station 12) and upline refers to the direction from which the web 11 travels (i.e., toward the unwind station 12). Each printing station 13 applies at least one component image of transferrable image forming fluid, such as a single color printing ink, at spaced apart locations along the length of the web 11. The single color component images applied at the printing stations 13 are intended to be printed in line or in register with each other, both longitudinally (i.e., circumferential registration) and transversely (i.e., axial registration) on the web 11, in order to form the final composite image. As used herein, transverse refers to the direction going from one side edge of the web 11 to the other and longitudinal refers to the direction from one end of the web 11 to the other (i.e., parallel to the direction web 11 travels). Usually, no more than six printing stations 13 (i.e., single color component images) are used to produce a desired multi-colored composite image. For reasons which will become apparent later on, such flexographic rotary printing presses 10 typically include up to twelve printing stations 13. With the present press 10, any desirable number of the printing stations 13 can be utilized while the balance of the printing stations 13 remain idle (i.e., do not apply a component image) as the web 11** passes therethrough.

The printing press 10 also includes a curing system 19 for curing each component image applied at a given printing station 13 before the next component image is applied by the following printing station 13. Any industry accepted system for curing images printed with a particular fluid may be used. When dryable inks are used, the curing system 19 may employ high velocity heated air to dry the applied component images. Such an ink drying system 19 is preferably positioned above the stations 13. A common air intake manifold 20 is connected to each printing station 13 through a combustion chamber 21. Air passing through chamber 21 from intake manifold 20 is heated with a gas burner 22. The freshly printed web 11 at each printing station 13 travels through a drying chamber 23. Heated air from the combustion chamber 21 is funnelled through multiple nozzles 24 located in the drying chamber 23. The nozzles 24 are positioned to direct the heated air against the printed surface of the web 11 as the web passes through chamber 23. Air exiting nozzles 24 is then drawn from chamber 23, which is kept at a negative pressure, into and through a return manifold 25 via ports 26, common to all the stations 13, and exhausted. While a hot air drying system has herein been described, it is understood that any curing system which adequately cures the component images before a subsequent component image is applied could be used.

The printing press 10 may include a die station 30 after the last printing station **13*n*. Such die stations 30 are well known in the industry and used to separate that portion of the web 11 on which the component image is printed from the surrounding balance of the web 11. The now processed web 11 is then rewound into a spool at a rewind station 31, also well known in the industry. The printing press 10 uses a plurality of idler rollers 32 to help direct the path of the web 11 through the press 10**.

Printing Station Frame

Referring to FIGS. 1–5, each printing station 13 has a frame 36 which includes a first vertical support panel 37 and a second vertical panel 38 spaced apart on opposite sides of the press 10. As herein used, references to a front or operator side of the press 10 refer to the side shown in FIG. 1. References to a back or gear train side of the press 10 refer to the side opposite from that shown in FIG. 1.

A first base member 39 and a second base member 40 are fastened to the bottom of respective support panels 37, 38. A first horizontal support bar 41 and a second horizontal support bar 42 are fastened about midway up respective support panels 37, 38 above the base members 39, 40. The printing stations 13 are tied together in a row, one after another, by fastening together corresponding base members 39, 40 and support bars 41, 42. The distance between successive printing stations 13 is thereby maintained. Cross beams 43 are fastened between each pair of support panels 37, 38 wherever necessary to help maintain the spacing therebetween.

Each printing station 13 in the preferred embodiment of the present printing press 10 includes an auxiliary frame 47 having a base platform 48 transversely movable across the frame 36. As used herein, transverse refers to the direction going from one side of the press 10 to the other and longitudinal refers to the direction from one end of the press 10 to the other (i.e., between the unwind and rewind stations 12, 31). The auxiliary frame 47 is located adjacent to and upline from the support panels 37, 38. The auxiliary frame 47, via base platform 48, is mounted for transverse sliding across the support bars 41, 42 by a first or upline linear bearing assembly 49 and a second or downline linear bearing assembly 50. The base platform 48 has a transverse length or depth which is about double the distance between the support bars 41, 42 of the frame 36. Each of the linear bearing assemblies 49 and 50 includes a first and second linear ball bushing 51 and 52 and a bearing shaft 53. Each of the shafts 53 is slidably disposed within the pair of respective bushings 51, 52. The bearing shaft 53 of the upline linear bearing assembly 49 is fastened lengthwise along the upline edge of and underneath the base platform 48. The bearing shaft 53 of the downline linear bearing assembly 50 is fastened lengthwise along the downline edge of and underneath the base platform 48. The ball bushings 51, 52 of the upline bearing assembly 49 are each respectively mounted in an upline slot 54 formed in the first and second support bars 41 and 42. The ball bushings 51, 52 of the downline bearing assembly 50 are likewise each mounted in slots 55 formed in respective support bars 41, 42 downline from the upline bearing assembly 49. A single stop plate 58 is fastened to the operator side ends of both bearing shafts 53. One of two keeper plates 59 is fastened to the other (gear train side) end of each bearing shaft 53 of the bearing assemblies 49, 50. The stop plate 58 and two keeper plates 59 effectively limit the transverse movement of the bearing shafts 53 (i.e., the base platform 48) across the frame 36.

Printing Station Printing Mechanism

Each printing station 13 has a printing mechanism or print head 60 for applying at least one component image of transferrable image forming fluid at spaced apart locations along the length of the web 11 as the web 11 passes therethrough. For the exemplary flexographic printing press 10, the printing mechanism 60 includes a printing roller 61, with a printing plate 62 mounted thereto for applying at least one component image to the web 11 with each revolution of the roller 61. Measured amounts of ink or other fluid is dispensed to the printing plate 62 by an anilox roller 63. The anilox roller 63 is supplied with the ink by some form of inking mechanism, such as a metering roller 64 submerged in an ink reservoir 65 (shown only in FIG. 3 and in phantom in FIG. 5). The typical structure and function of these rollers 61, 63 and 64, and the ink reservoir 65 are well known to those skilled in the flexographic printing art and need not be described in detail herein. Other inking mechanisms (not shown), such as a doctor blade and ink reservoir assembly, well known in the art, may also be used. One such doctor blade assembly can be found in U.S. Pat. No. 4,590,855, which is incorporated in its entirety herein by reference.

Each printing station 13 also has an impression mechanism 66 with a backing face 67 for backing the web 11 while a component image is being applied thereon by the printing mechanism 60. Preferably, the impression mechanism 66 is an impression cylinder roller, with its outer surface being the backing face 67. The printing mechanism 60 is fully carried by the base platform 48 of the auxiliary frame 47. The impression roller 66 is journaled at either end for rotation between the vertical support panels 37 and 38, downline from the printing mechanism 60. Another roller 74 is journaled at its ends for rotation between panels 37 and 38, above and slightly downline from impression roller 66. During normal printing operations, the web 11 is wrapped around both rollers 66 and 74 in an S-shape and passes up through the nip between printing roller 61 and impression roller 66, as shown in FIG. 1 (stations 13*a* and 13*b*). When it is desirable to also print on the opposite side of web 11, the web 11 is fed down between the printing roller 61 and impression roller 66 and around roller 66, by-passing roller 74 completely, as shown in FIG. 1 (station 13*n*).

Each printing station 13 includes a gear train 68 driven by a drive shaft 69 common to each printing station 13. The common drive shaft 69 also powers the die station 30 through a planetary output gear box (not shown) in a conventional manner. While in the operational position, the back end of the base platform 48 sticks out beyond the gear train side of the printing station 13 while the front end of the platform 48 is generally flush with the operator side of the station 13. Thus, the platform 48 does not obstruct an operator's freedom to move along the operator side of the press 10 while the platform 48 is in the operational position. As is described later on, the common drive shaft 69 drives the rotation of the impression cylinder roller 66 and thereby each of the rollers 61, 63 and 64 of the printing mechanism 60, as well as roller 74. Because it is driven, roller 74 is able to help feed the web 11 through each station 13 set up for normal printing, as described above.

Off-Line Servicing of Printing Mechanism

Figure 3:
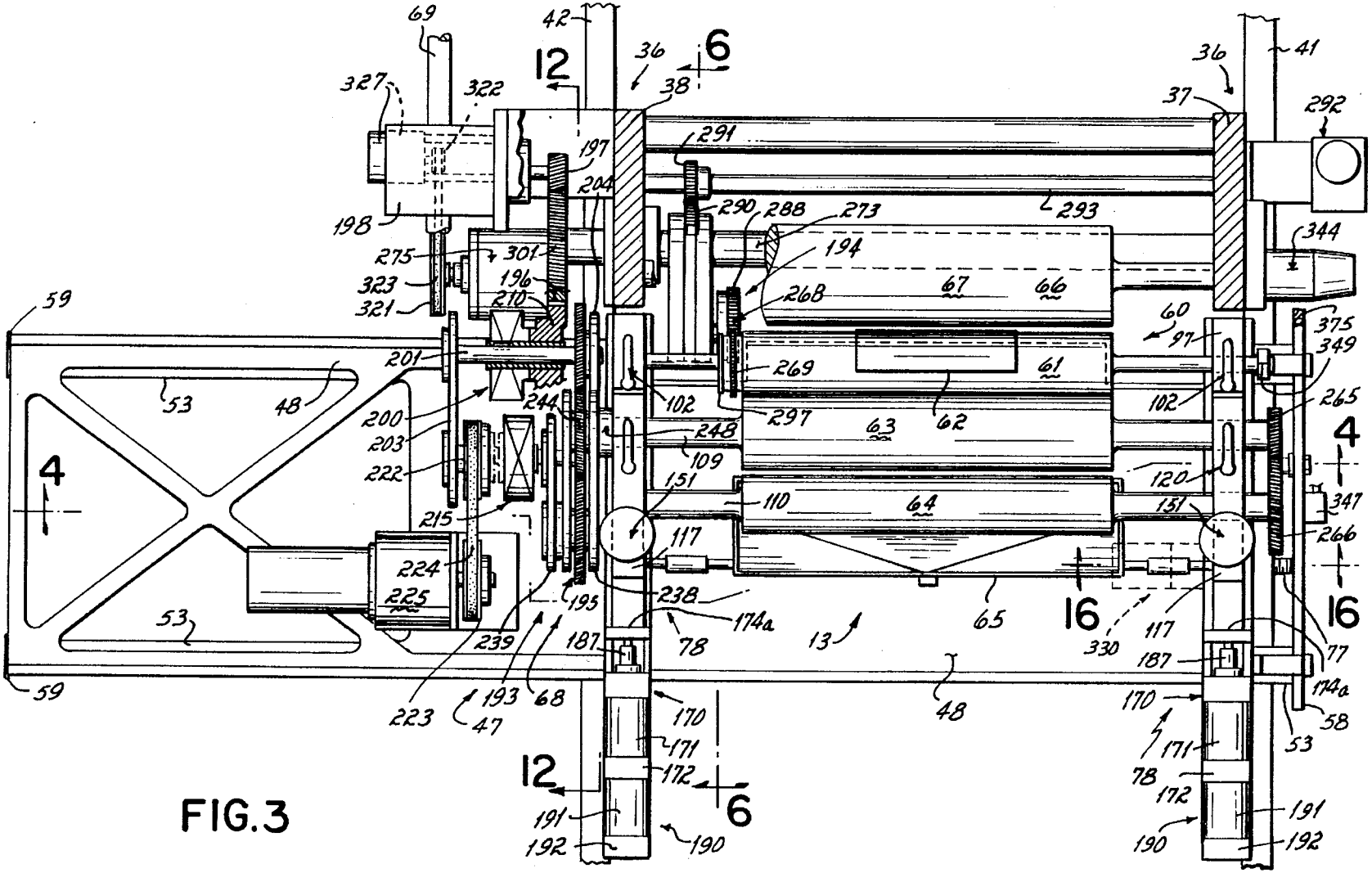
FIG. 3 is a top view of the printing station of FIG. 2.
Figure 4:
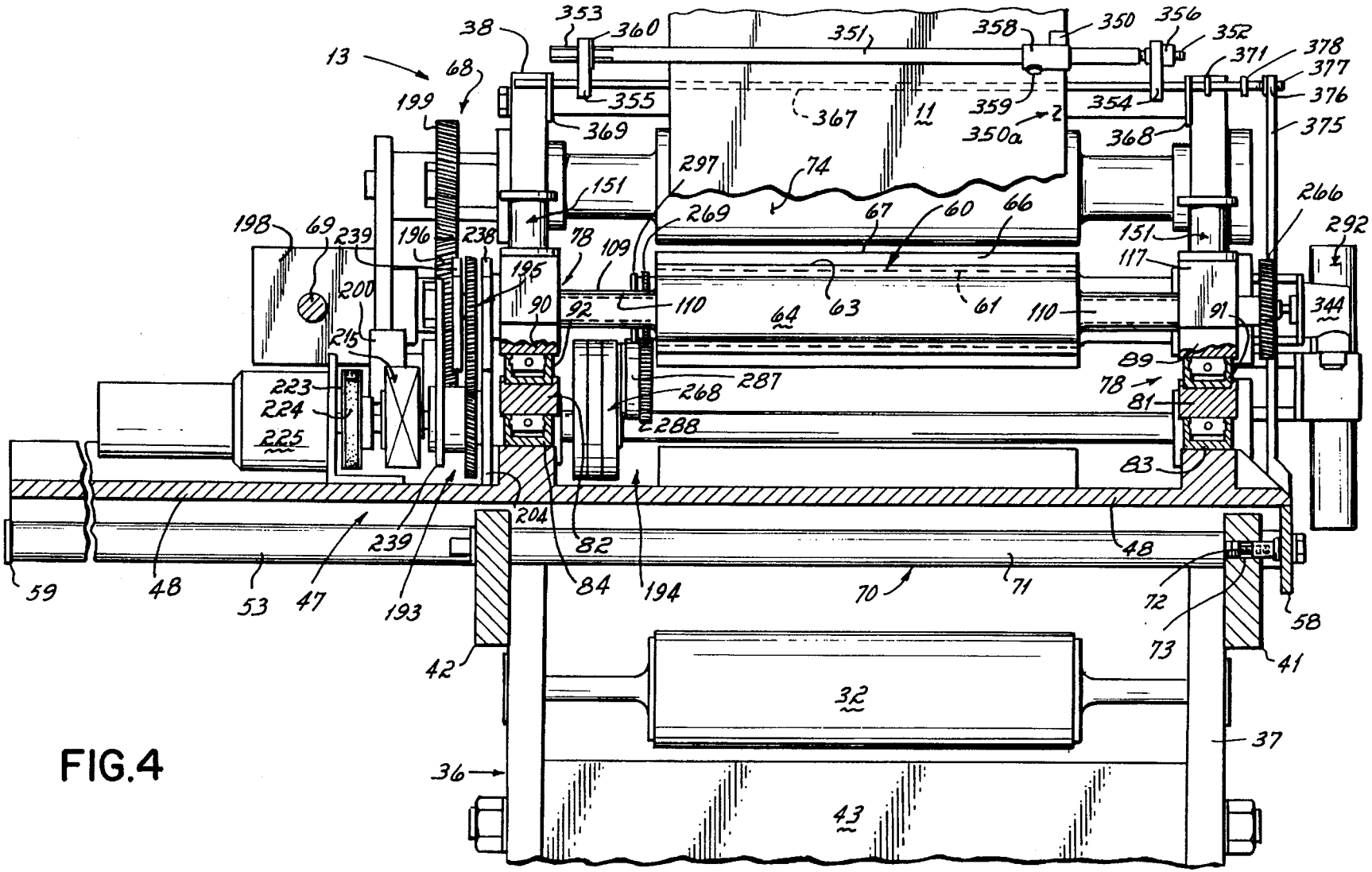
FIG. 4 and 5 are sectional views taken along line 4—4 of FIG. 3 showing the auxiliary frame of the present invention in an operational and stand-aside position, respectively.
Figure 5:
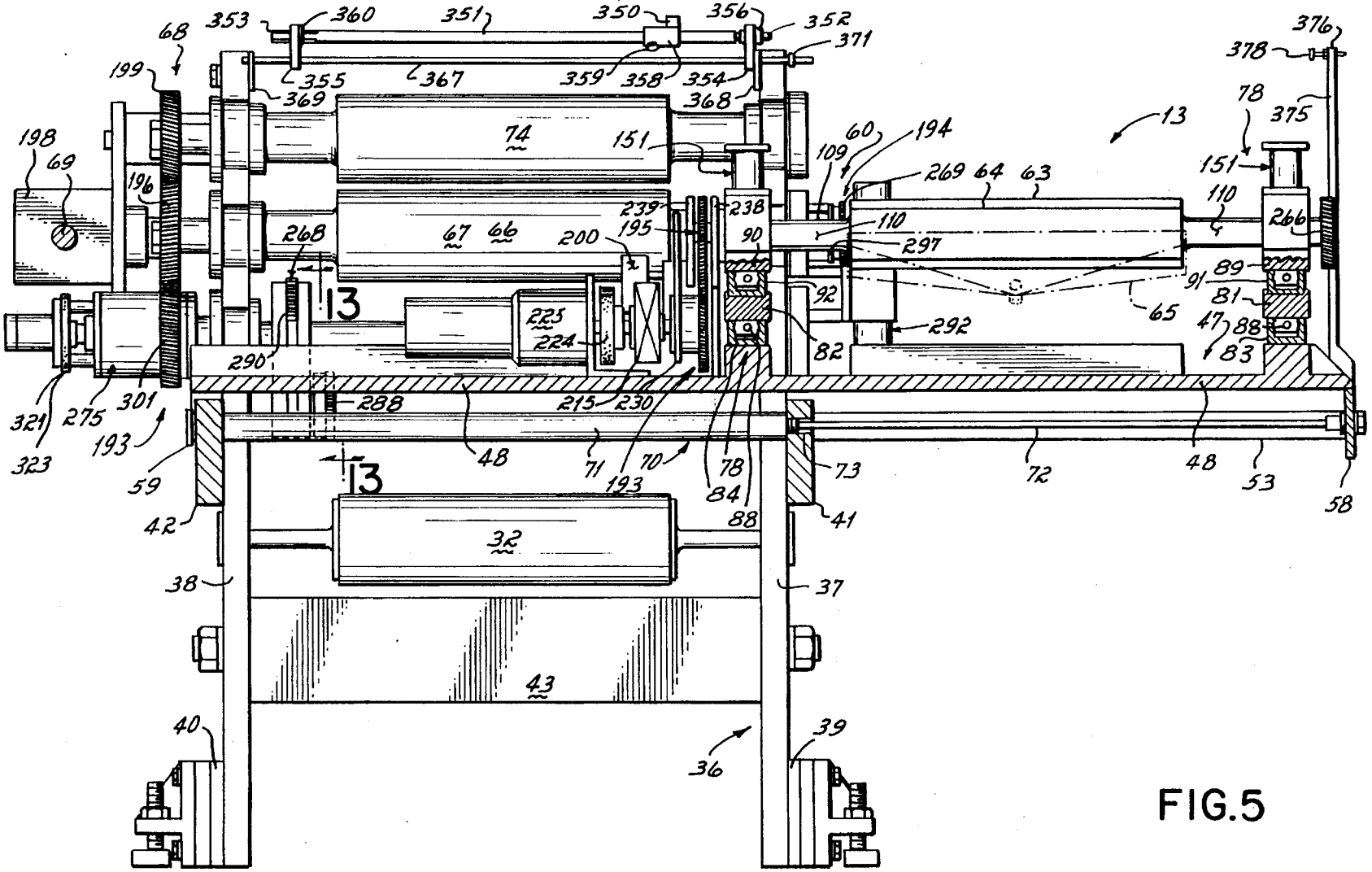
Figure 6:
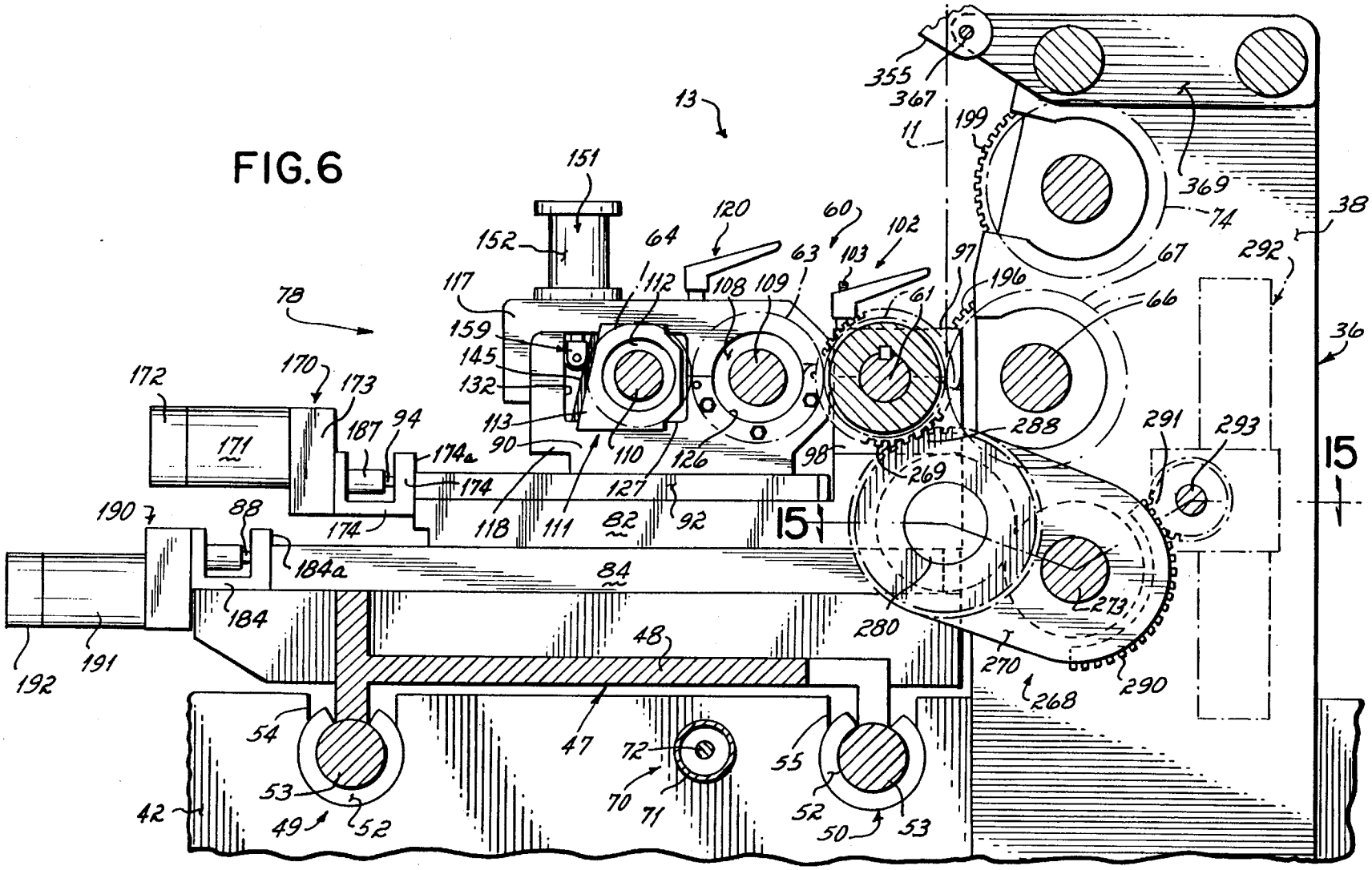
FIG. 6 is a sectional view taken along line 6—6 of FIG. 3 showing the gear train side of the roller positioning mechanism and a swingable gear assembly in one branch of the gear train of the present invention.

The base platform 48 is moveable to a desired transverse position including an operational position as shown in FIG. 3 and 4, and a stand-aside position as shown in FIG. 5. A double action pneumatic motor 70, such as that manufactured by Bimba Manufacturing Co., Monee, Ill., part No. 1731-DP, is used to effect this transverse movement of the base platform 48. The dual action air motor 70 includes a stationary cylinder 71 and an actuation rod 72. The cylinder 71 is mounted transversely between the support bars 41, 42 and positioned longitudinally between the two bearing assemblies 49, 50. The rear end of the cylinder 71 is fixed to the second support bar 42 and the front or actuating end of the cylinder 71 is fixed to the first support bar 41 such that the rod 72 is free to move through a hole 73 formed through the support bar 41 and transversely out from the operator side of the press 10. The leading end of the rod 72 is fixed to the stop plate 58. Thus, it can be seen that actuation of the air motor 70 causes transverse movement of the base platform 48, and therefore the printing mechanism 60, above the support bars 41, 42. With the base platform 48 in the operational position (see FIGS. 3 and 4), the printing mechanism 60 is transversely located between the support bars 41 and 42. With the base platform 48 in the stand-aside position (see FIG. 5), a sufficient portion of the base platform 48 extends out beyond the operator side of the frame 36 to enable the printing mechanism 60 to be serviced. Preferably, the printing mechanism 60 extends out beyond the operator side of the frame 36. Such servicing may include cleaning or replacement of any one or all of the elements of the printing mechanism 60. While it is in the stand-aside position, the base platform 48 is self-supportive in that neither a separate supportive frame (not shown) nor a cart (not shown) need be positioned alongside the press 10 to receive and provide support underneath the base platform 48. As is apparent from the drawings, the printing mechanism 60 is carried completely on the base platform 48 when in the stand-aside position.

The stand-aside position is obtained by actuating the air motor 70 to extend the rod 72. Movement of the rod 72 out of the cylinder 71, and therefore movement of the base platform 48, out beyond the operator side of the frame 36 is preferably halted by limiting the throw length of the rod 72 such that the keeper plates 59 on the back ends of the bearing shafts 53 just seat against respective second ball bushings 52. The keeper plates 59 help to prevent accidental removal of the shafts 53 out of the ball bushings 52. From the stand-aside position, the base platform is moved to the operational position by reversing the action of the air motor 70 to pull the rod 72 back into the cylinder 71. Movement of the platform 48 from the stand-aside position is halted and the operational position obtained when the backside of the stop plate 58 makes contact with a stop screw 77 mounted in and extending out beyond the front of the first support bar 41 (see FIGS. 2, 3 and FIG. 17). As is discussed below in the axial adjustment mechanism section of this description, the extent to which the stop screw 77 extends out beyond the front of the support bar 41 may be varied.

Positioning of Printing Mechanism Rollers

As shown in FIGS. 1–4, 6, 7 and 8, each printing station 13 of the present printing press 10 includes a positioning mechanism 78 for moving each of the rollers 61, 63 and 64 of the printing mechanism 60 longitudinally to a desired position relative to each other and to the impression roller 66, while the base platform 48 is in the operational position. As is discussed in detail in a separate section below, actuation of the positioning mechanism 78 is controlled by a computer control positioning system in order to automatically move the printing mechanism rollers 61, 63 and 64 into and out of position for printing.

The positioning mechanism 78 includes a first and second lower carriage 81 and 82 which are respectively slidable lengthwise along a first and second lower plane rectilinear slide assembly 83 and 84, such as that manufactured by THK America, Inc., Elk Grove Village, Ill., part No. KR3306B + 500LP. Each lower slide assembly 83, 84 is fastened to the base platform 48 and includes a non-driven or follower bearing block 85 and a driven bearing block 86, longitudinally spaced and fastened up line and downline, respectively, to the bottom of each of the lower carriages 81, 82. Each bearing block 85, 86 is moved along bearing or sliding surfaces 87 by a ball screw 88. The ball screw 88 of each lower slide assembly 83 and 84 is mounted for rotation at its ends and disposed in a longitudinal borehole formed through each of the bearing blocks 85, 86 of respective lower carriages 81, 82. Each longitudinal borehole is adapted to allow the respective ball screw 88 to freely pass therethrough. The driven bearing block 86 includes a recirculating ball nut (not shown) through which the respective ball screw 88 is threaded. The bearing blocks 85, 86 of each lower carriage 81 and 82 are moved longitudinally along the bearing surfaces 87 of respective lower slide assemblies 83 and 84 by rotating the ball screws 88.

A first and second upper carriage 89 and 90 are respectively slidable lengthwise along a first and second upper rectilinear slide assembly 91 and 92. The upper slide assemblies 91, 92 are respectively fastened to the top of the lower carriages 81, 82. Each of the upper carriages 89, 90 also include longitudinally spaced non-driven and driven bearing blocks 85 and 86 like those fastened to the bottom of the lower carriages 81, 82. The upper slide assemblies 91, 92 are similar to, but shorter than, the lower slide assemblies 83, 84, with each upper slide assembly 91, 92 including a shorter bearing or sliding surface 93 and ball screw 94. The upper slide assemblies 91, 92 may also be purchased from THK under part No. KR3306B + 300LP. The lower slides 83, 84 are transversely spaced apart and mounted to the base platform 48. The first lower slide 83 is mounted adjacent to the front edge of the base platform 48 and the second lower slide 84 is mounted approximately half way along the length of the base platform 48. Preferably, the first carriages 81, 89 and the first slides 83, 91 are generally longitudinally aligned and coplanar with the first vertical support panel 37 when the base platform 48 is in the operational position (see FIG. 4). The second carriages 82, 90 and the second slides 84, 92 are preferably likewise generally aligned and coplanar with the second vertical support panel 38 when the base platform 48 is the in the operational position.

Figure 7:
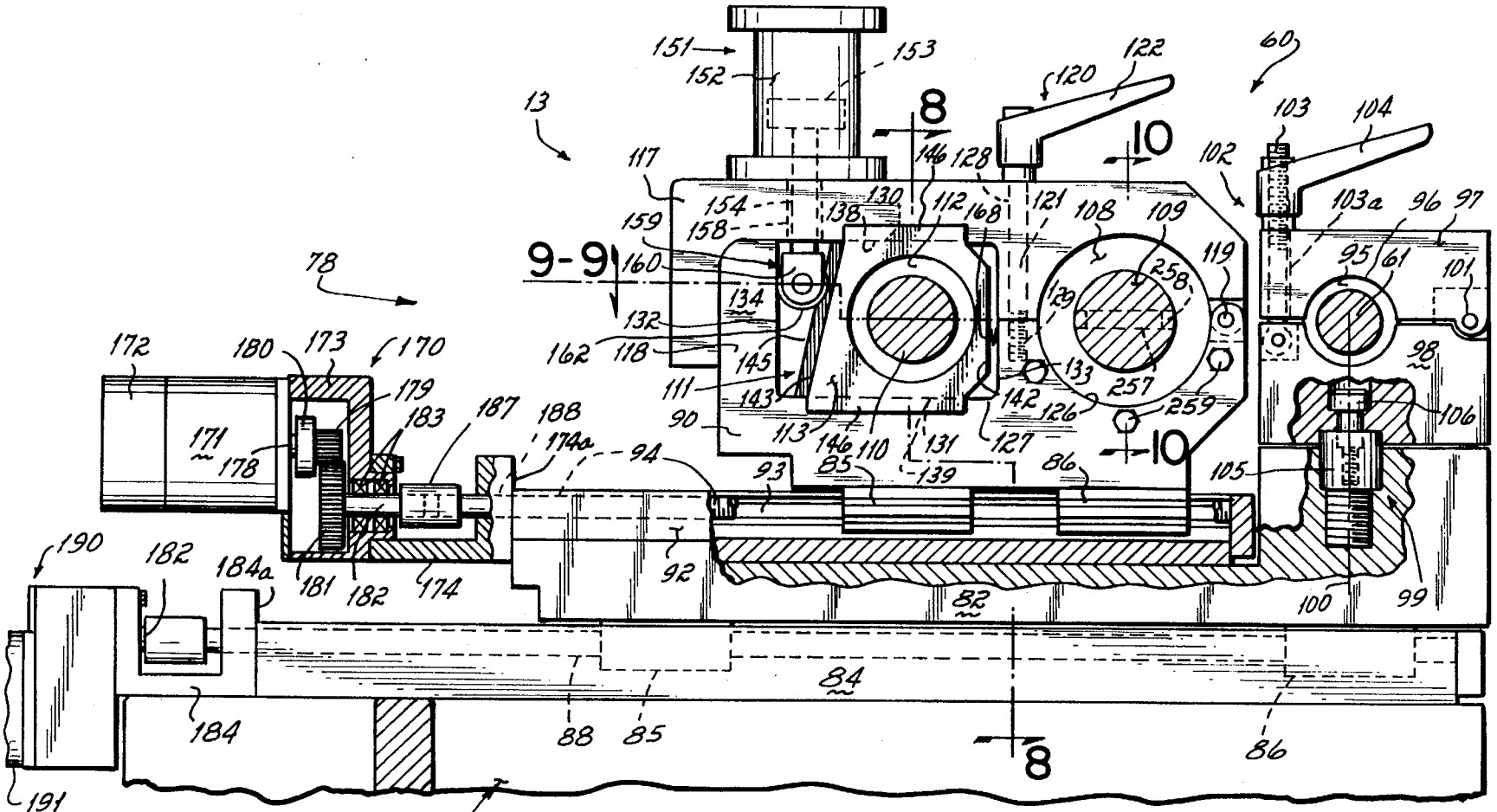
FIG. 7 is an enlarged fragmentary view of the roller positioning mechanism of FIG. 6.
Figure 9:
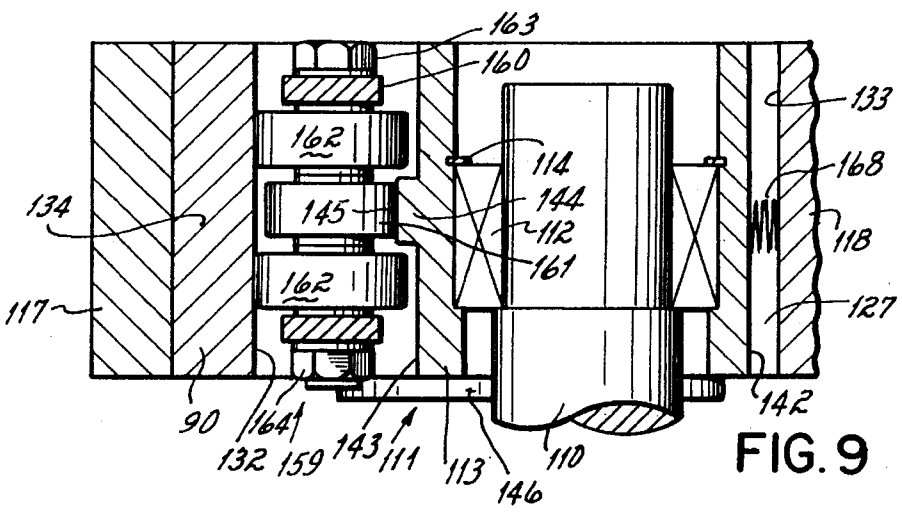
FIG. 9 is a sectional view taken on line 9—9 of FIG. 7 illustrating the structural detail of the metering roller pressure adjustment system.
Figure 10:
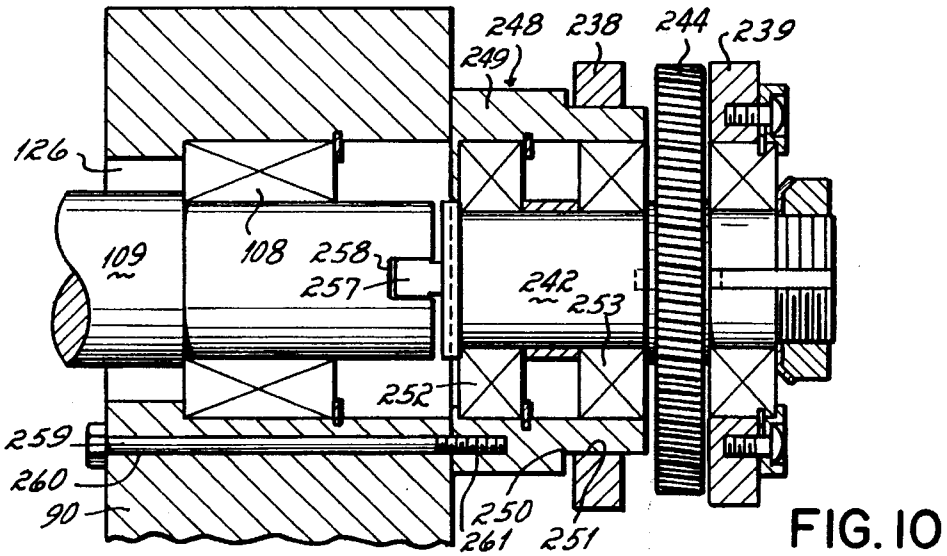
FIG. 10 is a sectional view taken on line 10—10 of FIG. 7 illustrating the structural details of the anilox roller drive shaft attachment.
Figure 8:
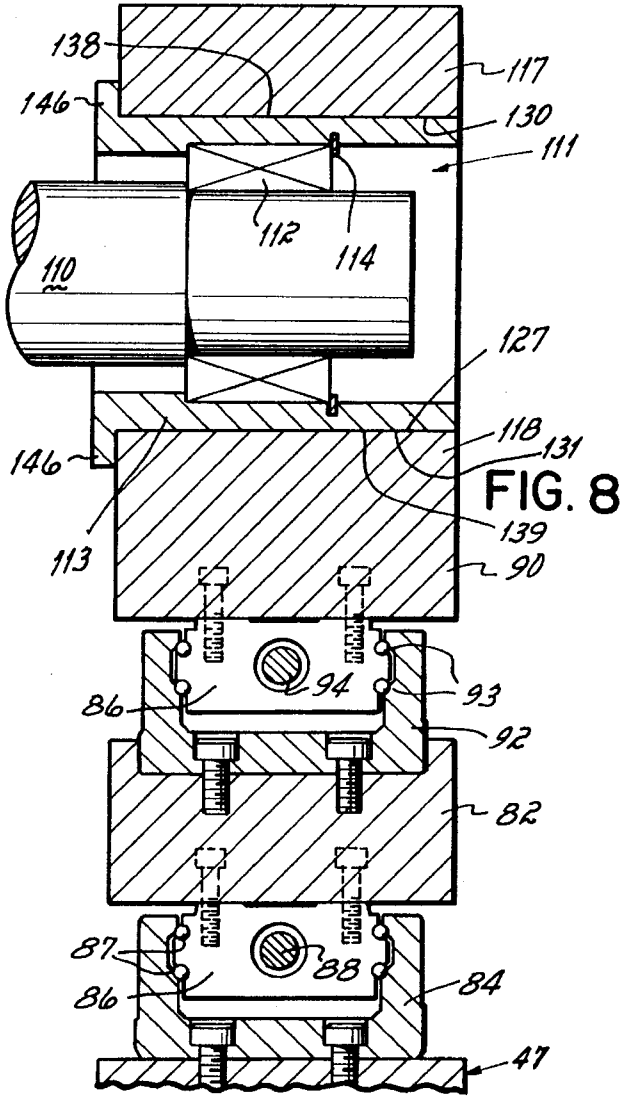
FIG. 8 is a sectional view taken on line 8—8 of FIG. 7 illustrating the detail of an upper and lower slide assembly.

Referring to FIG. 7, the printing roller 61 is journaled at its ends between the first and second lower carriages 81, 82. The printing roller 61 preferably has a sintered sleeve bearing 95 (e.g. oil impregnated sintered bronze) mounted for rotation about each end thereof. A top and bottom split bearing cap 97 and 98 is mounted with a pivot assembly 99 to the top of the downline end of each lower carriage 81, 82. The pivot assemblies 99 enable each pair of bearing caps 97, 98 to rotate freely about a central vertical axis 100. Each pivot assembly 99 includes a threaded bearing stud 105 and a capture bolt 106. One bearing stud 105 is screwed into a threaded hole formed in the top of the downline end of each of the lower carriages 81, 82. Each of the bottom split bearing caps 98 is fastened to the bearing stud 105 fixed in the respective lower carriage 81, 82 with one capture bolt 106. The shank of each capture bolt 106 passes through a hole formed through its respective bottom split bearing cap 98 and is threaded into the top of its respective bearing stud 105. The top of each bearing stud 105 extends beyond its respective lower carriage 81, 82 so that a space is formed between each bottom split bearing cap 98 and its respective lower carriage 81, 82. Satisfactory results have been obtained with a spacing of about 0.002 inches (0.0508 mm). Each capture bolt 106 is fixed in place relative to its respective bearing stud 105. Each pair of split bearing caps 97, 98 form an opening 96 to receive and hold in place one of the bearings 95. The top and bottom split bearing caps 97, 98 on each lower carriage 81, 82 are joined along adjacent downline edges by hinge 101. A first hand actuated locking mechanism 102 is used to quickly secure or release the upline end of the caps 97, 98. The locking mechanism 102 includes an eye bolt 103 pivotally mounted at its eye end to the bottom cap 98. The threaded end of the eye bolt 103 is disposed in a threaded borehole formed in a handle 104.

Each end of the printing roller 61 is journaled to its respective lower carriage 81, 82 by first placing each sleeve bearing 95 on the ends of the roller 61 between one of the top and bottom caps 97 and 98. Each opening 96 formed by the caps 97, 98 has an effective diameter smaller than each sleeve bearing 95. In order to hold and lock the bearings 95 in place between respective caps 97, 98, the eye bolt 103 is pivoted to a generally vertical orientation into a slot **103*a* formed in the upline end of the top cap 97, as shown in FIG. 7. While in this position, turning each handle 104 forces the top caps 97 towards their respective bottom caps 98 which in turn applies compression to hold the bearings 95 in place. With the bearings 95 held in place, the ends of the printing roller 61 are free to rotate within their respective sleeve bearings 95. If the ends of the printing roller 61 are found to have too much play radially within their respective bearings 95 (i.e., longitudinally within the frame), the handles 104 can be further turned to apply additional compression sufficient to deform the bearings 95 and thereby reduce the amount of play. It is believed that reducing this radial play improves the repeatability of roller positioning by helping to maintain tighter tolerances between the relative roller positions. The printing roller 61 can be removed by unlocking the locking mechanism 102**, which involves generally reversing the preceding steps.

Referring to FIGS. 7, 8, 9 and 10, the ends of the anilox roller 63 and of the metering roller 64 are journaled between the upper carriages 89, 90. A roller bearing 108, with an inner and outer race and multiple bearings therebetween (not shown), is mounted on either end 109 of the anilox roller 63. A wedge shaped roller bearing assembly 111 is mounted at each end 110 of the metering roller 64. Each bearing assembly 111 includes a roller bearing 112, similar to bearing 108, captured with a snap ring 114 within a wedge shaped block 113. The first and second upper carriages 89, 90 each comprise a set of top and bottom split dual bearing caps 117 and 118. Each set of top and bottom caps 117, 118 are joined along adjacent downline edges by hinge 119. A second, hand actuated locking mechanism 120 is used to quickly secure the caps 117, 118 together. The locking mechanism 120 includes a threaded stud 121 having its non-threaded end fixed to a handle 122. When the top cap is secured above the bottom cap 118, as shown in FIG. 7, the caps 117, 118 form a downline opening 126 and an upline opening 127 between them. The shank of the stud 121 is disposed in a hole 128 formed through the top dual bearing cap 117, between the openings 126, 127 and threaded into a threaded hole 129 formed in the bottom dual bearing cap 118. The through hole 128 is dimensioned to allow the shank of the stud 121 to freely pass therethrough. Thus, the top cap 117 is secured in place above the bottom cap 118 by turning the handle 122 to thread the stud 121 deeper into the threaded hole 129 thereby compressing the caps 117, 118 together. The caps 117, 118 can be opened by turning the handle 122 to back out the stud 121 from the threaded hole 129. Once the stud 121 is out of the hole 129, the top cap 117 can be pivoted away from the bottom cap 118 at hinge 119 to an open position. While in this open condition, the bearings 108 on the ends 109 of the anilox roller 63 and the wedge shaped bearing assemblies 111 on the ends 110 of the metering roller 64 can be placed between or removed from the caps 117, 118.

When the anilox and metering rollers 63, 64 are mounted between the upper carriages 89, 90, the bearings 108 on the ends of the anilox roller 63 are captured in the downline openings 126 and the wedge shaped bearing assemblies 111 on the ends of the metering roller 64 are captured in the upline openings 127. While the bearings 108 are relatively fixed in place in the downline openings 126, the wedge shaped bearing assemblies 111 are able to slide longitudinally within their respective upline openings 127 a desired distance. Each of the upline openings 127 has an upper and lower bearing surface 130 and 131, a vertical upline end surface 132, and a vertical downline end surface 133. The upline end surface 132 is a flat bearing surface formed by a vertical upline end portion 134 of the bottom cap 118. The downline end surface 133 is formed by a portion of both dual bearing caps 117, 118. The wedge-shaped block 113 of each bearing assembly 111 has an upper and lower bearing surface 138 and 139, a downline end surface 142, and an upline end surface 143. The wedge-shaped blocks 113 are dimensioned to closely fit within respective upline openings 127 while still allowing the blocks 113 to slide longitudinally therewithin. Each of the wedge-shaped blocks 113 have an internal flange 146 (see FIG. 8) which prevents transverse movement of the metering roller 64 when the bearing assemblies 111 are mounted in the upper carriages 89, 90. The upline end surface 143 of the block 113 is angled from vertical and has a similarly slanted ridge 144 (see FIG. 9) with a bearing surface 145 formed thereon. An angle for surface 143 of about 15° has produced satisfactory results.

A double action air motor assembly 151 is used to move each of the wedge-shaped bearing assemblies 111 longitudinally within respective upline openings 127. Each air motor assembly 151 includes an air cylinder 152, such as that manufactured by Bimba Manufacturing Co., Monee, Ill., model No. F0-17-2, a piston 153 and an actuation shaft 154. One air motor 151 is mounted on top of the top dual bearing cap 117 of each upper carriage 89, 90 such that the shaft 154 is actuated up and down in a generally vertical direction below the cylinder 152. The shaft 154 is disposed within a hole 158 formed through the top of the bearing cap 117 and into the upline opening 127. The hole 158 is dimensioned to allow the shaft 154 to move freely therethrough. The leading end of the shaft 154 extends into the upline opening 127 and mounts a camming bearing assembly 159. The bearing assembly 159 includes a two-prong yoke 160, a small diameter roller bearing 161 (such as that manufactured by McGil Manufacturing Co. Inc., Valparaiso, Ind., part No. CYR-3/4-S) and two equal size roller bearings 162 (such as McGil, part No. CYR-7/8-S) larger than bearing 161. A nut 163 and bolt 164, or similar fastener, is used to mount the roller bearings 161, 162 between the prongs of the yoke 160, with the smaller bearings 161 positioned between the two larger diameter bearings 162. Each bearing 161, 162 is free to rotate around the shank of the bolt 164. The yoke 160 is mounted to the leading end of the actuation shaft 154 of the air motor 151 such that the longitudinal axis of the bolt 164 lies in the transverse direction. The upline end surface 143 of the wedge-shaped block 113 and the bearings 161, 162 are dimensioned so that only the smaller bearing 161 is in contact with the bearing surface 145 of surface 143, and the larger bearings 162 are only in contact with the flat vertical bearing surface 132 of the bottom dual bearing cap 118. A compression coil spring 168 is mounted between the downline end surface 142 of the wedge-shaped block 113 and the portion of the downline end surface 133 of the opening 127 formed by the bottom bearing cap 118. This spring 168 provides a positive force pushing the block 113 toward the upline end surface 132 of the opening 127, thereby maintaining contact between respective bearing surfaces 145, 132 and bearings 161, 162, regardless of the vertical position of the cam bearings 161, 162 in the upline opening 127. Because of this bearing arrangement, frictional forces have been minimized which allows a more direct relationship between the air pressure supplied to the air cylinder 152 and the force applied to the wedge-shaped block 113 through the bearing assembly 159. Air pressures of about 30 psi have produced satisfactory results.

Movement of each wedge-shaped block 113, and therefore the ends of the metering roller 64, longitudinally within the upline opening 127 is effected by activating each air motor 151 and actuating the shaft 154 upward or downward between the diverging bearing surfaces 132 and 145. As the roller bearings 161, 162 are forced downward by the actuation of the air cylinder shaft 154, the wedge-shaped bearing assemblies 111 are forced longitudinally in the downline direction, compressing the springs 168 and moving the metering roller 64 toward and against the anilox roller 63. With the anilox and metering rollers 63 and 64 loaded in this manner, a significant amount, if not all, of any radial play in each of their respective roller bearings 108, 112 is removed. It is believed that reducing this radial play improves roller positioning repeatability by helping to maintain tighter tolerances between roller positions. Reversing the action of the air cylinder 152 moves the roller bearings 161, 162 upward, allowing the coil springs 168 and the natural resiliency of the metering roller 64 to push the wedge-shaped blocks 113 upline, thereby moving the metering roller 64 away from the anilox roller 63.

Movement of each upper carriage 89, 90 along its respective slide assembly, 91, 92 is effected by an upper gear box assembly 170. Each gear box assembly 170 includes a DC stepper motor 171 with an encoder 172 connected thereto for generating electronic pulses as the stepper motor 171 is actuated. Such a stepper motor/encoder 171/172 combination is manufactured by Superior Electric, Bristal, Conn., part No. M062-LF-509C2006. As last seen in FIG. 7, the roller positioning stepper motors 171 are each fastened to a gear box housing 173 mounted to a guide actuator bracket 174 on the upline end of the upper slide assemblies 91, 92. Each stepper motor 171 drives a shaft 178 having a spur gear 179 fixed to the end thereof with a two piece collar 180, such as that manufactured by IMO Industries Inc., Boston Gear Division, Quincy, Mass., catalog No. 2SC37. Each of the driven gears 179 engages another spur gear 181 fixed at one end of an actuation shaft 182 mounted for rotation within each of the gear box housings 173 by dual bearings 183. The other end of each actuation shaft 182 is coupled to an adjacent upline end of one of the ball screws 94 by a flexible coupling 187, such as that manufactured by W.M. Berg Inc., East Rockaway, N.Y., part No. CO41A-1 "Modified Bore" size. The upline end of each ball screw 94 is mounted for rotation in a hole 188 formed through the down line end of the respective guide actuator bracket 174.

Activation of each stepper motor 171 causes rotation of the respective drive gear 179 which in turn drives the rotation of each actuation shaft 182 through respective gears 181. Rotation of each shaft 182 drives the rotation of each ball screw 94 through respective couplings 187. Each coupling 187 is preferably made to flex axially, but not rotationally, in case respective shafts 182 and ball screws 94 become misaligned (i.e., are no longer coaxial). Rotation of each ball screw 94 through the recirculating ball nut of respective driven bearing blocks 86 causes longitudinal sliding of the upper carriages 89, 90 along respective upper slide assemblies 91, 92 as previously described.

Movement of each lower carriage 81, 82 along its respective lower slide 83, 84 is effected by a lower gear box assembly 190 having a stepper motor 191 and an encoder 192. Gear box assembly 190 is almost identical to gear box assembly 170 except that its drive shaft 178 is oriented below its actuation shaft 182. In addition, each gear box assembly 190 is connected to its respective lower slide assembly 83, 84 with a guide actuator bracket 184, in the same manner that gear box assemblies 170 are connected to respective upper slide assemblies 91, 92, described above. Likewise, rotation of each ball screw 88 by its respective gear box assembly 190 causes longitudinal sliding of the lower carriages 81, 82 along respective lower slide assemblies 83, 84 in the same manner as described above. By using the Superior Electric stepper motors/encoders 171/172 and 191/192 and respective THK slide assemblies 91, 92 and 83, 84 previously described, the carriages 89, 90 and 81, 82 may be moved in increments as small as about 0.005 mm (0.0002 inches).

Thus, the printing roller 61 can be moved to a desired spatial position relative to the backing face 67 of the impression roller 66 by activating either or both of the stepper motors 191 of the gear box assemblies 190 and thereby rotating either or both of the ball screws 88. Likewise, the anilox roller 63 can be moved to a desired spatial position relative to the printing roller 61 by activating either or both of the stepper motors 171 of the gear box assemblies 170 and thereby rotating either or both of the ball screws 94. The encoders 172, 192 associated with each respective stepper motor 171, 191 provides feedback to the computer control positioning system described below. This feedback enables the computer control system to know whether a particular stepper motor 171 or 191 has in fact been actuated the desired amount. The metering roller 64 can be moved to a desired position relative to the anilox roller 63 by activating or deactivating (i.e., pressurizing or depressurizing) either or both of the double action air motor assemblies 151 and thereby move either or both of the cammed bearing assemblies 159 down or up, respectively. The air pressure supplied to each air cylinder 152 may vary depending upon how much pressure is to be applied by the metering roller 64 against the anilox roller 63.

The positioning mechanism 78 is designed to keep the rotational axis of the printing, anilox and metering rollers 61, 63 and 64 co-planar with the rotational axis of the impression roller 66 as the different rollers 61, 63 and 64 are moved relative to one another. Keeping the printing mechanism rollers 61, 63 and 64 co-planar makes programming of the computer control positioning system easier.

Printing Station Gear Train

Referring to FIGS. 3, 10–12, 14 and 14A–C, each printing station's gear train 68 includes a first branch 193 for driving the rotation of the anilox and metering rollers 63 and 64, and a second branch 194 for driving the rotation of only the printing roller 61. Both branches 193, 194 of the gear train 68 are driven by a helical gear 196 mounted on the back end of the impression roller 66 behind the second support panel 38. Roller 74 has a gear 199 which is also driven by the impression roller gear 196. The impression roller gear 196 is engaged and driven by a helical drive gear 197 which is in turn driven by the common drive shaft 69 through a printing station gear box 198. The first branch 193 includes an articulating gear assembly 195 (see FIGS. 14 and 14A–C) that enables the anilox and metering rollers 63 and 64 to remain co-planar with the printing roller 61 and impression roller 66. The gear assembly 195 also enables rollers 63 and 64 to continue being drivable regardless of their relative longitudinal positions to rollers 61 and 66.

The articulating gear assembly 195 includes a first air actuated clutch assembly 200 mounted on a first stationary drive shaft 201. The first drive shaft 201 is journaled at either end between a back panel 203 and a front panel 204. The panels 203, 204 are transversely spaced apart and mounted vertically above the base platform 48 in back of the second carriages 82, 90. The first clutch gear assembly 200 includes a first claw clutch 205, such as that manufactured by Horton Manufacturing Co. Inc., Minneapolis, Minn., part No. 5H30P, having a slidable housing 206 keyed to the shaft 201 by a key 207 and a hub 208 fixed to shaft 201. Key 207 prevents rotation of housing 206 around shaft 201, but housing 206 is still able to slide along shaft 201. During printing, the clutch assembly 200 is activated, supplying air pressure to the clutch 200 and forcing the teeth 209 on the hub 208 and housing 206 to engage. A spring return is used to separate the teeth 209, when the assembly 200 is deactivated and the air pressure cut off from clutch 200. A helical ring gear 210 with its teeth being beveled on their front side edges is concentrically fastened to the hub 208. The ring gear 210 is engageable with and driven by the impression roller gear 196. Ring gear 210 has teeth beveled on their back side edges. A first stationary helical gear 211 for driving the balance of assembly 195 is fastened to the first drive shaft 201 between the clutch gear assembly 200 and the front panel 204. When the base platform 48 is to be moved to and from the operational position, the press 10 is shut down. Because the ring gear 210 of the first clutch assembly 200 and the impression roller gear 196 are helical with teeth beveled on meshing sides, the clutch gear 210 more readily meshes with the impression roller gear 196 when the base platform 48 is moved by air cylinder 70 into the operational position (see FIGS. 3 and 4) from, for example, the stand-aside position shown in FIG. 5.

The articulating gear assembly 195 also includes a second air actuated clutch assembly 215 mounted to a second stationary drive shaft 216 journaled at either end between the panels 203, 204. The second drive shaft 216 is mounted up line from and below the first drive shaft 201. The second clutch assembly 215 is similar to clutch assembly 200 with a slidable housing 217, a fixed hub 218 and mating teeth 219. The clutch assembly 215 is keyed to the shaft 216 with a second key 220. Clutch assembly 215 operates in the same manner as that described for assembly 200 above. A first timing pulley 222 is fastened to the hub 208 and connected to a second timing pulley 223 by timing belt 224. The second pulley 223 is rotatable by a motor 225 mounted to the base platform 48. A second stationary helical gear 229 is mounted to the second shaft 216 between the second clutch assembly 215 and the front panel 204 and engaged with the first helical gear 211.

An intermediate pivot plate 230 is mounted at one end for rotation about the second drive shaft 216. One end of a first moveable drive shaft 232 is journaled to the other end of the intermediate pivot plate 230. A first moveable helical gear 234 is fastened to the drive shaft 232 and engaged with the second stationary helical gear 229. A front and back leading pivot plate 238 and 239 are mounted at one end for rotation about the drive shaft 232, with the helical gear 234 located therebetween. The back pivot plate 239 is journaled intermediate the ends of the second moveable drive shaft 232. The plate 238 is journaled on the free end of shaft 232. A second moveable helical gear 244 is fixed to the drive shaft 242 between the pivot plates 238, 239 and engaged with the first moveable helical gear 234. The other end of the second drive shaft 242 extends out beyond the front of the pivot plate 238 and is mounted for rotation within a bearing cup assembly 248 mounted to the other end of the pivot plate 238. The bearing cup assembly 248 includes a bearing cup 249 with a shoulder 250 fitted for rotation within a hole 251 formed through the other end of the pivot plate 238. Assembly 248 also has a pair of spaced apart bearings 252, 253 mounted therein about the shaft 242. An integral key 257 extends out concentrically from the front end of the second drive shaft 242 for engaging a mating slot 258 concentrically formed in the back end 109 of the anilox roller 63.

With the key 257 mated in the slot 258, the bearing cup assembly 248 is fastened to the back side of the second upper carriage 90, for example with bolts 259 passing through holes 260 formed through the bottom bearing cap 118 of the second upper carriage 90 and threaded into threaded bore holes 261 formed in the bearing cap 249. A helical gear 265 is mounted on the front end of the anilox roller 63 for engaging another helical gear 266 mounted on the front end of the metering roller 64. Gears 265, 266 are located in front of the first upper carriage 89. The gears 265, 266 may have a variety of relative gear ratios, such as a 1:3 gear ratio respectively. The anilox to metering roller gear ratio may change with changes in the diameter of the metering roller 64 (the diameter of the anilox roller 63 remaining generally the same). This gear ratio may also be varied to change the ink supplying and dispensing characteristics of the metering and anilox rollers 64 and 63.

Figures 14, 14A, 14B, 14C:
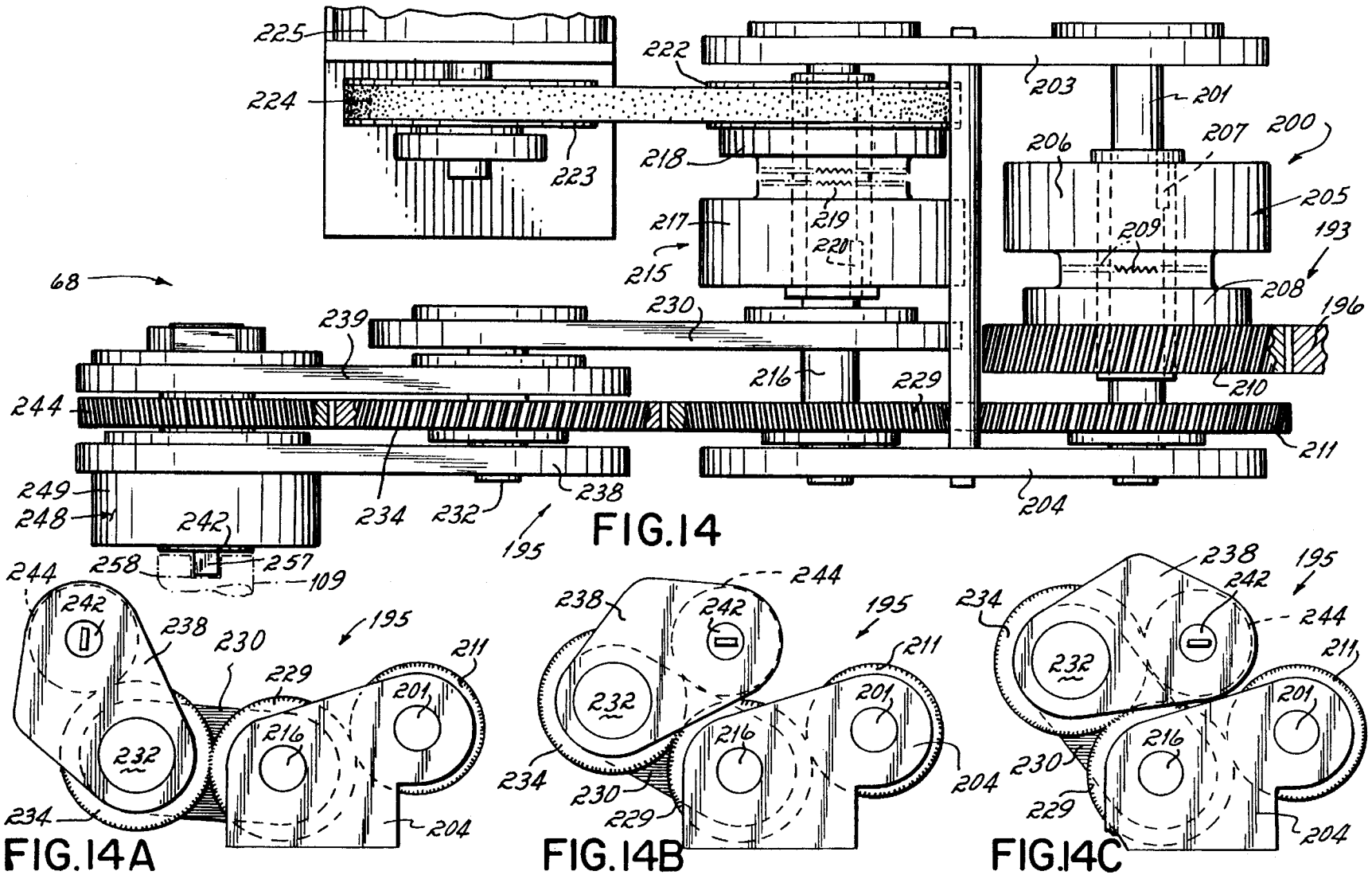
FIG. 14 is a top view of the articulating gear assembly of FIG. 12 in a fully extended position for clarity of illustration.
FIGS. 14A–C are side diagrammatic views of the articulating gear assembly of the present printing press in various degrees of articulation.

During printing, when the anilox roller 63 is driven by the common drive shaft 69 through the articulating gear assembly 195, the base platform 48 is in the operational position, and the first clutch assembly 200 is activated with its teeth 209 engaged and the second clutch assembly 215 is deactivated with its teeth 219 disengaged (see FIG. 14). With the teeth 209 of clutch assembly 200 engaged, rotation of the ring gear 210 by the impression roller gear 196 causes rotation of the drive shaft 201 and, in turn the helical gears 211, 229, 234 and 244. With the teeth 219 of clutch assembly 215 disengaged, rotation of the second stationary gear 229 will not cause rotation of the first pulley 222 mounted to hub 218, thereby leaving the motor 225 unaffected. Rotation of helical gear 244 causes the rotation of drive shaft 242 and, if key 257 and slot 258 are mated, anilox roller 63. Rotation of the anilox roller 63 causes rotation of the metering roller 63 when the later is positioned by air cylinder assembly 151 so that helical gears 265 and 266 are engaged.

The above described structure of the articulating gear assembly 195, enables the anilox roller 63 and the metering roller 64, if their respective gears 265 and 266 are engaged, to be rotated regardless of their relative position to the printing roller 61 or the impression roller 66. That is, the articulating gear assembly 195 is able to move longitudinally along with the second carriages 82, 90 while maintaining constant engagement between the drive gears 211, 229, 234 and 244. As is apparent from FIGS. 14A–C, the articulating gear assembly 195 enables the anilox and metering rollers 63 and 64 to be moved and driven while still maintaining the co-planar relationship between all of the rollers 61, 63, 64 and 66.

When a particular printing station 13 is shut down for servicing, such as replacement of the printing roller 61, it is often desirable to keep the anilox and metering rollers 63 and 64 rotating in order to prevent the ink from drying thereon. The clutch assemblies 200 and 215 enable the anilox roller 63 and the metering roller 64, if their respective gears 265 and 266 are engaged, to be rotated independent of the impression roller gear 196 (i.e., the common drive shaft 69). Independent rotation of the inking rollers 63 and 64 may be accomplished by shutting down the press 10, deactivating the first clutch assembly 205 to disengage the teeth 209 and activating the second clutch assembly 215 to engage teeth 219. With the first clutch 205 disengaged and the second clutch 215 engaged, the press 10 can be turned back on without the common drive shaft 69 (through the impression roller gear 196) causing rotation of the anilox roller 63. With the base platform 48 in the operational position, the impression roller gear 196 will continue to drive the rotation of the ring gear 210. However, because the teeth 209 of the first clutch 205 are disengaged, rotation of the ring gear 210 has no effect on the balance of the first gear branch 193. With the first clutch 205 disengaged and the second clutch 215 engaged, the motor 225 can be used to drive the rotation of the anilox and metering rollers 63 and 64 independent of the common drive shaft 69, and therefore the balance of the press 10.

Figure 11:
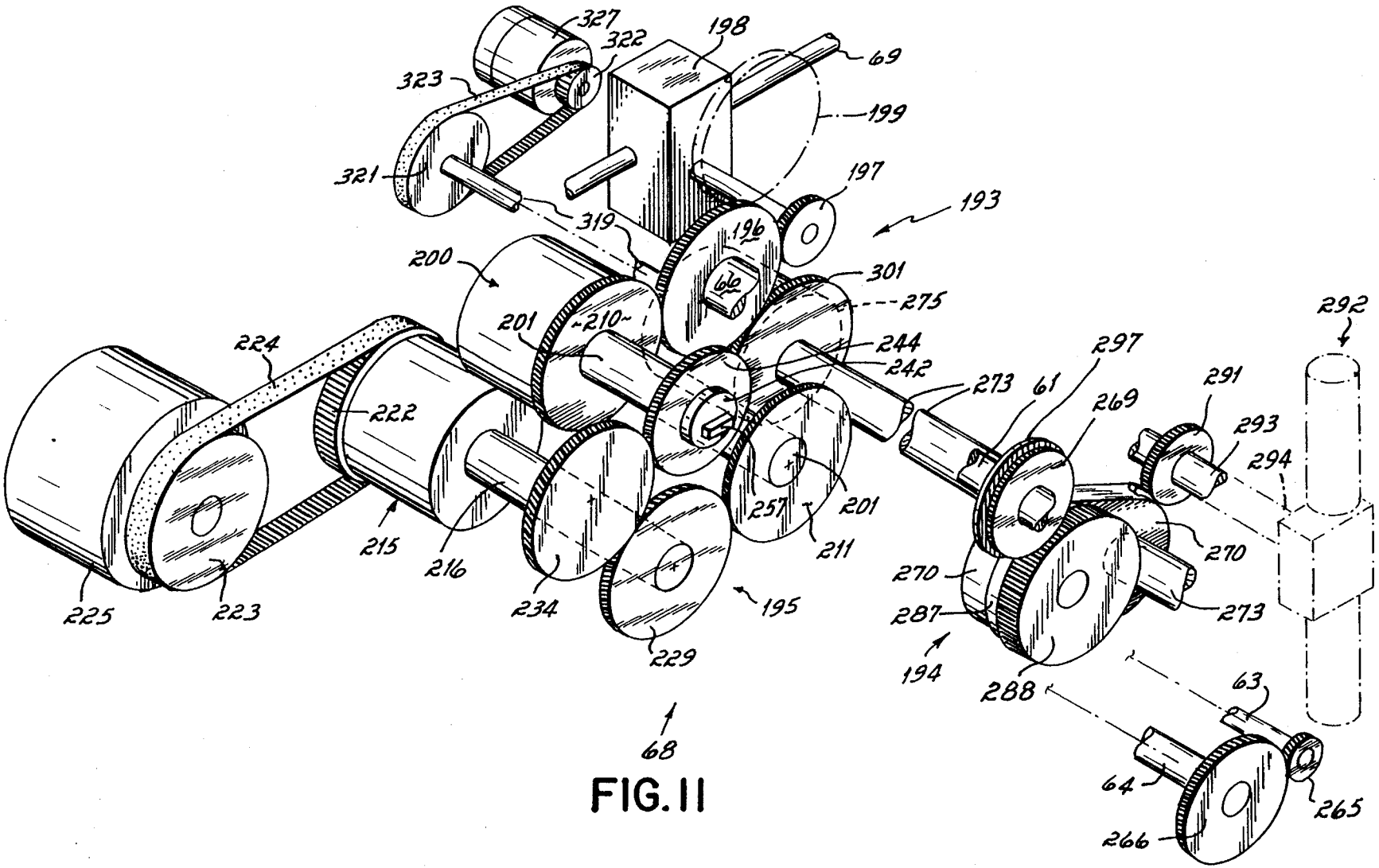
FIG. 11 is a perspective view of the gear train of one of the printing stations of the press of FIG. 1.
Figure 12:
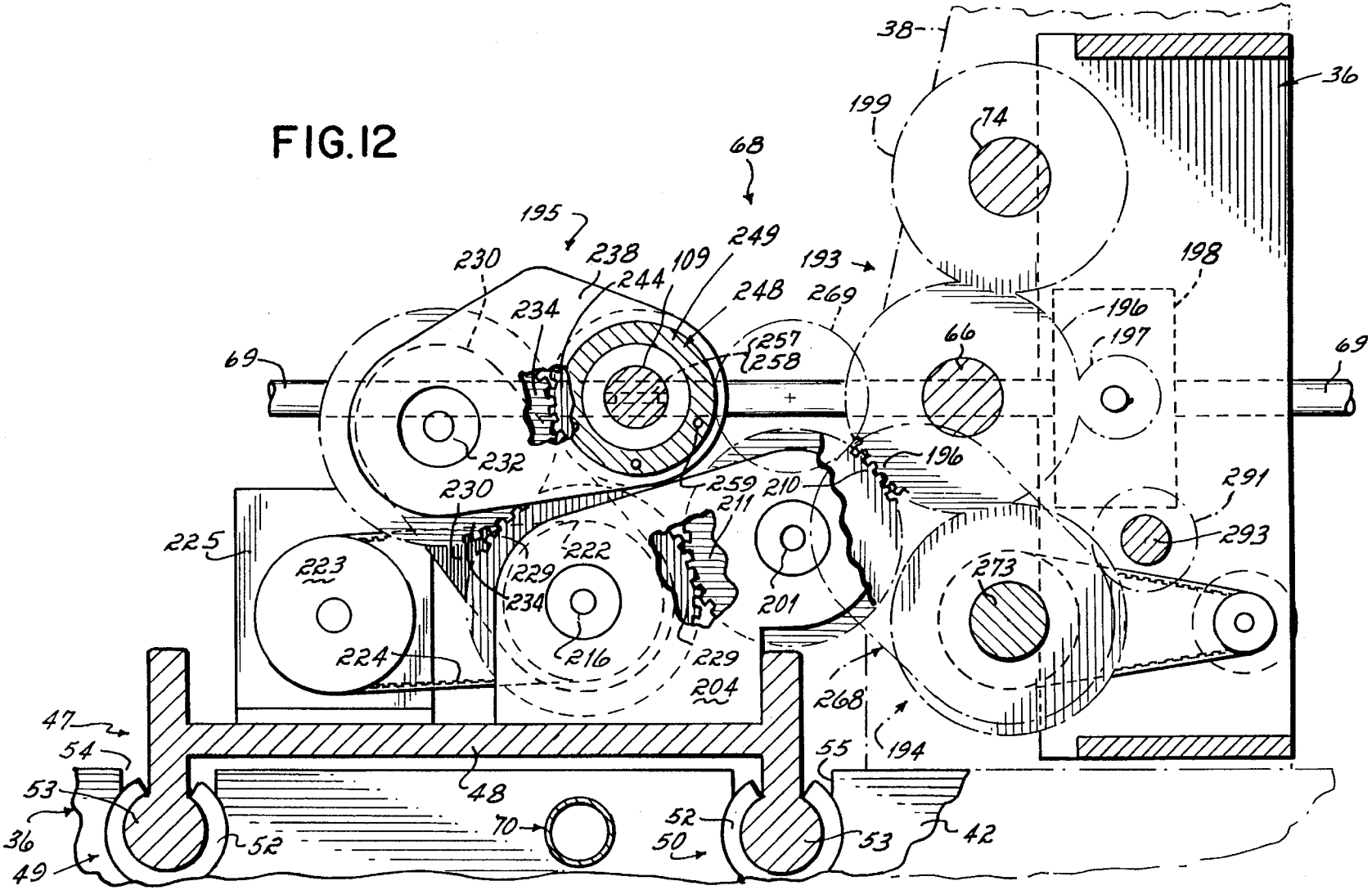
FIG. 12 is a sectional view of the articulating gear assembly in another branch of the gear train of the present invention taken on line 12—12 of FIG. 3.
Figure 13:
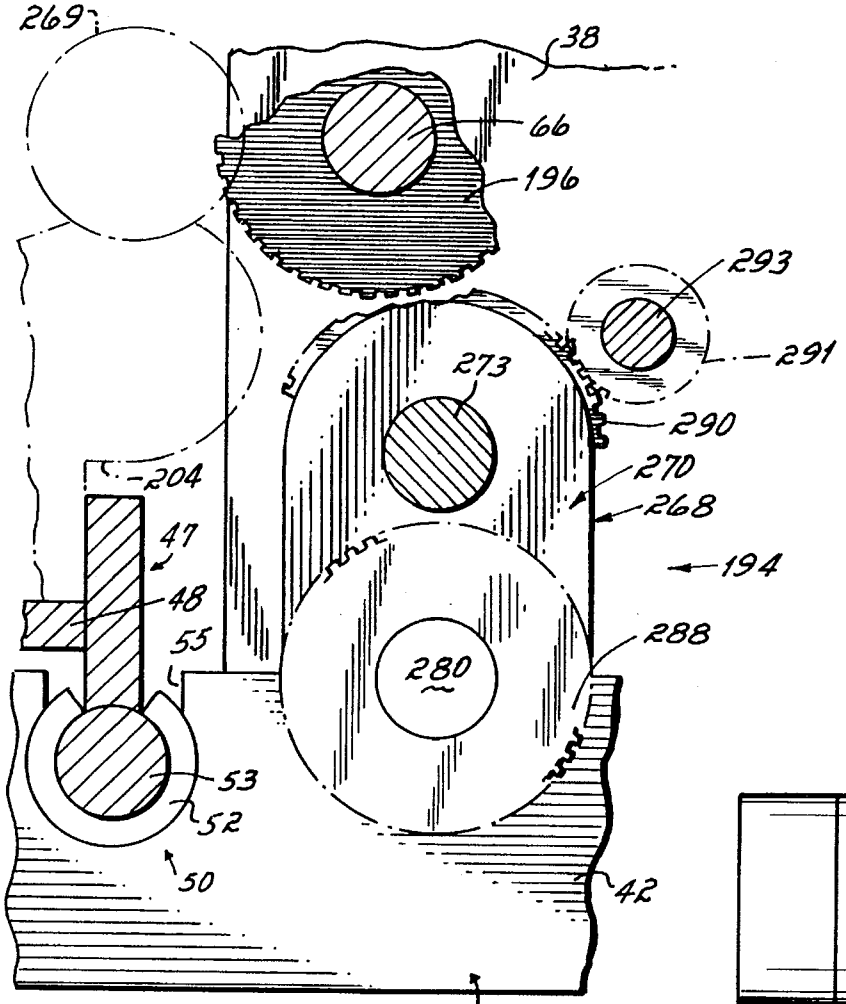
FIG. 13 is a side view of the swingable gear assembly according to the present invention as seen on line 13—13 of FIG. 5.
Figure 15:
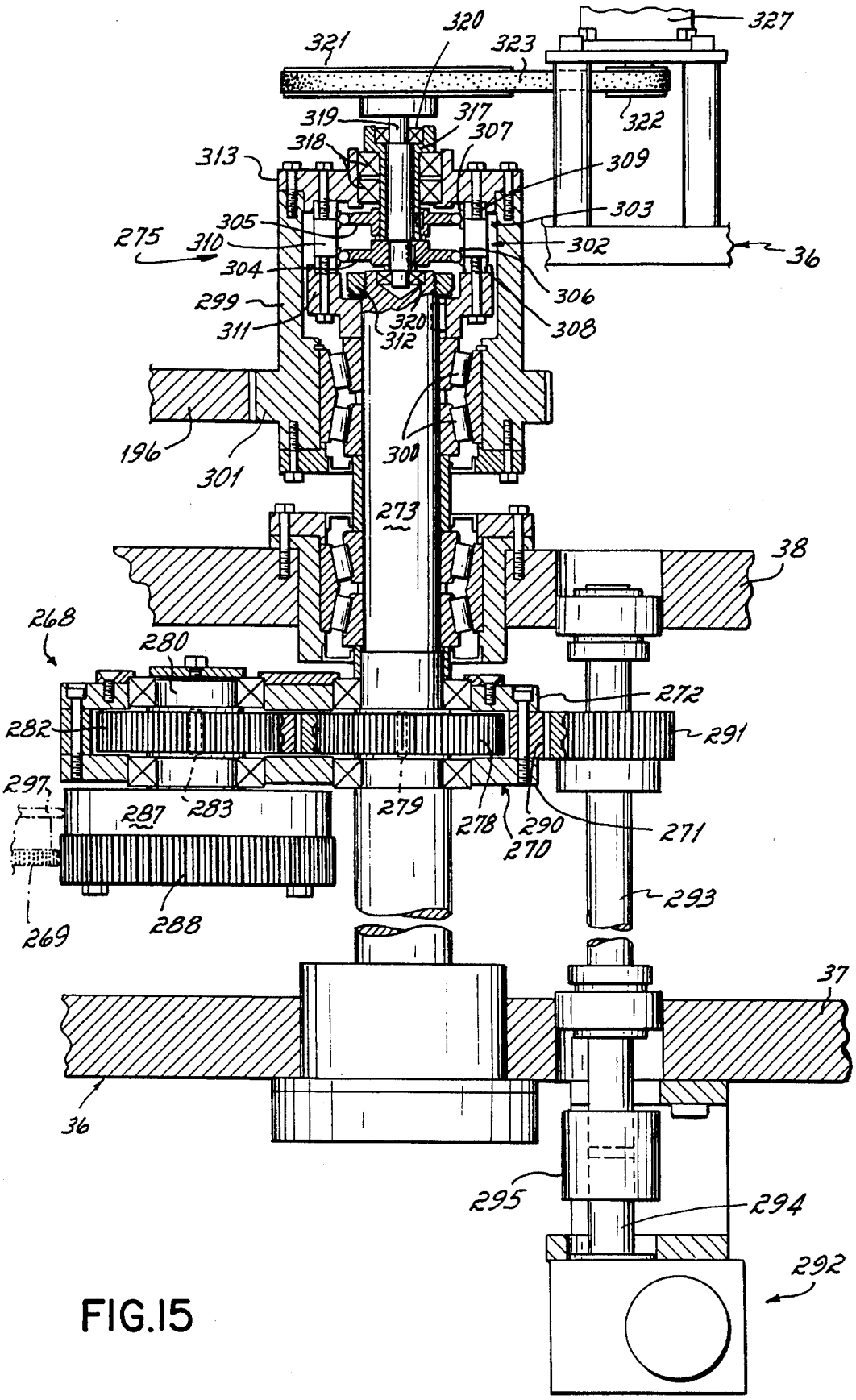
FIG. 15 is a sectional view taken along line 15—15 of FIG. 6 showing the swingable gear assembly and dual harmonic gear assembly of the present invention.
Figure 19:
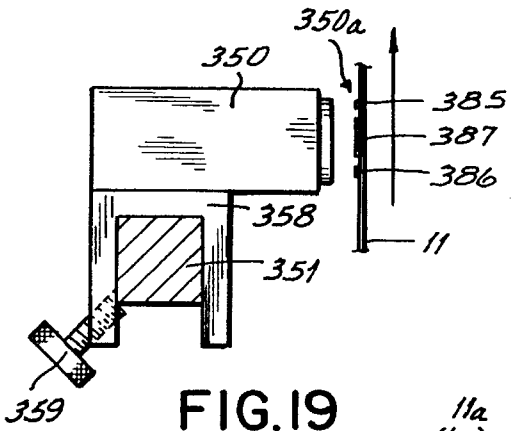
FIG. 19 is a sectional view taken on line 19—19 of FIG. 18.

Referring to FIGS. 11, 13, and 15, the second branch 194 of each printing station gear train 68 includes a swing gear assembly 268 moveable in and out of position to engage and drive a spur gear 269 mounted to the printing roller 61. Because it is moveable into position for full engagement, the swing gear assembly 268 helps to ensure that the printing roller gear 269 is fully engageable with the second branch 194 of the gear train 68 regardless of the thickness of the web 11. Full and snug engagement of the gears from the printing roller gear 269 through the second gear train branch 194 and to the common drive shaft 69 helps to prevent backlash and the resulting reduction in print quality (e.g. barring). Toward this end, the gears in gear train 68 are preferably cut to meet or exceed Class 10 specifications of the American Gear Manufacturers Association (AGMA) Gear Standards. To meet Class 10 specifications, engaging gears are allowed no more than about 0.0005 inches of backlash.

The swing gear assembly 268 includes a housing 270 having a spaced apart front and back side plate 271 and 272 mounted for rotation about a first drive shaft 273 journaled at its ends between the vertical support panels 37 and 38 below the impression roller 66. The back end of the shaft 273 extends out behind the second support panel 38 and is driven by the impression roller gear 196 through a dual harmonic gear assembly 275, described in detail later on. A first spur gear 278 is fixed to the shaft 273 with key 279 between the plates 271, 272. One end of a second drive shaft 280 is journaled to each of the plates 271, 272 at the other or leading end of the housing 270. A second spur gear 282 is fixed to the shaft 280 with key 283 between the plates 271, 272. The second gear 282 is engaged with and driven by the first gear 278. The other end of the second shaft 280 extends out beyond the side plate 271 and mounts an integral bearer ring 287. A leading spur gear 288 is fastened along side the bearer ring 287. An arcuate spur gear rack 290 is fastened to the one end of the housing 270. Rotation of the swing gear assembly 268 is accomplished with another spur gear 291 which engages and drives rotation of the gear rack 290, and thereby the housing 270, around the shaft 273. The arc length that housing 270 can be rotated through is limited by limiting the stroke of actuator 292. The third spur gear 291 is driven by a double action air powered rotary actuator 292, such as that manufactured by Bimba Manufacturing Co., Monee, Ill., Series 247 PT-247-270-A1, through a third drive shaft 293. The third gear 291 is keyed to the third shaft 293. The front end of the shaft 293 extends out beyond the support panel 37 and is coupled to a rotatable shaft 294 of the actuator 292 by a coupling 295, such as that manufactured by IMO Industries, Inc., Boston Gear Div., Quincy, Mass., catalog No. SCC7/8x7/8. The rotary actuator 292 is able to rotate the third drive gear 291 in either direction.

Thus, the leading gear 288 can be swung in and out of engagement with the printing roller gear 269 by activating the actuator 292 and rotating the gear 291 in either direction. The housing 270 is thereby rotated about the shaft 273 in a desired direction opposite to the rotation of gear 291. Full engagement of the leading gear 288 and printing roller gear 269 is accomplished when the bearer ring 287 contacts another bearer ring 297 mounted axially spaced from the gear 269 on the printing roller 61. As will be discussed in greater detail later on, printing roller gear 269 and bearer ring 297 are significantly narrower than the corresponding gear 288 and bearer ring 287 on the swing gear assembly 268 so that the printing roller 61 can be adjusted transversely to maintain axial registration without becoming disengaged. With the gears 288 and 269 fully engaged, the printing rollers 61 can be driven by the common drive shaft 69 through their respective impression roller gear 196, as previously described, and the second branch 194 of the gear train 68. The balance of gear train branch 194 between the impression roller gear 196 and printing roller gear 269 is designed to maintain a 1:1 gear ratio between gears 196 and 269.

Circumferential Adjustment Mechanism

The dual harmonic gear assembly 275 is a circumferential adjustment mechanism for adjusting the rotational speed of the printing roller 61 independent of the speed of the web 11 as it is run through the press 10. As is discussed in greater detail below, each printing station 13 has its own computer control circumferential registration system for controlling the actuation of the dual harmonic gear assembly 275. The assembly 275 includes a housing 299 mounted for rotation about the back end of drive shaft 273 with bearings 300. The housing 299 has a helical gear 301 integrally formed on the outside thereof which is engaged with and driven by the impression roller gear 196. The assembly 275 further includes a pair of coupled harmonic drive gears 302 and 303 which are located in juxtaposed, coaxial relation, like the coupled harmonic drive gears disclosed in U.S. Pat. No. 4,363,270, which is incorporated in its entirety herein by reference. Each of the gears 302, 303 includes a central, elliptical wave generator 304, 305, a flexible, externally toothed spline 306, 307, and a first, rigid, internally toothed outboard spline 308, 309 located for meshing interengagement with a corresponding flexible spline 306, 307. A second, rigid internally toothed, inboard spline 310 is provided in bridging engagement between the respective gears 302, 303, and is disposed such that the internal teeth thereof are simultaneously engageable with the flexible splines 306, 307. The outboard spline 308 is fastened to flange 311 so that these elements rotate in unison about shaft 273. Flange 311 is locked in place against the inner race of bearing 300 by a bearing nut 312 threaded on the back end of shaft 273. The other outboard spline 309 is fastened to an end plate 313 which is fastened to the back end of housing 299.

Wave generator 305 is fixedly keyed to a stationary annular or tubular sleeve 317. Sleeve 317 is mounted with bearings 318 in a hole formed through end plate 313. The back end of sleeve 317 is fixed to frame 36 and prevented from rotating by means not shown. Bearings 318 enable housing 299 to rotate around stationary sleeve 317. A stepped trim shaft 319 extends through sleeve 317 and is rotatable therein. Wave generator 304 is fixedly keyed to trim shaft 319. The innermost end of shaft 319 is rotatably supported by roller bearing 320 mounted concentrically within the back end of shaft 273. The outermost end of shaft 319 mounts a first pulley 321 which is coupled to a second pulley 322 with belt 323. A DC stepper motor 327 is mounted to frame 36 and mounts the second pulley 322 on its drive shaft. Stepper motor 327 is basically the same as stepper motor 171 except without encoder 172. The dual harmonic gear assembly 275 serves as a normal 1:1 ratio power transmission when shaft 319 is held stationary (i.e., motor 327 is not actuated). When it is desirable to change the circumferential position or phase between the rotation of the printing roller 61 and the anilox, metering and impression rollers 63, 64 and 66, stepper motor 327 is actuated to rotate shaft 319 in a desired direction. Rotation of shaft 319 causes shaft 273, and therefore printing roller 61, to rotate faster or slower depending upon the direction of rotation of shaft 319. This operation is further described in U.S. Pat. No. 4,363, 270. In this way circumferential registration changes can be effected.

Axial Adjustment Mechanism.

Figure 17:
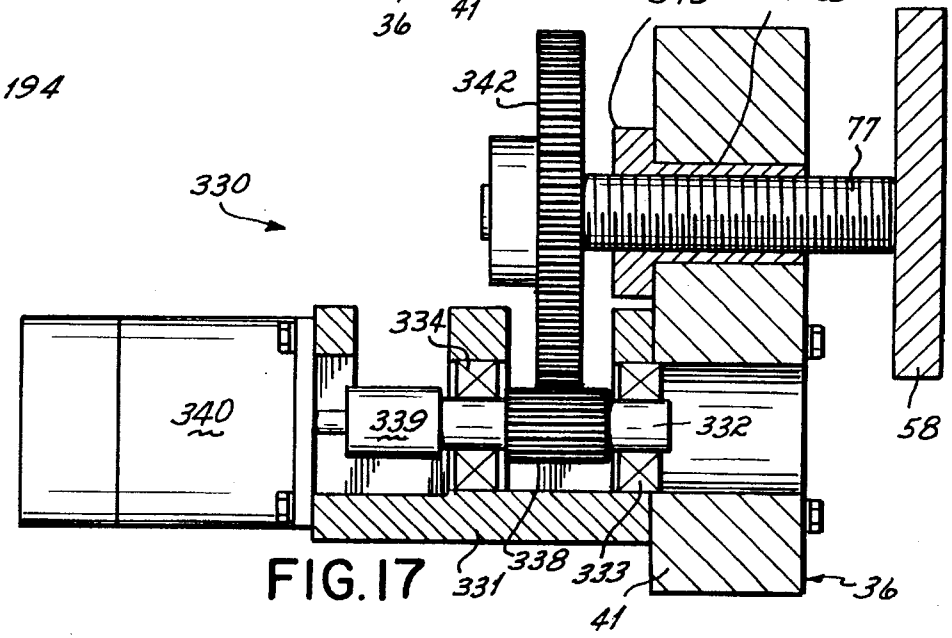
FIG. 17 is a sectional view, taken on line 17—17 of FIG. 3, of the axial adjustment mechanism of the present invention.

Referring now to FIG. 17, each printing station 13 preferably includes an axial adjustment mechanism 330 for simultaneously adjusting the transverse position of the printing mechanism rollers 61, 63 and 64 within the frame 36 in order to correct for axial registration errors. The mechanism 330 includes a mounting bracket 331 fastened to the backside of horizontal support bar 41. A shaft 332 is mounted for rotation to bracket 331 at two points along its length with spaced bearings 333 and 334. A wide-faced spur gear 338 is fixed to, or is an otherwise integral part of, shaft 332 intermediate bearings 333 and 334. The rear end of shaft 332 extends beyond bearing 334 and is connected by coupling 339, such as that manufactured by W.M. Berg Inc., East Rockaway, N.Y., part number C041A-3 "Modified Bore" size, to the drive shaft of a DC stepper motor 340. Stepper motor 340 is basically the same as stepper motor 327. A narrow-faced spur gear 342 is fixed to the rear end of stop screw 77, such as by a set screw. The narrow gear face of gear 342 engages and is driven by gear 338. Stop screw 77 is threadably received within a threaded sleeve or nut 343 which is fixed in and extends through a hole **343*a* formed through horizontal support bar 41. The front end of stop screw 77 extends out beyond the front of the support bar 41 in order to halt transverse movement of the platform 48 from the stand-aside position. When the front end of stop screw 77 contacts stop plate 58, platform 48 is in or near its operational position. Contact is maintained between the stop plate 58 and stop screw 77 by continuing to actuate the double action air cylinder 70 so as to continue pulling rod 72 back into cylinder 71**.

Fine adjustment of the transverse position of platform 48, and thereby the axial position of printing roller 61 (as well as the anilox and metering rollers 63, 64) can be accomplished by actuating stepper motor 340 to rotate shaft 332 incremental amounts. Rotation of shaft 332 causes gear 342 to rotate threading stop screw 77 in or out of sleeve 343 depending on the direction of rotation. As stop screw 77 is threaded out of sleeve 343, stop plate 58 and therefore platform 48 follows the movement of stop screw 77 due to the continued pressure exerted by air motor 70. As stop screw 77 is threaded into sleeve 343, the pressure exerted by air motor 70 pulling rod 72 back into cylinder 71 must be overcome to move stop plate 58 transversely outward. Gear 342 has a much narrower gear face than gear 338 so that they remain engaged while stop screw 77 moves within sleeve 343. This is also the reason why the gear 269 and bearer ring 297 of printing roller 61 are narrower than the matching gear 288 and bearer ring 287 of swing gear assembly 268. Thus, axial registration errors of printing plate 62 relative to the component image(s) previously printed on web 11 can be corrected by actuating stepper motor 340 in order to move platform 48, and therefore printing roller 61, in the manner just described.

A number of the advantages of the press 10 incorporating principles of the present invention may be better realized by constructing the press 10 with augmented structure to improve its overall rigidity or resistance to deflection (e.g. frame 36), and with tightly controlled tolerances and clearances of press elements (e.g. engaged gears and roller bearings 108, 112). By augmenting the overall structure of press 10, keeping tighter tolerances and limiting clearances wherever practicable, the press 10 will operate with less vibration and chatter. Curtailing vibration and chatter is helpful in attaining faster printing speeds. The present exemplary flexographic printing press 10 has been able to reach printing speeds of up to about 3 to 4 times faster than the prior flexographic printing press manufactured by the assignee of the present invention, while still maintaining satisfactory print quality.

Computer Control System

Figure 23:
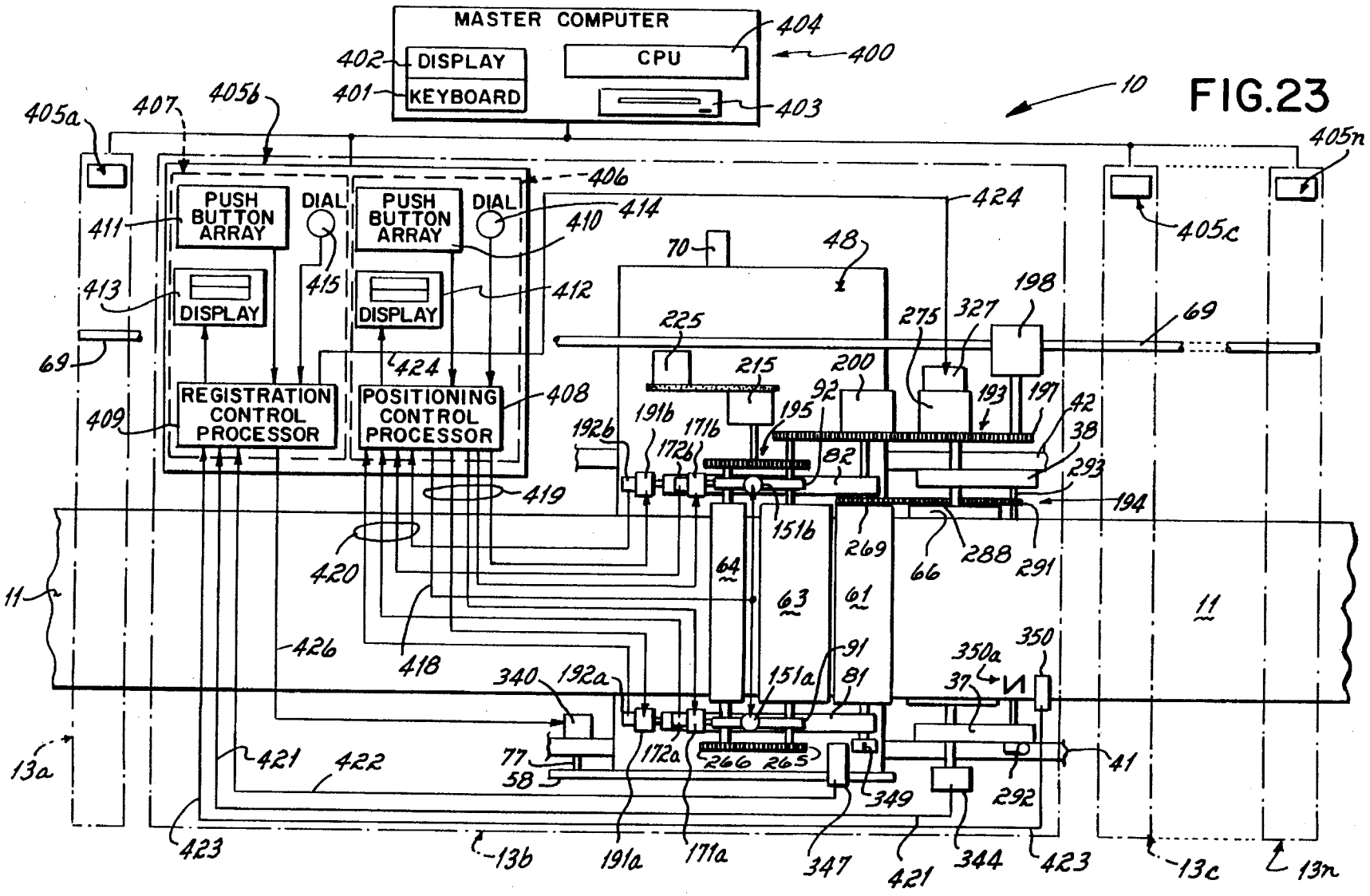
FIG. 23 is top plan view including a block diagram of one preferred embodiment of a computer control system of the press of FIG. 1.

Referring to FIG. 23, the preferred embodiment of the automated printing press of the present invention is illustrated in diagrammatic form, particularly showing the computer control system. The computer control system includes a master computer 400 that includes a keyboard 401 for data entry, a display 402, a removable or fixed disk storage medium 403, and a central processing unit 404. Preferably, the display 402 and keyboard 401 are combined into a touch screen display/input device.

The master computer 400 provides an operator interface with all of the standard control features of the printing press 10. In addition, the master computer 400 monitors and controls a plurality of individual station control computers **405*a* through 405*n* at each of the stations 13*a* through 13*n*, respectively, generically referred to as the individual or station computers 405**.

At each station 13, the computer 405 controls relative roller positioning, circumferential preregistration of the printing roller 61 with respect to all of the other stations 13, automatic circumferential (i.e. longitudinal or lineal) registration of the printing roller 61 with respect a longitudinal reference point on the web 11, preferably printed by the first one **13*a* of the stations 13, and an automatic axial (i.e. transverse) registration of the printing roller 61 with respect to a transverse reference point on web 11, preferably also printed by the first one 13*a* of the stations 13**.

In the automated or computer controlled functions performed by the station computers 405, data is taken of the measurements made as well as the corrections made under the control of the computer 405. This data is stored temporarily by the computers 405 and downloaded to or read periodically by the master computer 400 for analysis, system maintenance and future system setup and design.

The computer control system contributes to the objectives of the invention by providing a roller positioning feature which fully automates the setting of relative positions of the rollers 61, 63, 64 and 66 with respect to one another at each of the stations 13. The Computer Control System also provides a registration feature for setting and maintaining the positions of the printing rollers of the different stations 13 with respect to web 11. The registration feature further includes the subfeatures of preregistration (initial gross registration of the rollers of different stations 13 with respect to each other), circumferential or lineal registration (automatic maintenance of an optimum longitudinal registration of the printing rollers 61 with respect to images printed on the web 11), and axial registration (automatic maintenance of an optimum transverse registration of the printing rollers 61 with respect to images printed on the web 11).

Furthermore, the features of the computer control system, by being provided in combination as set forth herein, enhance the advantages of each of the other computer control features by preserving and rapidly restoring the proper relationships between the rollers within and among each of the stations 13, thereby allowing the advantages of the others of the computer control features to be more fully realized. These features also cooperate with the mechanical features described above. For example, the mechanical off-line servicing feature functions in cooperation with the positioning feature as well as with the axial registration feature to preserve the positioning and registration settings when off-line servicing is carried out. Also, with the computer controlled positioning, certain adjustments can be carried out on the fly without disturbing the automatically maintained circumferential registration.

The master or host computer 400 is capable of providing, from a central location, operating, monitoring and control of all of the input and output functions that can be carried out at the individual computers 405. Setup parameters may be made from the host computer 400 by issuing global commands to all of the computers 405 of the stations 13 or by issuing commands selectively to individual ones of the computers 405. From the host computer 400, an operator can comparatively monitor the running data regarding registration at each station 13 and make compensating adjustments that take into account an analysis of the performance of all of the stations 13. The analysis may be that performed by the operator or by software in the host computer 400.

The individual computers 405 at each of the stations 13 are preferably divided into two physically distinct processing units, including a positioning controller 406 and a registration controller 407, still referring to FIG. 23. Each of the controllers 406 and 407 may be interconnected, or, preferably, are both connected to the master computer 400, with which they communicate bi-directionally, and which controls any communication between the controllers 406 and 407 of a respective station 13, or between and among processors 406, 407 of others of the stations 13. The positioning controller 406 includes a processor 408, made up of a microprocessor, drivers and interfaces for the hardware it monitors or controls, and related devices and circuitry. Similarly, the registration controller 407 includes a similarly equipped processor 409. Each of the controllers 406, 407 also respectively includes a sixteen button capacity four by four array input panel 410, 411, a two line LED display 412, 413 and a rotary incremental dial 414, 415. The buttons of the panels 410, 411 allow for the inputting of commands by their depression, alone or in combination with others. The displays 412, 413 display the function selected to the operator. Where the commands involve numerical settings (such as the settings of web thickness or repeat length), the displays 412, 413 display the current numerical values thereof to the operator. Where the numerical values are to be changed, rotation of the dials 414, 415 are rotated, with each clockwise click of the dial incrementing the value displayed and each counterclockwise click of the dial 414 decrementing the value displayed.

The positioning control processor 408 of the positioning controller 406 of each station 13 controls the operation of stepper motors 171 and 191 and air cylinders 151, and reads the encoders 172 and 192. It may also include other outputs and inputs, such as limit switch inputs to verify the positions of, for example, the air cylinders 151. In the diagram of FIG. 23, the air cylinders 151 include an operator side air cylinder 151*a* and a gear side cylinder 151*b*, while the stepper motors 171 and 191 include operator side motors 171*a* and 191*a* and gear side motors 171*b* and 191*b*, respectively. Similarly, encoders 172 and 192 include operator side encoders 172*a* and 192*a* and gear side encoders 172*b* and 192*b*, respectively.

The processor 408 preferably has at least five outputs: one output 418 connected to the control line inputs of the metering roller air cylinders 151*a*, 151*b*, preferably to simultaneously actuate the cylinders, and four outputs 419, one connected to each of the respective stepper motors 171*a*, 171*b*, 191*a* and 191*b*. Sensor outputs from each of the encoders 172*a*, 172*b*, 192*a* and 192*b*, corresponding respectively to the stepper motors 171*a*, 171*b*, 191*a* and 191*b*, are connected to inputs 420 of the positioning controller processor 408.

The registration processor 409 of the registration controller 407 of each station 13 preferably has at least six inputs and at least two outputs. These include a web longitudinal motion input 421, which receives pulses from an encoder 344 on the shaft of the impression roller 66. These pulses each represent a fixed increment of angular rotation of the impression roller 66, which are proportional to a fixed increment of length of web 11 that moves through the station 13. Another input 422 is connected to the output of an optical sensor 347 and reads pulses corresponding to the angular position of the print roller 61 that brings a mark 349 on the print roller 61 into alignment with the sensor 347. A similar input 423 is connected to the output of an optical sensor 350 and reads pulses that correspond to the presence adjacent the sensor 350 of one of a plurality of marks 350*a* on the web 11 that are printed at the first station 13*a* along with the first image, and thus precisely positioned on the web 11 with respect to the image printed at the first station. Output 424 is connected to the stepper motor 327 that indexes the harmonic drive 275 to communicate control pulses thereto.

For axial registration, control pulses are sent on output line 426 from the processor 409 to the stepper motor 340.

The configuration, logic and operation of the computer control system is explained more fully in connection with the individual functions of the computer control features discussed below.

Computer Controlled Positioning

With the base platform 48 in the operational position, the computer control positioning system controls the relative positions of the printing mechanism rollers 61, 63 and 64 by moving the rollers relative to each other and to the impression roller 66 of the station 13. The printing mechanism rollers 61, 63 and 64 are movable between a printing position and at least one and preferably multiple non-printing positions. In the printing position the rollers 61, 63 and 64 are in positions to apply at least one component image of transferable image forming fluid to the web 11 every revolution of the printing roller 61. In any of the non-printing positions, the rollers 61, 63 and 64 of the printing mechanism 60 are not in positions to apply a component image to the web 11.

When the rollers of the printing mechanism 60 are in printing position, the metering roller 64 is in sufficient contact with the anilox roller 63 to properly supply the transferable image forming fluid or ink to roller 63. In addition, the anilox roller 63 is in a fluid dispensing position relative to the printing roller 61 where the ink is dispensable in a sufficient amount from the anilox roller 63 to the printing plate 62 each revolution of the printing roller 61. Also, the printing roller 61 is in an image applying position relative to the backing face 67 of the impression roller 66 (i.e., the web 11) where at least one component image of satisfactory quality can be applied to the web 11 by printing plate 62 every revolution of printing roller 61. When the printing mechanism 60 is in the printing position, the anilox and metering roller gears 265 and 266 are engaged, and the leading gear 288 and bearer ring 287 of the swing gear assembly 268 are engaged and in contact with the printing roller gear 269 and bearer ring 297, respectively (see FIGS. 6, 11 and 15).

One non-printing position of the printing mechanism 60 is a throw-off position. In this position, the anilox and metering roller 63 and 64 are moved out of the fluid dispensing position and into a cut-off position. In the cut-off position, the stepper motors 171*a* and 171*b* of gear box assemblies 170 (see FIG. 7) are actuated to move the upper carriages 89 and 90 upline. The upper carriages 89, 90 are moved a small distance to back the anilox roller 63 just far enough away from the printing roller 61 that the ink is no longer dispensable to the printing plate 62. In addition, the stepper motors 191*a* and 191*b* are actuated to move the lower carriages 81, 82, and therefore the entire printing mechanism 60, upline. The carriages 81, 82 are moved a small distance to back the printing roller 61 far enough away from the impression roller 66 to be out of position to apply an image to web 11 (i.e., out of printing position). Further, air cylinders 151*a* and 151*b*, which are manually controlled, remain activated, thereby keeping the anilox and metering rollers 63 and 64 in proper ink supplying contact.

The printing mechanism rollers 61, 63 and 64 are automatically moved from printing position to the throw-off position whenever the printing press 10 is shut down or stopped. An operator may also manually actuate the printing mechanism rollers 61, 63 and 64 from printing position to the throw-off position while the press 10 is running. This feature enables an operator to isolate one or more colors during the initial set up of a printing run (i.e., making initial image quality determinations). Preferably, during movement to the throw-off position with the press 10 still running, the motors 191*a*, 191*b* are actuated and the lower carriages 81, 82 moved after the anilox and metering rollers 63 and 64 have been moved out of the fluid dispensing position and into the cut-off position. By first cutting off its supply of ink before moving the printing roller 61, any ink left on the printing plate 62 may be transferred onto the web 11 before the printing roller 61 is moved. In this way, the ink may be cleaned off of the plate 62, rather than drying thereon.

When they are moved from the printing position to the throw-off position, the upper carriages 89, 90 are moved identical distances by actuating the stepper motors 171*a* and 171*b* simultaneously an equal number of increments or steps. Likewise, the lower carriages 81, 82 are moved identical distances from the printing to the throw-off position by actuating motors 191*a* and 191*b* in the same manner. Thus, while the relative positions of (i.e., distances between) the printing mechanism rollers 61, 63 and 64 may be changed, the relative angular orientation of each roller axis is maintained, typically in a parallel orientation.

While in the throw-off position, the printing roller 61 is still sufficiently close to the swing gear assembly 268 for their respective gears 269, 288 and bearer rings 297, 287 to remain fully engaged. Swing gear assembly 268 remains engaged as roller 61 is backed away to the throw-off position because air powered rotary actuator 292 (see FIG. 6) continues to apply a torque to shaft 293 which is transmitted to swing gear housing 270, as previously described, rotating leading gear 288 and bearer ring 287 in an upward arc around shaft 273 and toward the retreating printing roller 61. In other words, rotary actuator 292 acts as a pivoting and biasing mechanism which biases housing 270 upwardly to maintain leading gear 288 in engagement with printing roller gear 269 in both the printing position and the throw off position. In addition, once the throw-off position is reached, clutch assembly 200 is deactivated, clutch assembly 215 is activated and motor 225 is turned on (see FIG. 14). In this manner, the anilox and metering rollers 63 and 64 are isolated from the common drive shaft 69. At the same time, rollers 63 and 64 are continually rotated by motor 225 in order to prevent the ink from drying on the surface of either roller 63, 64.

Another non-printing position of the printing mechanism 60 is a retracted or backed-off position. In this position, the upper carriages 89, 90 (the anilox and metering rollers 63 and 64), are moved further upline to or almost to the full capabilities of the upper slide assemblies 91 and 92. The lower carriages 81 and 82 (i.e., printing roller 61) are also moved further upline but only to about half the capabilities of the lower slide assemblies 83 and 84. This movement of the upper and lower carriages 89, 90 and 81, 82 is achieved by additional simultaneous and identical actuation of respective stepper motors 171*a*, 171*b* and 191*a*, 191*b*, in the same manner as previously described for movement to the throw-off position. Before the carriages 89, 90 and 81, 82 begin moving from the throw-off position to the retracted position, the press 10 is turned off then the action of the rotary actuator 292 (see FIG. 6) is reversed and the leading gear 288 of the swing gear assembly 268 is rotated down and away from the printing roller gear 269. While in the retracted position, the printing roller 61 is not only out of position to apply a component image to the web 11, the roller 61 is also too far away from the swing gear assembly 268 for the swing gear 288 to engage and drive the printing roller gear 269 even if gear 288 were swung back up. While in this retracted position, the anilox and metering roller 63 and 64 are preferably still being rotated by motor 225 to prevent the ink from drying on their surfaces.

When the carriages 89, 90 and 81, 82 (i.e., rollers 63 and 64, and 61) are moved from the retracted to the printing position, the press 10 is preferably turned off (i.e., the gear train 68 is not being driven). When the printing mechanism rollers 61, 63 and 64 reach the throw-off position, the actuator 292 is automatically activated pivoting the leading gear 288 of the swing gear assembly 268 upward to fully engage the printing roller gear 269. The rollers 61, 63 and 64 would then move on to their respective printing positions, with the swing gear 288 pushed downward slightly. However, if the press 10 was running, the rollers 61, 63 and 64 would not move past the throw-off position to the printing position, and the actuator 292 would not be activated to swing the leading gear 288 upward to engage print roller gear 269. With the press 10 running and the printing mechanism rollers 61, 63 and 64 in printing position, turning the press 10 off causes the rollers 61, 63 and 64 to automatically move to the throw-off position.

Actuation of the stepper motors 171 and 191 is brought about by the communicating of control signals on the lines 419 to carry an identical number of pulses to respective motors 171 and 191. Each pulse causes a fixed movement of respective carriages 89, 90 and 81, 82 when received by respective stepper motors 171*a*, 171*b* and 191*a*, 191*b*. The processor 408 keeps track of the exact positions of the stepper motors 171*a*, 171*b* and 191*a*, 191*b* by pulses from the respective encoders 172*a*, 172*b* and 192*a*, 192*b* communicated over the corresponding lines 420. Each of the pulses received from the encoders 172*a*, 172*b* and 192*a*, 192*b* represents a fixed increment of movement of the respective carriage 89, 90, 81 and 82, and thus the respective rollers 63 and 64, and 61. The encoders 172*a*, 172*b*, 192*a* and 192*b* associated with the stepper motors 171*a*, 171*b*, 191*a* and 191*b* provide feedback to the computer control positioning system. This feedback enables the processor 408 and the host computer 400 to know whether a particular stepper motor 171 or 191 has in fact been actuated and moved the desired amount. The combination of the present computer control positioning system and the structure of the previously described positioning mechanism 78 enable the printing mechanism rollers 61, 63 and 64 to be moved out of a particular printing position and returned to that printing position within a very high degree of accuracy.

The stepper motors 171*a*, 171*b*, 191*a* and 191*b* may also be operated in an adjustment mode in which the operating position of the print roller 61 relative to the impression roller 66, and the operating position of the anilox roller 63 with respect to the print roller 61, may be adjusted. These adjustments can be made to set the roller spacings, by sending the same number of pulses to each of the stepper motors of the pairs 171 or 191, thereby moving the rollers toward and away from each other. The adjustments also can be made by activating each of the stepper motors 171*a*, 171*b*, 191*a* and 191*b* individually, and thereby adjusting the relative inclinations or skew of the axes of the rollers with respect to each other. Such adjustments can be made either when the press 10 is shut down or when it is in operation printing images upon the web 11.

Figure 25:
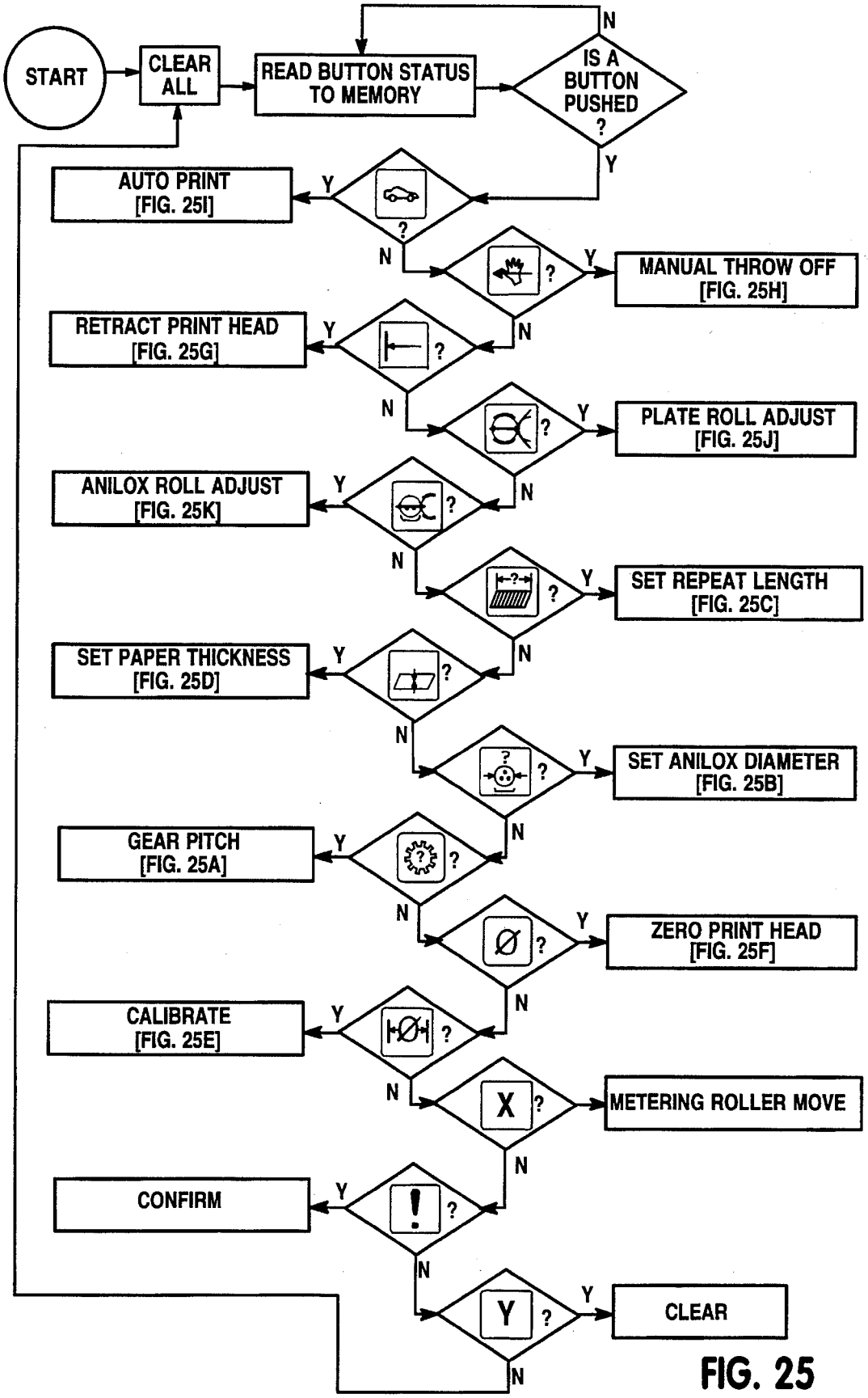
FIG. 25 is a flow chart schematically representing MAIN LOOP of the operation of the positioning controller of FIG. 24.

The block diagram of FIG. 24 and flowchart of FIG. 25 symbolically represent the operation of the positioning controller 406. Generally, the processor 408 includes a microprocessor 430, such as a Motorola MC68HC711E9FS, that is programmed to interrogate button activity performed by an operator at the panel 410 or with the dial 414, and by pulses from the encoders 172 and 192. The microprocessor 430 also performs processing operations to translate the input information into appropriate control signals on the lines 418 and 419.

Symbolically, referring to FIG. 24, buttons 410*a*–410*p* of the control panel 410 may be considered as connecting through an interface 431 such as a programmed array logic chip (PAL), as, for example, industry standard part number GAL-22V10. The microprocessor 430 causes the interface 431 to check the state of the buttons periodically, for example, every 1/50th of a second, communicating their status to a memory section 432 of the processor 408 which stores them as a plurality of logical variables 432*a*–432*p*, each representing a state of one of the pushbuttons 410*a*–410*p*. When any of the variables 432*a*–432*p* is zero, for example, this represents that the corresponding button 410*a*–410*p* is not pushed. When any of the variables 432*a*–432*p* equals one, for example, this represents that the corresponding button 410*a*–410*p* is pushed. For a button to be interpreted as pushed, the interface must return a 1 for four consecutive interrogation cycles. In one embodiment, when a button push has been detected, the microprocessor 430 compares the pattern of bits in memory 432 with valid settings to identify the function selected, ignoring all invalid combinations. When a valid pattern is identified, the appropriate routine is executed, as illustrated in FIG. 25.

The program executed by the microprocessor 430 may alternatively execute the loop illustrated in FIG. 25 so as to determine whether any button has been pushed on the panel 410, and allow only a single button to be pushed at a time. Thus, the program need only identify one button at a time. The pressing of any one of the buttons thus turns off all other buttons that might have been pushed and not otherwise cleared by the program. In such an embodiment, multiple button commands are selected by sequentially pushing a combination of buttons on the panel 410.

The processor 408 also includes a section of memory 433 that stores a plurality of numerical integer variables 433*a*–433*d*, each representing a count cumulatively incremented or decremented by pulses received over a respective one of the lines 420 from the encoders 172 and 192. The input lines 420 may be considered as each connected through an interface 434, such as an RS485 interface chip, that functions in cooperation with the microprocessor 430 or with a separate processing device to count the pulses received over lines 420 from the encoders 172 and 192. The microprocessor 430 interprets the signals for directionality and then either increments or decrements the count stored in the memory location 433*a*–433*d* corresponding to the respective one of the encoders 172, 192 from which the pulses are received. Each encoder 172 and 192 generates one pulse for each 1/200th of the encoder rotation, which will correspond to a fixed increment of motion of the respective carriage 81–82, 91–92. These pulses are generated at the encoder on each of two channels, and are 90° out of phase. With such phase change pulses, the discrimination of the encoder is 1/800th of a rotation of its shaft. After gearing, this amounts to 0.005 mm of carriage travel per phase change pulse, or 0.197 mil, or approximately 0.0002 inches. In addition, the encoders are thereby direction responsive. For example, when the signal on one channel moves from a 0 to a 1 state while the signal on the other channel is 0, or from a 1 to a 0 state when the signal on the other channel is 1, forward motion is indicated. When the signal on the one encoder moves from a 0 to 1 state while the signal on the other channel is 1, or from a 1 to a 0 state when the signal on the other channel is 0, reverse motion is indicated. This direction responsiveness of the encoders provides a means to discriminate between actual rotation of the stepper motors 171 and 191 and extraneous pulses caused by vibrations which might occur when the motors are stationery. The default values of the variables 433*a*–433*d* are zero. The variables 433*a*–433*d* will reflect the cumulative algebraic sum of the pulses counted from each respective decoder 172, 192 and may be considered counter variables.

The dial 414 also connects through an interface 435 to a memory variable 436*a* in a memory location 436. The dial 414 clicks every fraction of a rotation in either direction to produce a series of direction sensitive pulses sequentially to the interface 435 to increment or decrement, for clockwise or counterclockwise rotation respectively, the current integer value of the variable 436*a*. The variable 436*a* will thereby reflect the cumulative algebraic sum of the pulses counted from the dial 414 since the last resetting or clearing of the variable 436*a*. The variable 436*a* may thereby also be considered a counter variable.

An additional memory section 438 stores output integer variables that represent the number of pulses to be sent to the stepper motors 171, 191. Corresponding variables 438*a*–438*d* are stored in the memory section 438 and, when output signals are to be generated on the lines 419 through drivers 439, under control of the microprocessor 430, the preset counts of each of the memory variables is increased or decreased to zero, thus producing forward or reverse pulses to the corresponding stepper motor that increase or decrease the current position counts to an appropriate target count. The driver interface chips or drivers 439 are appropriate to power the particular stepper motors 171 and 191 being driven.

In one embodiment, the counters 433, 436 and 438 are separate from the memory within the microprocessor 430, for example, within a field programmable gate array (FPGA), such as the chips made by Xilinx, which may be programmed to contain the counters 433, 436 and 438, for example. Such counters will respond to interrupts from the encoders without requiring interruption of the microprocessor 430, which can then interrogate the counters at its convenience.

Further memory locations 440 are provided to store settings such as REPEAT LENGTH 440*a* (which is directly proportional to print roller diameter), PAPER THICKNESS 440*b*, ANILOX ROLLER DIAMETER 440*c* and GEAR PITCH 440*d*. The memory 432,433,436,438,440 is non volatile memory either connected to the microprocessor 430, as are the interfaces and drivers, through computer busses 441 or contained within the microprocessor chip. In addition, one or a pair of output drivers 441, connected to the microprocessor 430, may be provided for energizing the air cylinders 151 to move the metering roller in or out with a bi-directional signal on line 418. The display 412, also connects to the microprocessor 430, is provided with LEDs displays 412*a* and 412*b*. The display, outputs to the operator two line alphanumeric or digital data indicative of the operation or function selected by the operator, such as output settings, and may display a current setting for comparison with a new setting as incremented or decremented by the dial 414.

Additional volatile memory 442 and programmable read only memory 443, such as an EEPROM, are provided for storing values, constraints, calibration settings, intermediate variables and program. Additional drivers 444 are provided to operate anilox roller clutches 200 and 215, swing gear drive and other functions.

In operation, following an initial installation of the machine 10 or loss of power to the controller 406, certain settings must be made. When the controller 406 is first energized, all values are defaulted to zero, or to some standard values programmed into the memory 443, which may be read only memory. At this point, the operator may press the SET GEAR PITCH button 410*m*. The Gear Pitch is the number of teeth per inch on the impression roller gear 196 that drives the print roller 61. Since this value changes only when a physical gear change is made to the machine 10, the setting may be made by way of a blank key code accessible only to service personnel, or the value may be programmed into the EEPROM 443. The Gear Pitch information is needed by the program in calculating the repeat length sizes that are possible, in that the repeat length is, preferably, made equal to the gear tooth count ratio of the print roller gear 269 to the impression roller gear 196 times the impression roller circumference. That is, the repeat length or circumference of the print roller 61 can only vary in increments equal to the circumference of the impression roller 66 divided by the number of teeth on the impression roller gear 196. Accordingly, the impression roller circumference must be known to the program and is preferably programmed into the EEPROM 443.

Figure 25B:
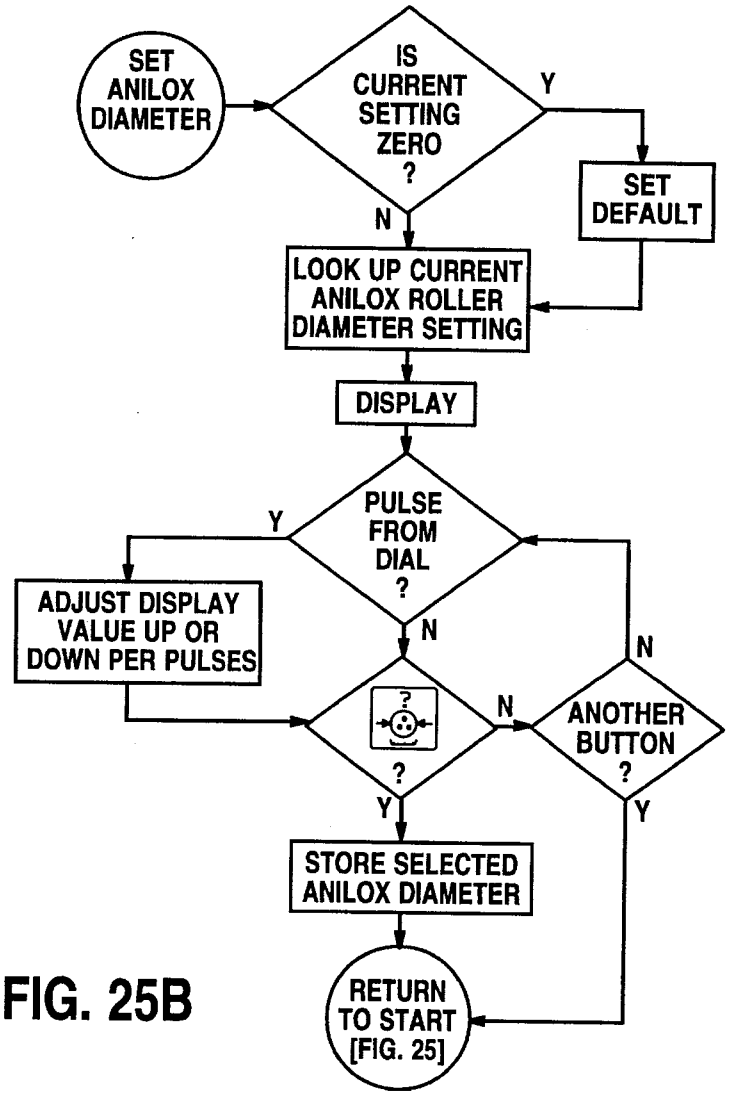
FIG. 25B is a flowchart of the ANILOX ROLL DIAMETER setting routine of the flowchart of FIG. 25.
Figure 25A:
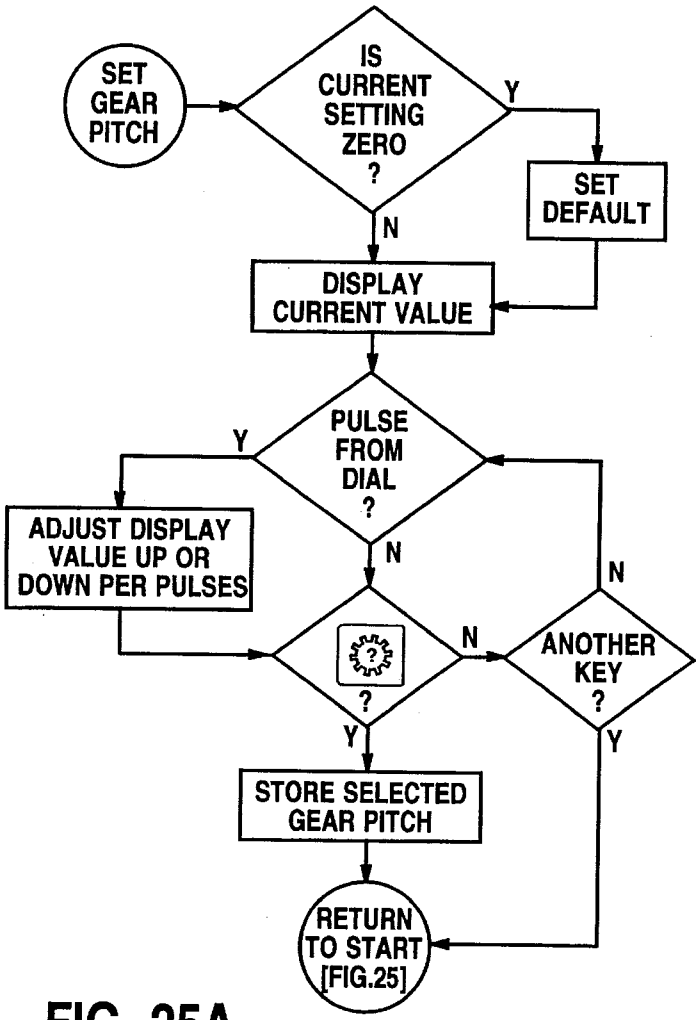
FIG. 25A is a flowchart of the GEAR PITCH setting routine of the flowchart of FIG. 25.

As shown in the flowchart of FIG. 25, the program will scan the memory 443, identify the button and execute the SET GEAR routine, which is illustrated in FIG. 25A. The preset or default gear pitch is initially loaded by the microprocessor 430 into memory variable 440*d*, which will be displayed to the operator on the display 412*a*, and also on display 412*b*. The routine may check for a setting and, if none has been made, set a default value as illustrated in the flowcharts, e.g., FIG. 25A, or, preferably, do so upon startup of the program. When the current value has been displayed, the operator turns the dial 414. This may be programmed to cause the display 412*b* to step through a preprogrammed list of gear pitches stored in the memory 443. Alternatively, the program may retrieve from memory the number of gear teeth on the impression roller gear 196 and increment that up or down directly from the pulses from the dial. The display may reflect the number of gear teeth and/or, preferably, a calculated number that reflects the impression roller circumference divided by the number of impression roller gear teeth. As another alternative, the display may directly increment the number representative of the gear pitch in accordance with pulses from the dial. When the proper pitch has been selected, the operator presses the button 410*m* again to load the new value into variable 440*d*, thereby setting it. Pressing another button instead cancels the setting charge and returns to start (FIG. 25).

As with the gear pitch setting, the operator may also check and reset, if desired, the ANILOX ROLL DIAMETER. This setting procedure is initiated by pressing the button 410*i*, which selects the SET ANILOX ROLLER DIAMETER routine, as illustrated in FIG. 25. This routine is similar to that of FIG. 25A, as is illustrated in detail in the flowchart of FIG. 25B. The default setting routing is preferably run at start-up. The current or default value for anilox roller diameter is displayed in displays 412*a* and 412*b*. The value in 412*b* may be stepped through a preprogrammed list of sizes by operating the dial 414, otherwise incremented up or down, in response to dial pulses, altering the display in display 412*b*. Once so selected, the operator sets the diameter to the selected diameter for the anilox roller 63 by pressing button 410*i* again, storing the value in the memory variable 440*c*.

Figure 25C:
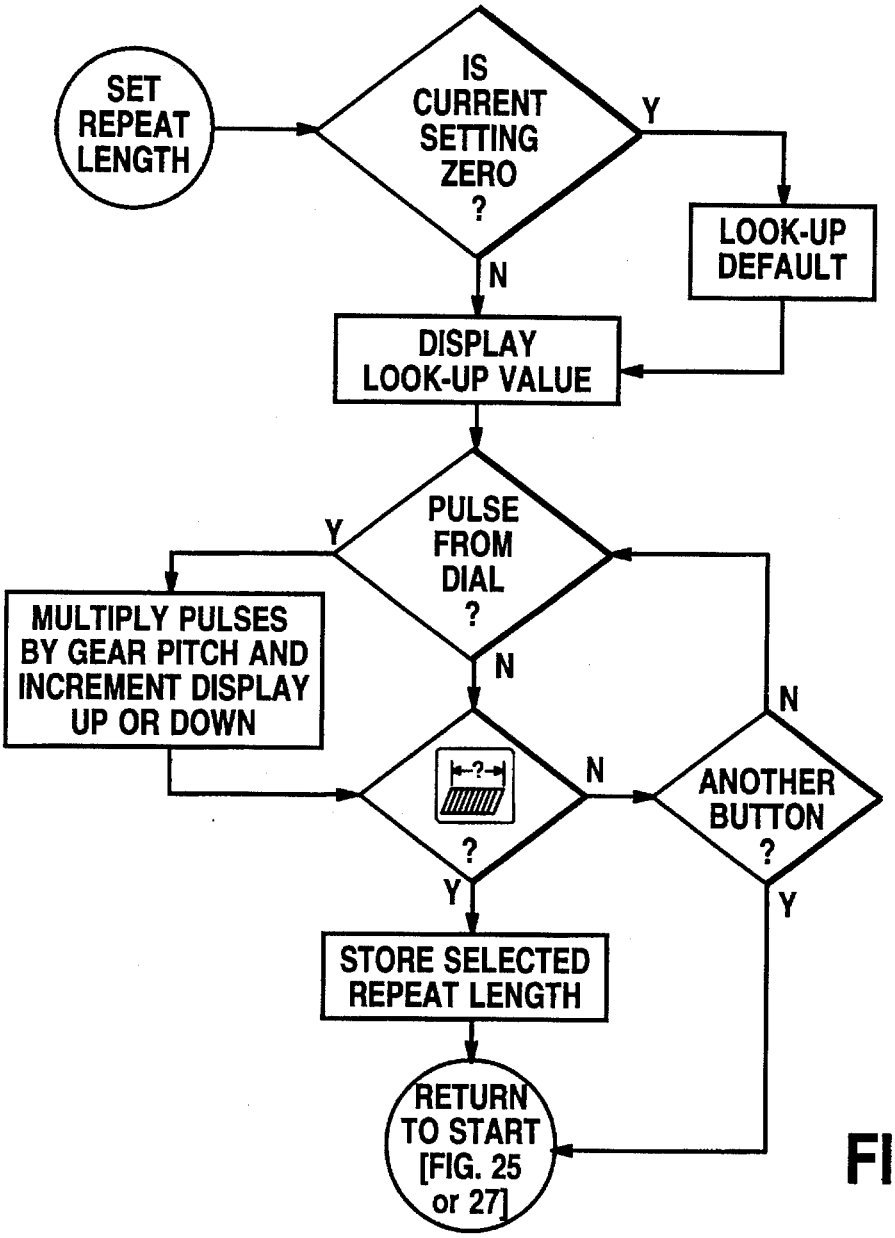
FIG. 25C is a flowchart of the REPEAT LENGTH setting routine of the flowchart of FIG. 25.

On the initial setup and whenever additional print jobs are set up on the machine 10, the operator will check, and often reset, the REPEAT LENGTH, which is related to the diameter of the printing roller 61 which must be known for positioning. The operator pushes the SET REPEAT LENGTH button 410*g*, which is identified by the program as shown in FIG. 25, which executes the SET REPEAT LENGTH routine illustrated in FIG. 25C, also in a manner similar to that of FIG. 25A. The default setting portion of the routine is preferably executed at start up rather than as illustrated. The default value is preferably the largest print roller size mountable on the machine 10. This prevents inadvertent crashing of the print roller 61 and impression roller 66. The current or default value for repeat length is then displayed in display 412*a* and 412*b*. The value in 412*b* is stepped through a list of sizes by multiplying the pulses generated by operating the dial 414 by the gear pitch and adding the product to the current value, which alters the display in display 412*b*. When, the desired repeat length is selected, the operator sets the repeat length to the selected length by again pressing button 410*g*. The new value is stored in the memory 440*a*, and from it the print roller diameter is derived for use in the positioning calculations.

Figure 25D:
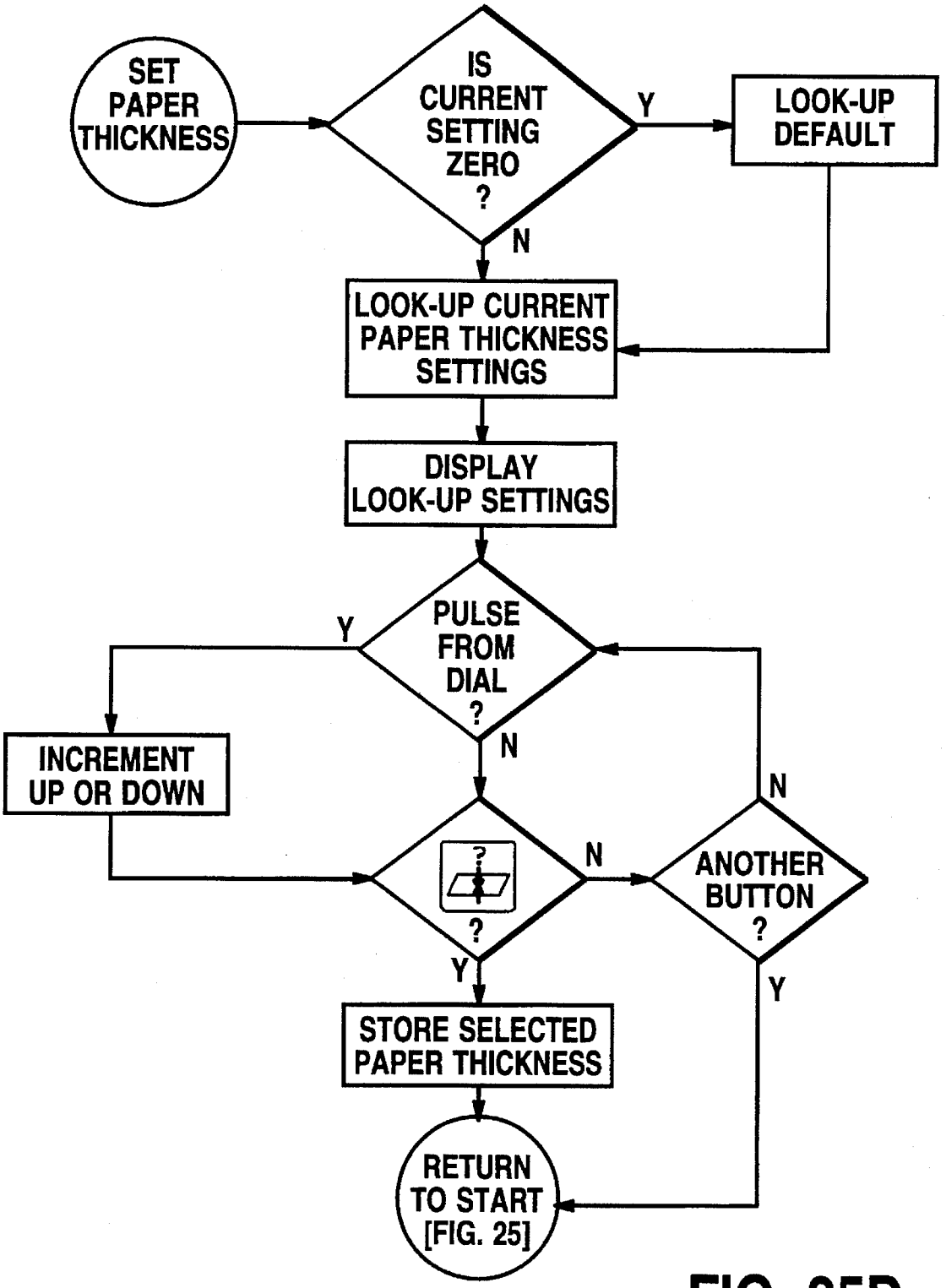
FIG. 25D is a flowchart of the PAPER THICKNESS setting routine of the flowchart of FIG. 25.

The web thickness is also set similarly, by pressing the button 410*h*. The program identifies button and initiates the SET PAPER THICKNESS operation, running the routine of FIG. 25D. The currently set value for web thickness, or if none, the default value, which is the thickest paper practicable, is displayed in display 412*a* and 412*b* in thousandths of an inch and the value in 412*b* is stepped through a preprogrammed list of thicknesses by operating the dial 414, which increments the display up or down in 1/1000th of an inch in display 412*b*. When, the desired web thickness is selected, the operator sets the current value of web thickness to the selected value by again pressing button 410*h*. The new value is stored in the memory 440*b*.

Figure 25E:
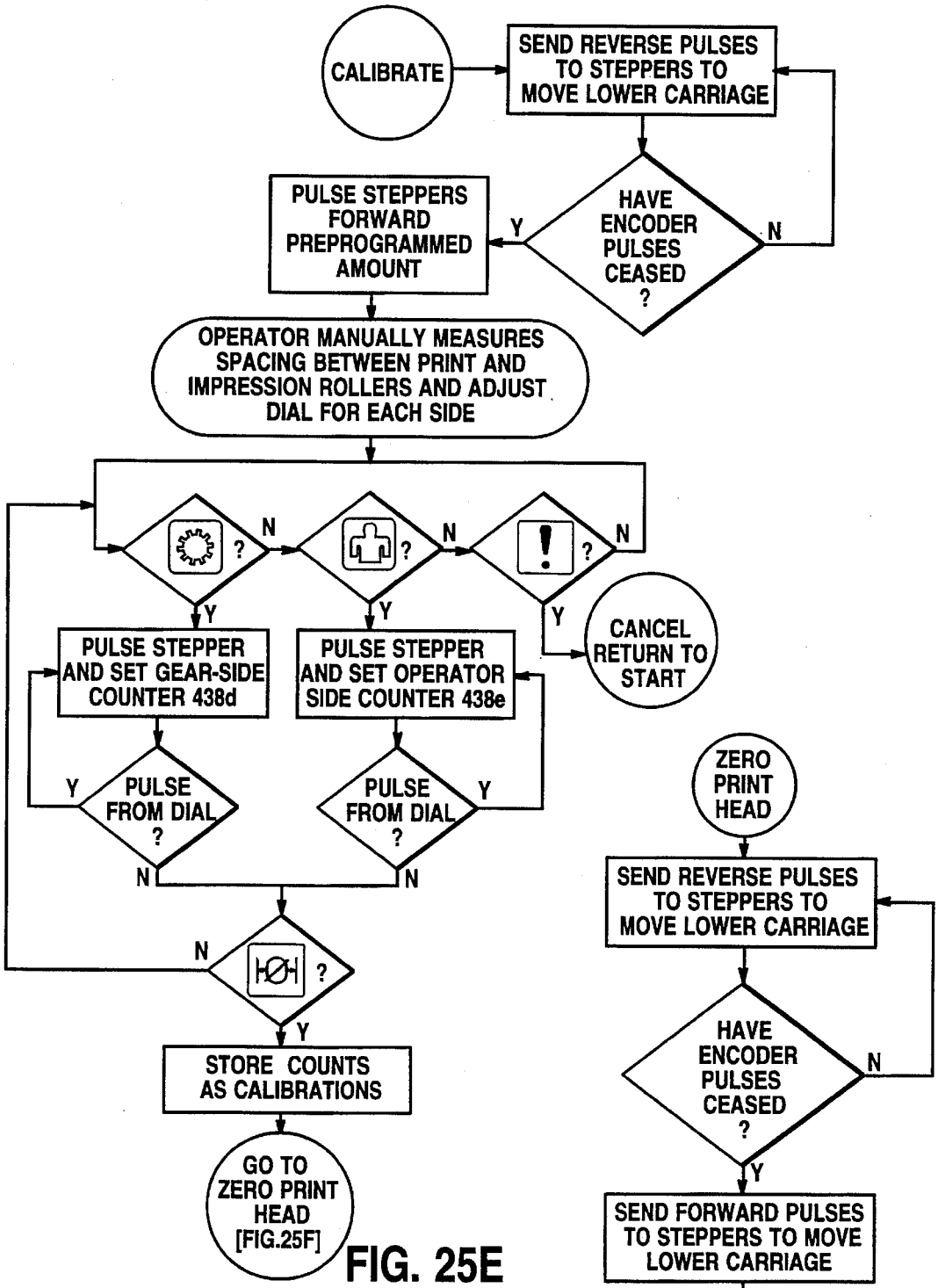
FIG. 25E is a flowchart of the CALIBRATE routine of the flowchart of FIG. 25.

In initial setup of the machine 10, and thereafter at infrequent intervals, the positions of the print mechanism 60 are calibrated. This is accomplished by pressing the CALIBRATE button 410*l*, which causes the program to initiate the CALIBRATE routine, illustrated in FIG. 25E. The operator then presses either the PLATE ROLL ADJUST button 410*d* or the ANILOX ROLL ADJUST button 410*c* to select the roller to be calibrated. When this routine is run, the stepper motors 191*a* and 191*b* or 171*a* and 171*b* are energized to move either the entire print mechanism 60 (i.e., the lower carriages 81, 82) or the anilox and metering rollers 63, 64 (i.e., the upper carriages 89, 90) to an extreme position away from the impression roller 66 and against respective mechanical stops 184*a* and 174*a*. Mechanical stops 184*a* and 174*a* may each be a surface on respective guide actuator brackets 184 and 174 (see FIG. 7). The motors 191 or 171 are energized by pulses through the corresponding drivers 439. As the stepper motors 191 or 171 move, the encoders 192 or 172 return pulses through the corresponding interface 434. When the microprocessor 430 detects that the pulses from the encoders 192 have ceased even though pulses are still being sent to the stepper motors 191 or 171, the conclusion is reached that the respective lower or upper carriages 81, 82 or 89, 90 have engaged their respective stops 184*a* or 174*a* and stalled. In this event, the count in each of the counters 433 is stored in the memory 442. Then the stepper motors 191 or 171 are driven a fixed number of pulses to move respective lower or upper carriages 81, 82 or 89, 90 toward the impression roller 66 to the retracted position. The number of pulses are predetermined by a preprogrammed back-off number in the memory 443.

The number of calibration pulses needed to bring the printing roller 61 in contact with the impression roller 66 or the anilox roller 63 in contact with the printing roller 61 from their respective retracted positions is separately determined for each of the stepper motors 191*a* and 191*b* or 171*a* and 171*b*. The number of calibration pulses are separately determined because the longitudinal distance or length of travel between one roller and another may be different from one side of the press 10 to the other. The operator may manually use a calibration caliper or gauge to measure the length of travel between the print roller 61 and either the impression roller 66 (for print roll calibration) or the anilox roller 63 (for anilox roller calibration) for each of the respective carriages 81, 82 or 89, 90. The operator would then press the respective button 410*a* or 410*b* identifying the side (i.e., gear or operator side). For each side, the dial 415 would then be turned an amount corresponding to the measured length. Pulses from the dial 415 individually increment the respective counter 438*c*, 438*d* or 438*a*, 438*b* and pulse the respective stepper motor 191*a*, 191*b* or 171*a*, 171*b*. When the operator is satisfied with a given setting, the operator presses the button 410*n* to store the calibration setting from each respective counter 438*c*, 438*d* or 438*a*, 438*b*. The program then proceeds to the Zero Print Head routine. Preferably, in performing the calibration, instead of a print roller 61 being mounted, a calibration bar (not shown) is used in its place. The bar is dimensioned to allow additional clearance for a custom gauge being used. The bar and gauge together simulate the spacing for a standard printing roller 61 of, for example, 16.5 inch circumference. For actual print rollers 61 of other sizes, the positions are calculated from the calibrated numbers and the set repeat length.

Figure 25F:
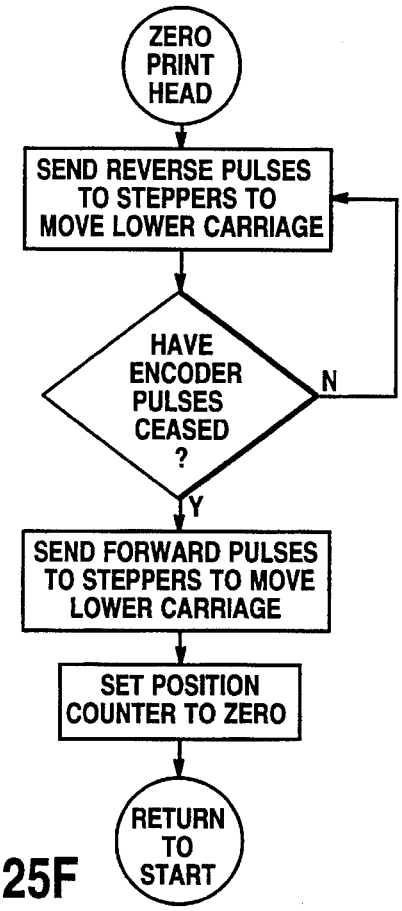
FIG. 25F is a flowchart of the ZERO PRINT HEAD routine of the flowchart of FIG. 25.

The Zero Print Head routine is run automatically following Calibration and at the selection of the operator upon power-up, by pressing the Zero Print Head button 410*k*. Pressing button 410*k* causes the program to execute the Zero Print Head routine illustrated in FIG. 25F. This routine zeros both the printing roller 61 and the anilox roller 63, simultaneously. The routine again pulses the stepper motors 191*a*, 191*b* and 171*a*, 171*b* rearward until the stops 184*a*, 174*a* are encountered, then forward by the programmed amount that defines the retracted position plus the calibration values. This defines the retracted position as a point spaced from the stops 184, 174*a* a fixed distance sufficient to insure that, in operation, the carriages 81, 82 and 91, 92 will not engage the stops 184*a*, 174*a*. The counters 433 are then set to zero at this Retracted Position. This setting establishes the zero reference positions from which the program calculates the various positions of the printing roller 61 and anilox roller 63. In moving between these positions, other functions such as coordinating the operation of the clutch assemblies 200, 215 and the swing gear assembly 268, and positioning of the print roller 61 and anilox roller 63, that occur as the print head 60 moves through various positions, are also controlled.

Figure 25G:
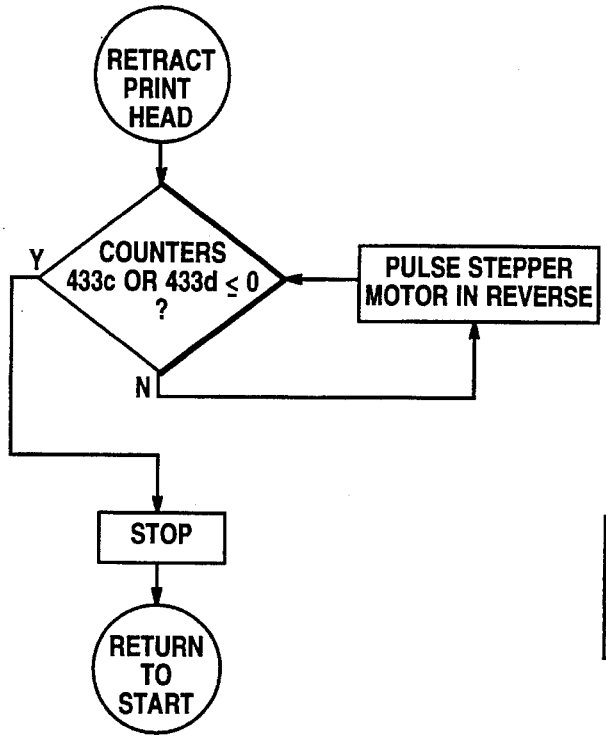
FIG. 25G is a flowchart of the RETRACT PRINT HEAD routine of the flowchart of FIG. 25.

In the operation of the press 10, the print mechanism 60 may be moved with precise repeatability among the retracted, throw-off and print positions. In the retracted position, the operator will service the mechanism 60, and may change plates 62, clean rollers, change print rollers 61, or perform operations that require movement of the base platform 48 between its operational and stand-aside positions (see FIGS. 4 and 5 respectively). Movement of the print head 60 to the retracted position is achieved by pressing the RETRACT PRINT HEAD button 410*j*, which causes the program to execute the RETRACT PRINT HEAD routine illustrated in FIG. 25G. This routine sends motion causing pulses to the stepper motors 191*a*, 191*b* and 171*a*, 171*b* to move the lower carriages 81, 82 (i.e. printing roller 61) and the upper carriages 89, 90 (i.e. anilox roller 63), respectively, to the retracted position. The retracted position is identified when the content of respective counters 433*c*, 433*d* and 433*a*, 433*b* equal zero, the calculated position attained as a result of the CALIBRATE and ZERO PRINT HEAD ROUTINES. In addition, the actuation of clutches, relays, and other functions that must take place will be actuated through drivers 444 in response to signals from the microprocessor 430.

Figure 25H:
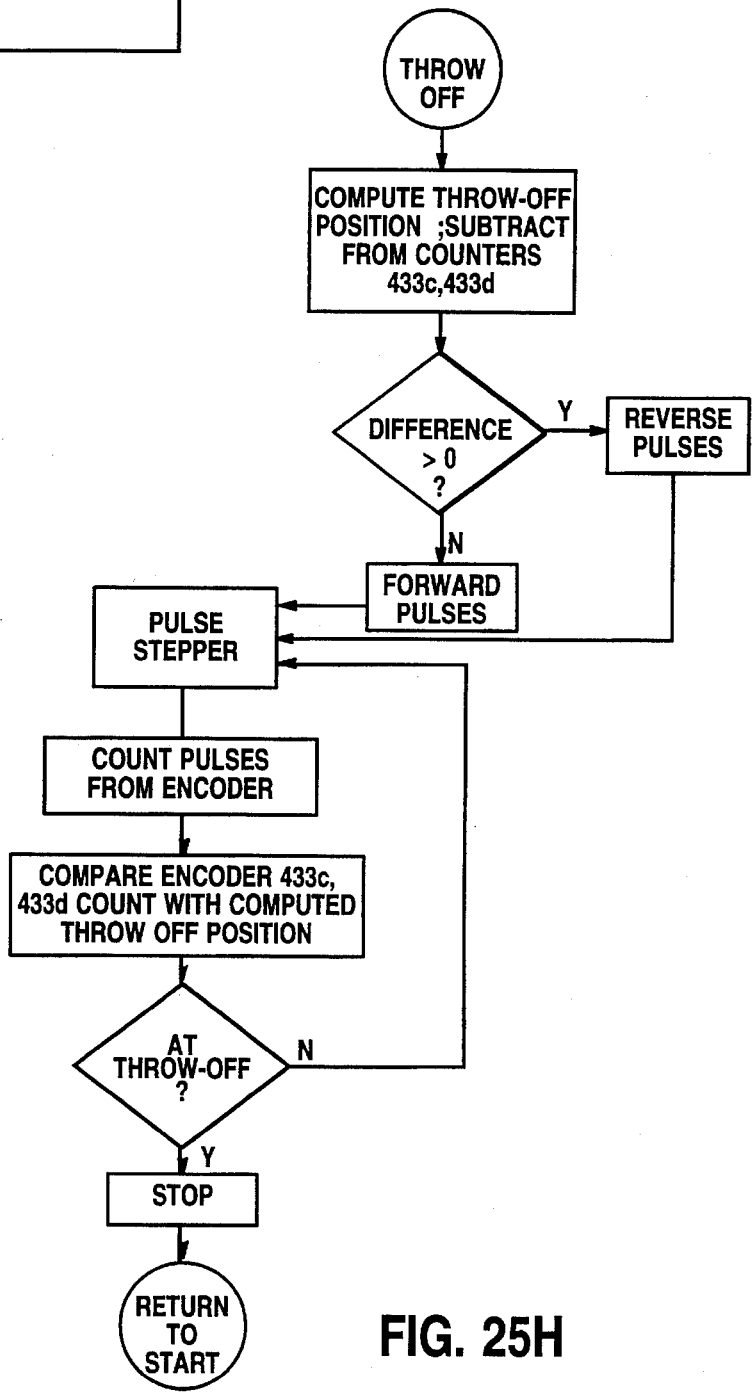
FIG. 25H is a flowchart of the MANUAL Throw-off routine of the flowchart of FIG. 25.

Movement of the print head 60 to the throw-off position is achieved by pushing the Throw-off button 410*f*, which causes the program to execute the Throw-off routine as illustrated in FIG. 25H. This routine moves the print mechanism 60, by sending pulses to the stepper motors 191*a* and 191*b* through the drivers 439, until the counters 433*c* and 433*d* indicate a count that is less, by a preprogrammed amount, than the calculated print position, as stored in the memory 443. In addition, pulses will also be sent to the stepper motors 171*a* and 171*b* to move the anilox roller 63, along with the metering roller 64, toward or away from the print roller 61. But, depending on whether the print head 60 is moving to the throw-off position from the retracted or print positions, control signals may be sent to control other functions through the drivers 444, to engage or release clutches 200 and 215 to drive the anilox roller 63, or other corresponding functions. From the printing to throw-off position, the stepper motors 171 may be actuated first, followed by actuation of the stepper motors 191 when it is desirable to remove any excess ink from the plate 62 by transferring the ink onto the web 11.

Figure 25I:
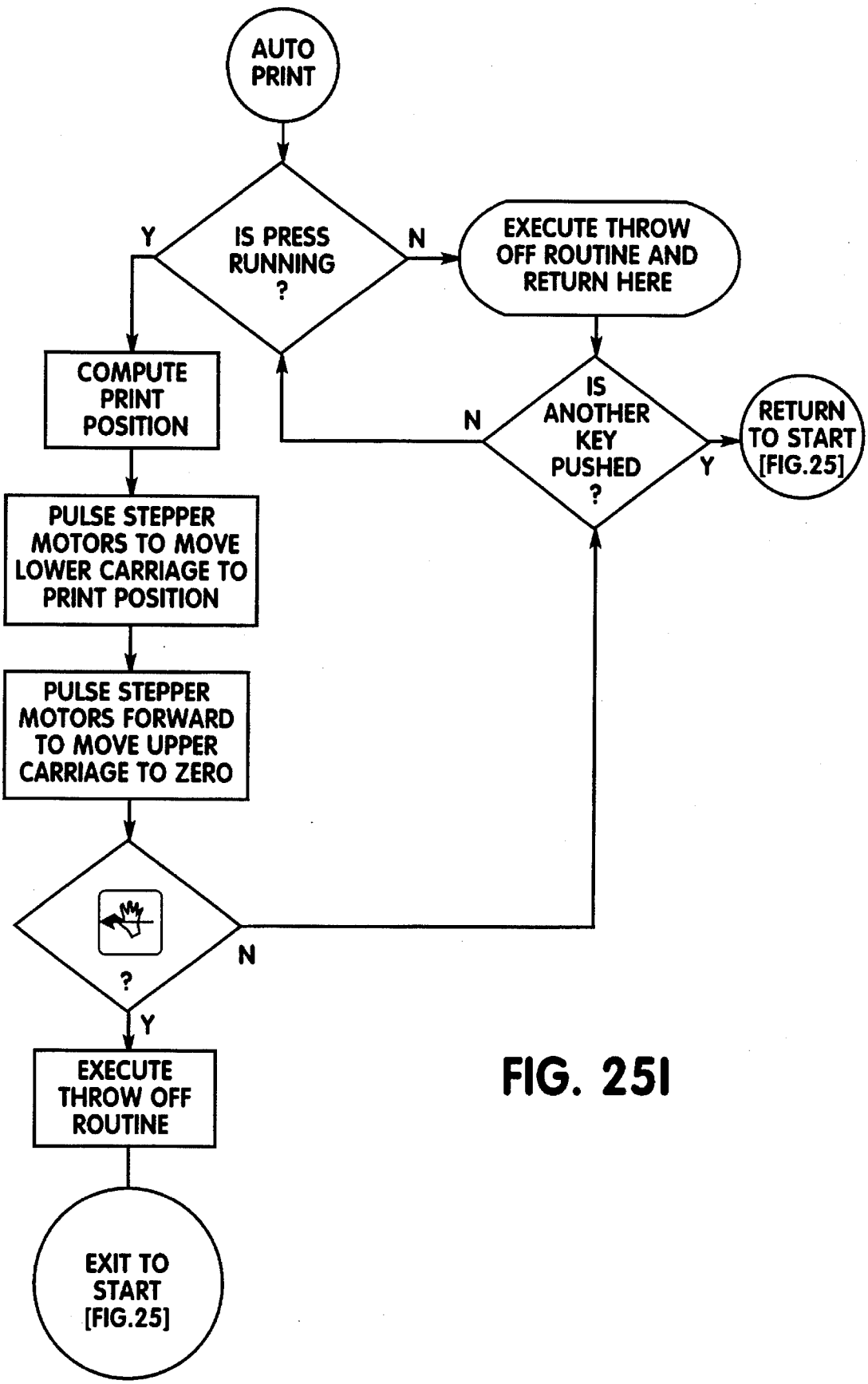
FIG. 25I is a flowchart of the AUTO PRINT routine of the flowchart of FIG. 25.

The movement of the print mechanism 60 to the print position is achieved by pressing the AUTO PRINT button 410*e*, which causes execution of the AUTO PRINT routine, as illustrated in the flowchart of FIG. 25I. In the auto print routine, the microprocessor 430 monitors whether the press is running, that is, whether the web 11 is being driven through the stations 13. This may be accomplished by detecting the presence and motion of the web 11 at the respective printing station 13, or preferably by a signal from the host computer 400. If the web 11 is in motion, the print mechanism 60 is moved to and/or held in the throw-off position. When the web is not moving, the stepper motors 191 are then activated to move the print roller 61 to the zero or print position, where the plate 62 is in printing relationship with the web 11. In addition, the motors 171 are stepped to bring the anilox roller 63 into fluid dispensing relation with the plate 62 on the print roller 61. Pressing the manual throw-off button while in Auto Print cancels Auto Print and moves the print head 60 to the throw-off position.

Figure 25J:
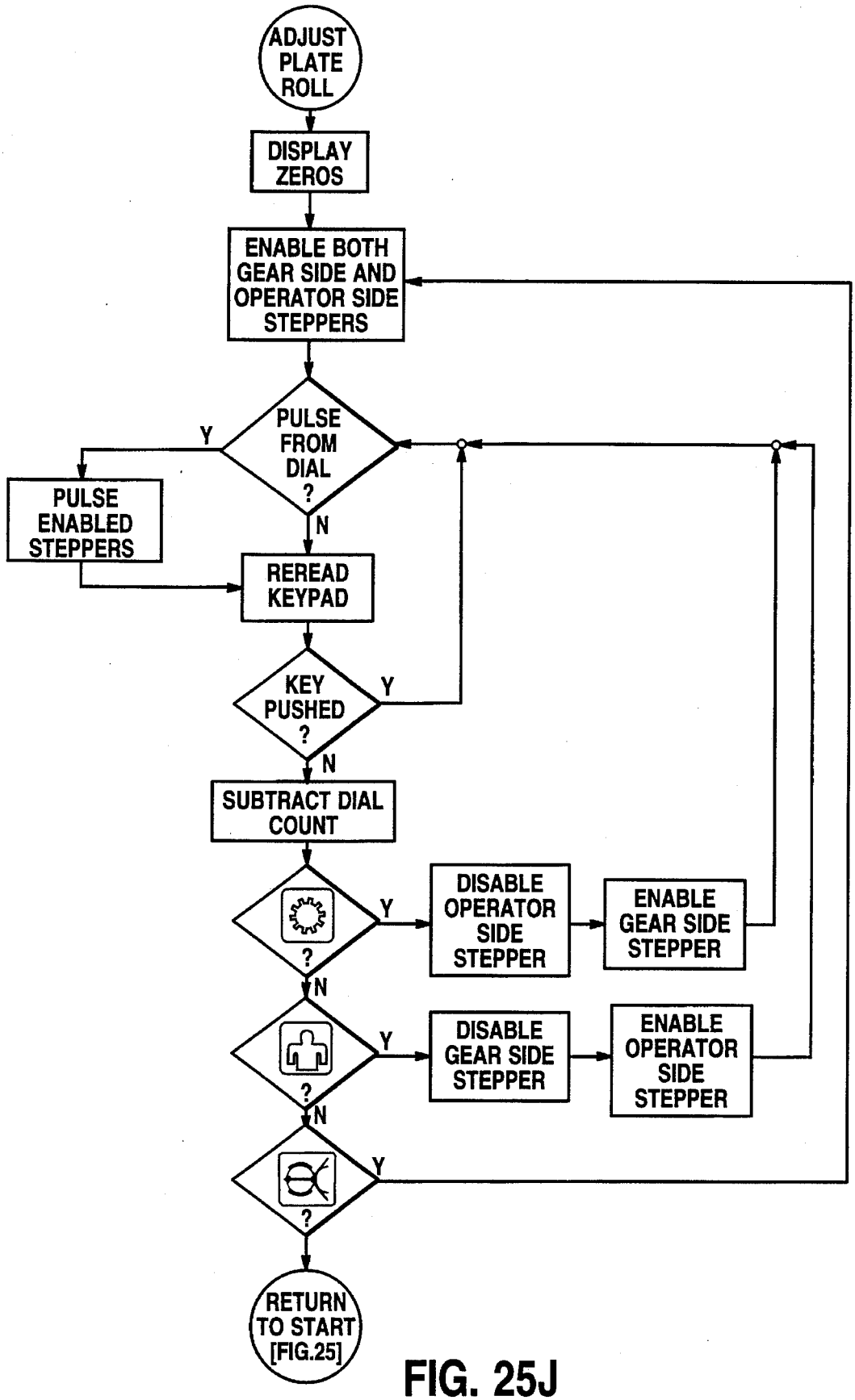
FIG. 25J is a flowchart of the ADJUST PRINT HEAD routine of the flowchart of FIG. 25.

Adjustment of the print roller 61 changes its zero position relative to its commanded position by a positive or negative numerical offset. Such adjustment is carried out by pressing the PLATE ROLL ADJUST button 410*d*, which causes the microprocessor to execute the PLATE ROLL ADJUST routine as illustrated in FIG. 25J. This adjustment may be carried out in any position of the print mechanism 60, but is usually carried out in the print position with the print head 60 printing on the web 11, and the operator monitoring the quality of the printed product. When the adjustment is selected, zeros are displayed on the displays 412*a* and 412*b*. If the operator then turns the dial 414, both stepper motors 191*a* and 191*b* are moved the same amount. As the motors 191 are moved, the displays 412*a* and 412*b* are incremented or decremented in accordance with the pulses received from the encoders 192*a* and 192*b*, respectively. These changes are immediate, and the operator can immediately observe the effect on the printed product if printing is in progress. If at any time during this process, the operator presses either of the GEAR SIDE or OPERATOR SIDE buttons 410*a* or 410*b*, from that point on turning the dial 414 affects only the stepper motor 191*a* or 191*b* on the selected side of the web 11. In this way, the operator can compensate for non-uniformity or non-parallelism of the print roller 61 to the impression roller 66. If one side only has been selected, pressing the button for the other side switches the adjustment to the other side. Pressing the PLATE ROLL ADJUST button 410*d* again returns the adjustment to both sides equally. Pulses from the dial 414 directly pulse the respective stepper motor 191. The adjustment values are stored in the volatile memory 442 and displayed on the displays 412*a* and 412*b* for each respective side. These adjustment values can be changed or cleared by the operator at will by immediately stepping the motors 191 back to their zeroed positions. The routine stays in the plate roller adjustment loop until another button is pushed selecting another function.

Figure 25K:
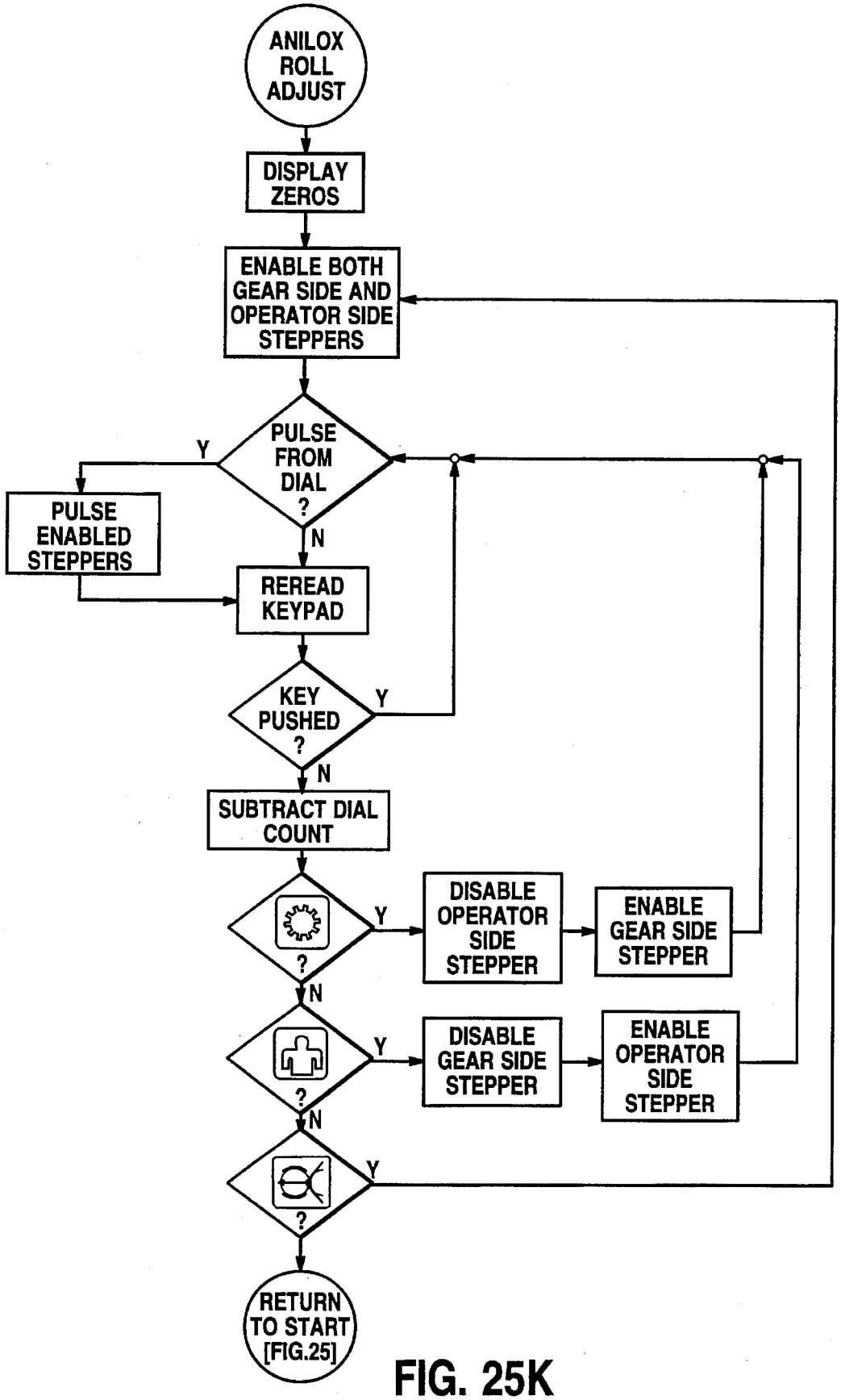
FIG. 25K is a flowchart of the ADJUST ANILOX ROLL routine of the flowchart of FIG. 25.

Adjustment by the operator of the anilox roller 63 in relation to the print roller 61 proceeds similarly by depression of the ANILOX ROLL ADJUST button 410*c*, as illustrated in FIG. 25K, the difference being that the stepper motors 171*a* and/or 171*b* are adjusted and the feedback verifying the motion is received from the encoders 172*a* and/or 172*b*, respectively.

Other functions are also provided, such as the CONFIRM button 410*n*, which initiates a cancellation of the pending adjustment and returns to the ADJUST PRINT ROLL routine, the CLEAR button 410*o*, which clears all button functions and the display, and the METERING ROLLER MOVE button 410*p* which causes the cylinders 151 to throw in or out the metering roller 64, to start or stop ink flow to the anilox roller 63.

Computer Controlled Registration

Computer controlled registration, including the semi-automatic preregistration feature and the more fully automatic circumferential and axial registration features, is supervised by the operator either from the individual stations or from the host computer. These are explained here in connection with the registration controller 407 at the individual stations 13. From the host computer 400, the operation can be controlled globally or individually for selected stations.

Figure 26:
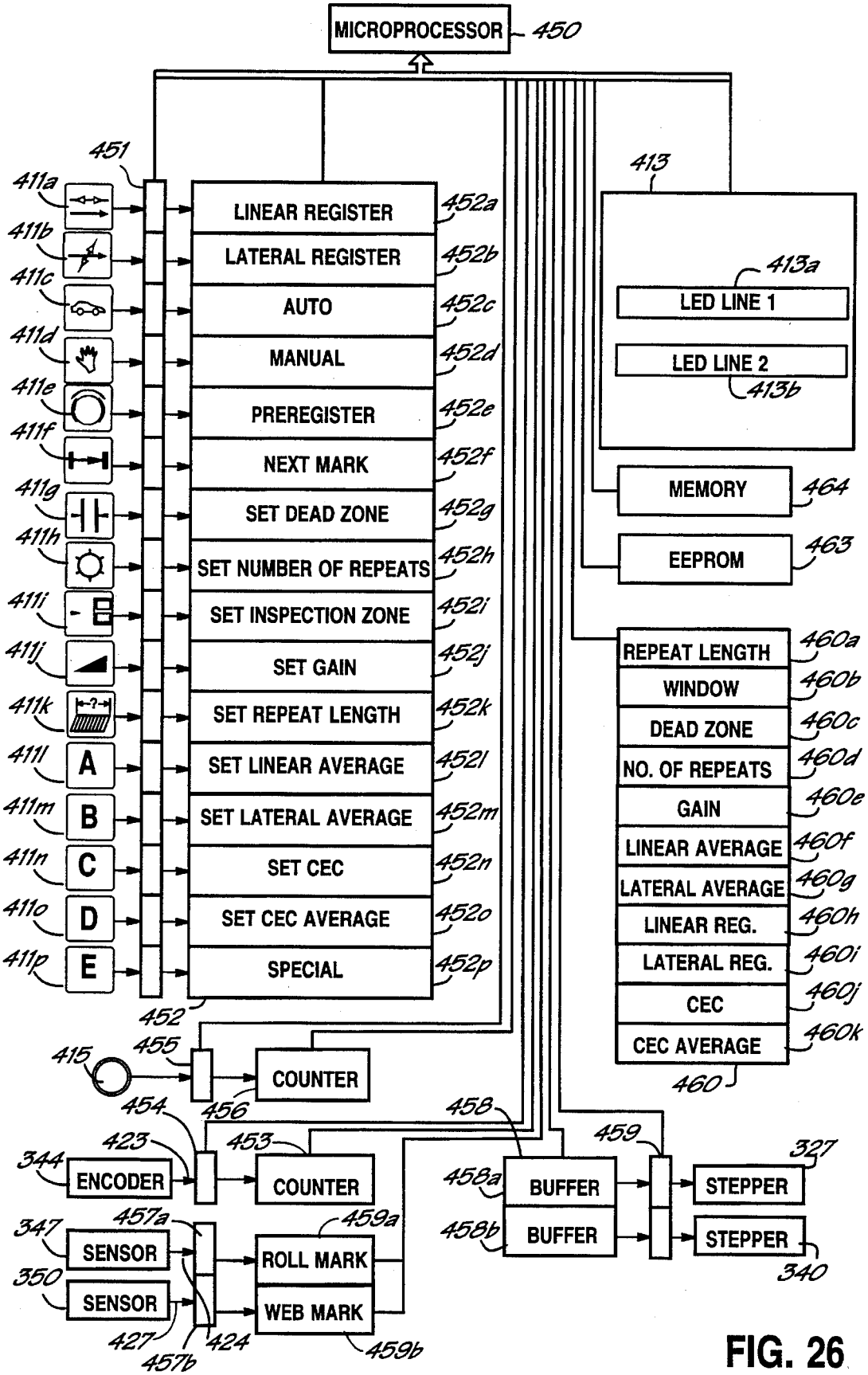
FIG. 26 is a block diagram of a preferred embodiment of the registration controller of computer control system of FIG. 23.
Figure 27:
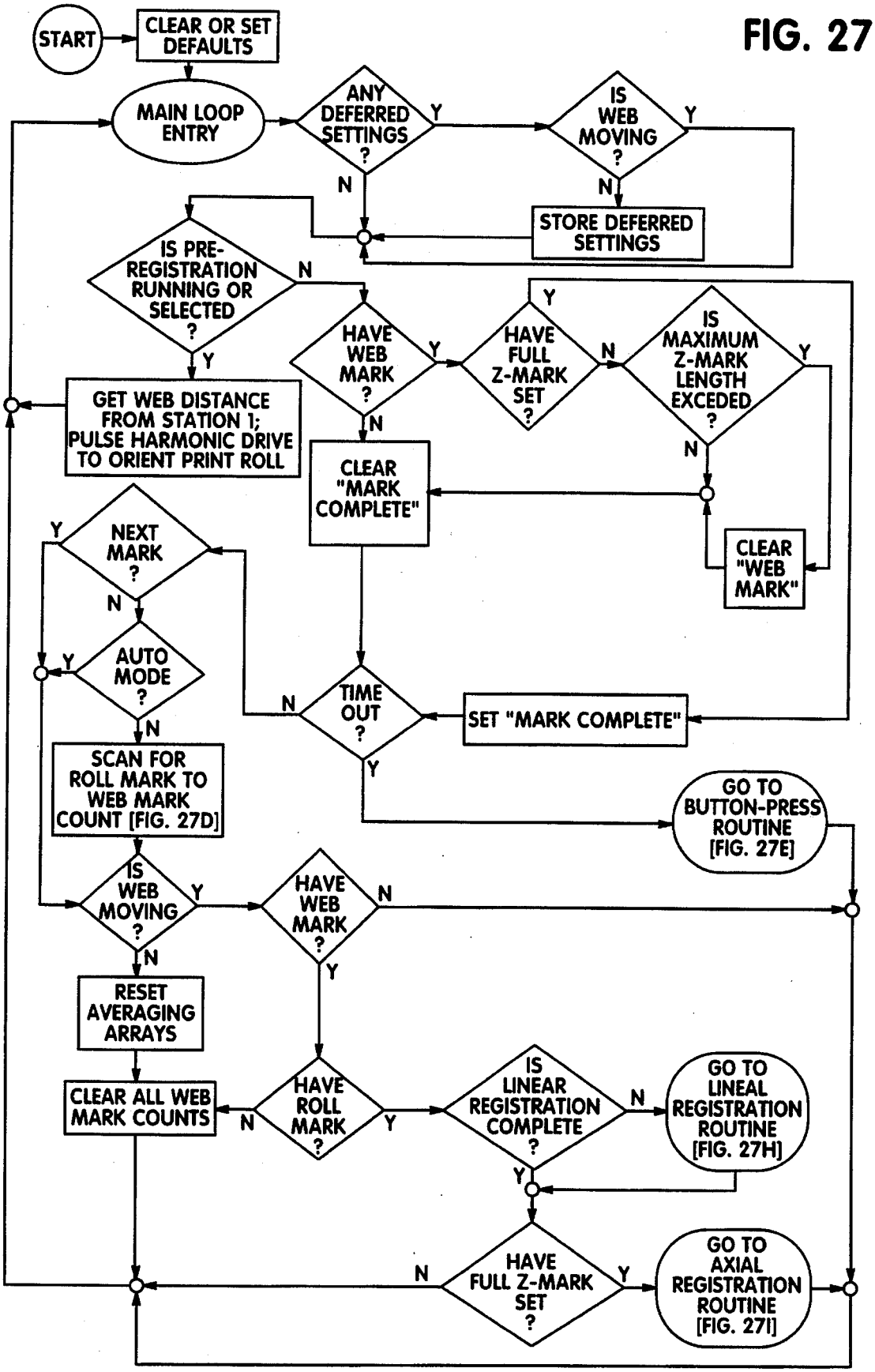
FIG. 27 is a flow chart schematically representing the MAIN LOOP of the operation of the registration controller of FIG. 26.

The block diagram of FIG. 26 and flowchart of FIG. 27 symbolically represent the operation of the registration features and the logic of the registration controller 407. The controller 407 is made of the same types of components, has the same general architecture, and functions according to similar logic, as the positioning controller 406 described above, with the addition of interrupt driven routines to accommodate simultaneous operator interfacing and high speed registration control. Generally, the processor 409 includes a microprocessor 450 that, in cooperation with a PAL identical to that of the processor 406, interrogates interrupts activated by button activity performed by the operator at the panel 411 and with the dial 415. The microprocessor 450 also interprets pulses from the encoder 328 and electric eye sensors 347 and 350. The microprocessor 450 also performs processing operations to translate the operator input information into appropriate control signals on the lines 424 and 426.

Symbolically illustrated in FIG. 26, buttons 411*a*–411*p* of the control panel 411 may be considered as connecting through an interface 451 to a memory section 452 of the processor 409 which stores a plurality of logical variables 452*a*–452*p*, each representing a state of the pushbuttons 411*a*–411*p*. When any of the variables 452*a*–452*p* is zero, for example, this represents that the corresponding button 411*a*–410*p* is not pushed. When any of the variables 452*a*–452*p* equals one, this represents that the corresponding button 411*a*–411*p* is pushed. The default settings of the variables 432*a*–432*p* are zero.

The processor 409 also includes a section of memory 453 that operates as a counter, representing a count of pulses received over the line 423 from encoder 344. The input lines 423 is connected through an interface 454, for example an RS 485 chip, that functions in cooperation with the microprocessor 450 to count two channel direction sensitive pulses received over the input line 423 from the encoder. The counter 453 either increments or decrements the count stored therein in accordance with the direction of the rotation of the encoder 344. The pulses on the encoder 344 is generated for each 1/5000th of encoder rotation, which will correspond to a fixed increment of angular motion of the impression roller 66, which is directly related to a fixed increment of lineal motion of the web 11. As with the encoders 172 and 192 for the positioning controller 406, these pulses are generated on each of two channels, and are 90° out of phase. As such, the discrimination of the encoder 344 is 1/20,000th of a rotation of its shaft. The encoders 344 are thus direction responsive. The counter 453 will reflect the cumulative algebraic sum of the pulses counted from encoder 344. One encoder 344 is coupled onto the shaft of the continuously rotating impression roller 66. The count from the encoder 344 starts over at a count of zero when the counter 453 exceeds its maximum.

The dial 415 also connects through an interface 455 to a memory location 456. The dial 415 clicks every fraction of a rotation in either direction to produce a series of direction sensitive pulses sequentially to the interface 455 to increment or decrement, for clockwise or counterclockwise rotation respectively, the current integer value of the variable in memory location 456. The memory location 456 will thereby reflect the cumulative algebraic sum of the pulses counted from the dial 415 since the last resetting or clearing of the variable stored therein. In addition, each pulse from the dial 415, through the interface 455 and to the counter 456 trip an interrupt in the microprocessor 450.

The sensors 347 and 350 connect through an interfaces 457*a* and 457*b* respectively to the microprocessor 450, and to corresponding memory locations 459*a* and 459*b* that store a logical 1 when the respective sensors 347*a* and 350 sense the respective marks 349 on the print roller 61 and 350*a* on the web 11. Activation of each of the sensors 347 and 350 also trips a respective interrupt in the microprocessor 450.

An additional memory section 458 stores output integer variables that represent the number of pulses to be sent to the stepper motors 327 and 340 to perform circumferential and axial registration, respectively. Corresponding variables 458*a*–458*b* are stored in the memory section 458 and, when output signals are to be generated on the lines 419 through drivers 439, under control of the microprocessor 430, the preset counts of each of the memory variables is increased or decreased to zero at equal intervals spaced over a single repeat length of the web 11 in the form of, forward and reverse pulses, respectively, to the corresponding stepper motor 327 or 340.

As with the controller 408, in one embodiment, the counters 453, 456 and 458 are separate from the memory within the microprocessor 450, for example, within a field programmable gate array (FPGA) such as manufactured by Xilinx, which may be programmed to contain the counters 453, 456 and 458, for example. Such counters will respond to interrupts from the encoders without requiring interruption of the microprocessor 450, which can then interrogate the counters at its convenience.

Further memory 460 is provided to store settings such as REPEAT LENGTH 460*a*, INSPECTION ZONE or WINDOW 460*b*, DEAD ZONE TOLERANCE 460*c*, NUMBER OF REPEATS per print roller rotation 460*d*, GAIN 460*e*, LINEAL ERROR AVERAGING 460*f* and AXIAL ERROR AVERAGING 460*g*. The memory 452,453,456,458,460, 463,464 may be connected to the microprocessor 450, as are the interfaces and drivers, through computer busses 461, or may be included in the volatile memory of the chip containing the microprocessor 450, as will be the configuration when using a Motorola MC68HC711E9 microprocessor, as is preferred. However, certain variables represented as stored in the memory 460 are preferably written to non-volatile memory when the press 10 is stopped, to be available after the press is started after being shut down. The display 413, also connected to the microprocessor 450, is provided with two LED display lines 413*a* and 413*b*, which output to the operator alphanumeric characters indicative of the operations and settings selected by the operator. The program and preprogrammed variables and settings are stored in a read only memory 463.

The program executed by the registration control microprocessor 450 differs somewhat from that of the positioning control microprocessor 410 because it must not only process setting changes and monitoring functions that interface with the operator through the keyboard 411 and display 413, but must simultaneously control registration when automatic registration is selected and when the press is running. This is accomplished utilizing interrupts to initiate routines that insure that keyboard entries and setting changes made by the operator and that roll and web mark readings are made, while other portions of the program of the microprocessor 450 are being executed. The program that accomplishes this objective is generally represented by the MAIN LOOP program illustrated in FIG. 27 and in the interrupt handling routines illustrated in FIGS. 27A–27C.

The MAIN LOOP program of FIG. 27 is initiated at the START point when the microprocessor 450 is powered up. It first executes a start-up routine in which registers are cleared and default values and flags are set, and in which the programmable gate array logic chips that interface with the keyboard and display components and with stepper motors and encoders of the registration system are downloaded with the programs that essentially configure them as set forth in FIG. 26, described above.

After initiation, the program executes a loop from the MAIN LOOP ENTRY point of FIG. 27. The loop first checks to see if any operator settings or setting changes have been made. If so, they would have been stored in volatile memory 464, to be recorded in non-volatile memory 460 when the press is not running. The program therefore checks for wed motion and stores any settings made to non-volatile memory 460. Then, the loop interrogates memory 464 to see if a ROLL MARK count and a WEB MARK count have been read. Further, if a WEB MARK has been encountered, the program also checks to determine if the WEB MARK counts include three crossings of the Z-mark 350*a* of FIG. 21. The MAIN LOOP then checks to see if preregistration is in effect, and if so, provided the press is not running, performs the preregistration of the respective station. This is accomplished by retrieving from memory the web distance from the first station to the current station, dividing the distance by the repeat length or print roll circumference, and advancing the print roll relative to a reference orientation, which equals that of the first station, by pulsing the stepper motor 327 to the harmonic drive 275 in accordance with the arithmetic remainder of the division operation.

The MAIN LOOP also checks to see if the manual setting of the lineal registration has been selected by a pressing of the NEXT MARK button with linear registration selected but automatic linear registration turned off. If so, interrupts are suspended while the roll and web mark spacing is determined and used to set the LINEAL REG. variable, which is the automatic lineal registration set point for the station. The routine for setting this, which is initiated by a pressing of the NEXT MARK button 411*f* by the operator, is illustrated in the flowchart of FIG. 27D.

Figure 27A:
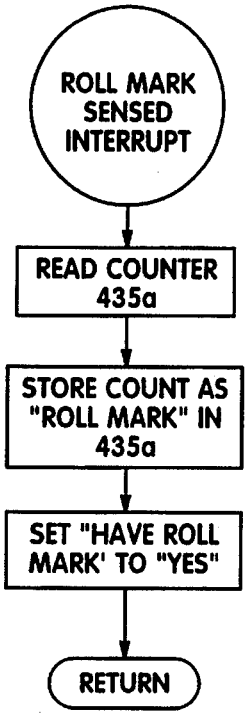
FIG. 27A is a flowchart of the interrupt servicing routine of the controller of FIG. 26 responsive to the sensing of the print roll mark.
Figure 27B:
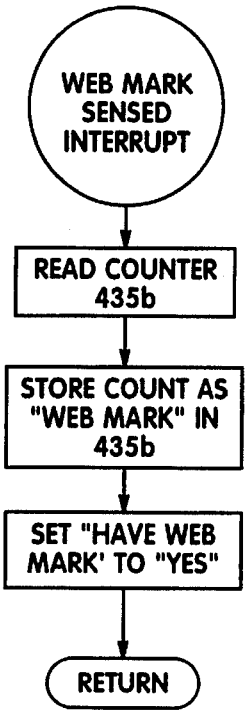
FIG. 27B is a flowchart of the interrupt servicing routine of the controller of FIG. 26 responsive to the sensing of the web mark.
Figure 27C:
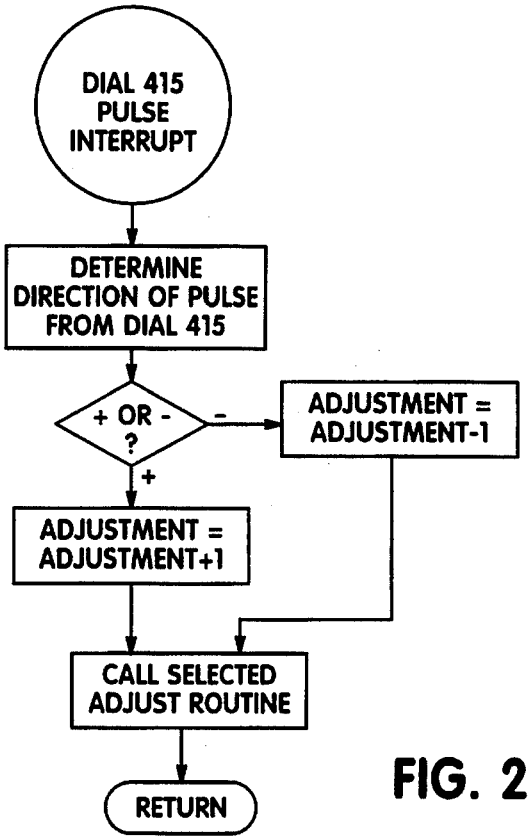
FIG. 27C is a flowchart of the interrupt servicing routine of the controller of FIG. 26 responsive to pulses from the operator adjustment dial.
Figure 27D:
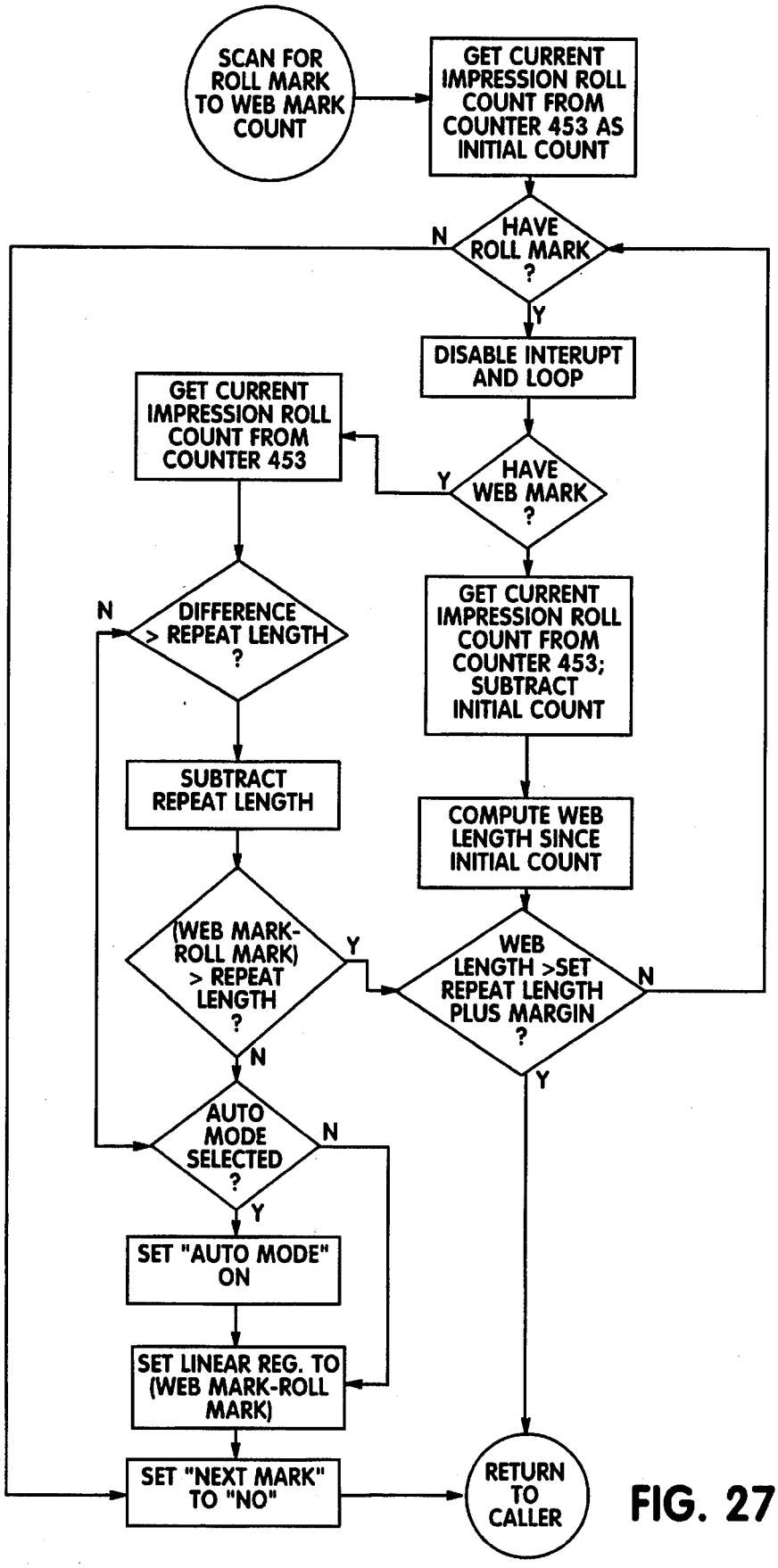
FIG. 27D is a flowchart of the registration setting routine initiated by the selection of the NEXT MARK button by the operator when called by the MAIN LOOP of FIG. 27.

If both the ROLL MARK and WEB MARK counts have been determined, the MAIN LOOP calls the LINEAL REGISTRATION subroutine of FIG. 27H, which implements the actual performance of automatic lineal registration, as explained more fully below. Then, if full Z-mark data has been read, the MAIN LOOP also calls the LATERAL REGISTRATION subroutine of FIG. 27I, which implements the actual performance of the axial registration, as is also explained more fully below. The MAIN LOOP then returns to the MAIN LOOP ENTRY point and executes again unless interrupted by the interrupt routines of FIGS. 27A–27C, or by the clock interrupt, which causes execution of the BUTTON-PRESS ROUTINE of FIG. 27E. The button press routine of FIG. 27E sends information to the display 413 in accordance with the routine that is currently selected, as illustrated in the flowchart of FIG. 27F, and retrieves button press and setting adjustment data from the keyboard 411 and dial 415. The routine also interprets the button presses or combinations thereof to select the various operations, as illustrated in the flowchart of FIG. 27G.

The BUTTON-PRESS ROUTINE determines whether a button has been pushed on the panel 411, and identifies the button or button combination. The program may be set up to allow only a single button to be pushed at a time. Thus, the program will only identify one button at a time, and the pressing of any one of the buttons may be set to turn off any other button that might have been pressed and not otherwise cleared. In such an embodiment, multiple button commands would be selected by sequentially pushing a combination of buttons on the panel 411.

Alternatively, in the preferred and illustrated embodiment, the program is structured such that multiple button commands are selected by pressing more than one button simultaneously. In such a case, the release of a button will cause the button to be regarded as pushed and will reset all other button presses recorded in memory. If, upon the release of a button, another button is still pressed, release of the last of the simultaneously pressed buttons sets the other previously released simultaneously pressed buttons in memory 452. The program will then check all of the button combinations and compare the combinations with all valid combinations, ignoring all others, as the flowchart of FIG. 27G illustrates.

Figure 27E:
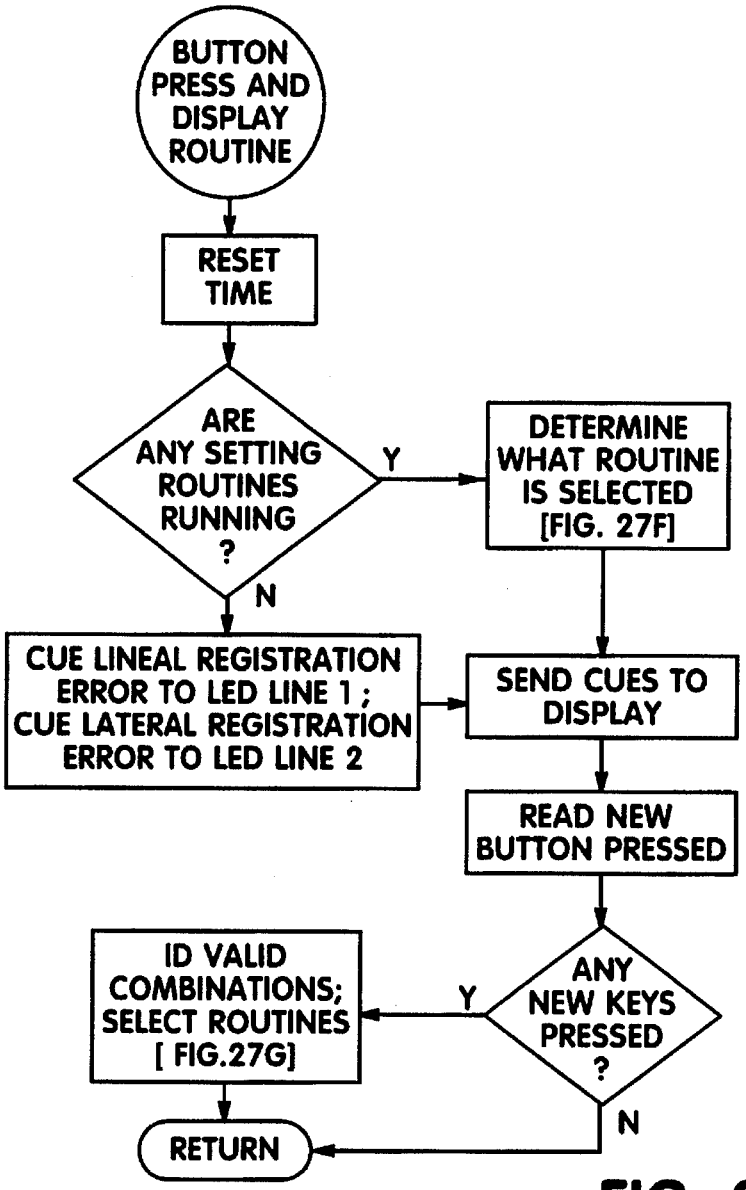
FIG. 27E is a flowchart of the button press routine for cuing information to the operator display and interpreting button press commands from the operator when called by the MAIN LOOP of FIG. 27.
Figure 27Q:
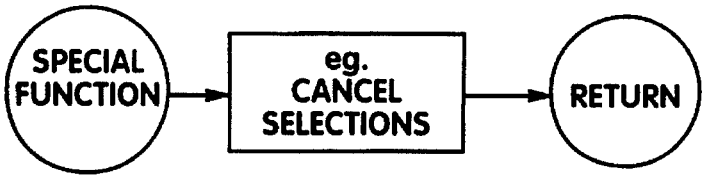
FIG. 27Q is a flowchart of the SPECIAL function subroutine called by the routine of FIG. 27G.
Figure 27F:
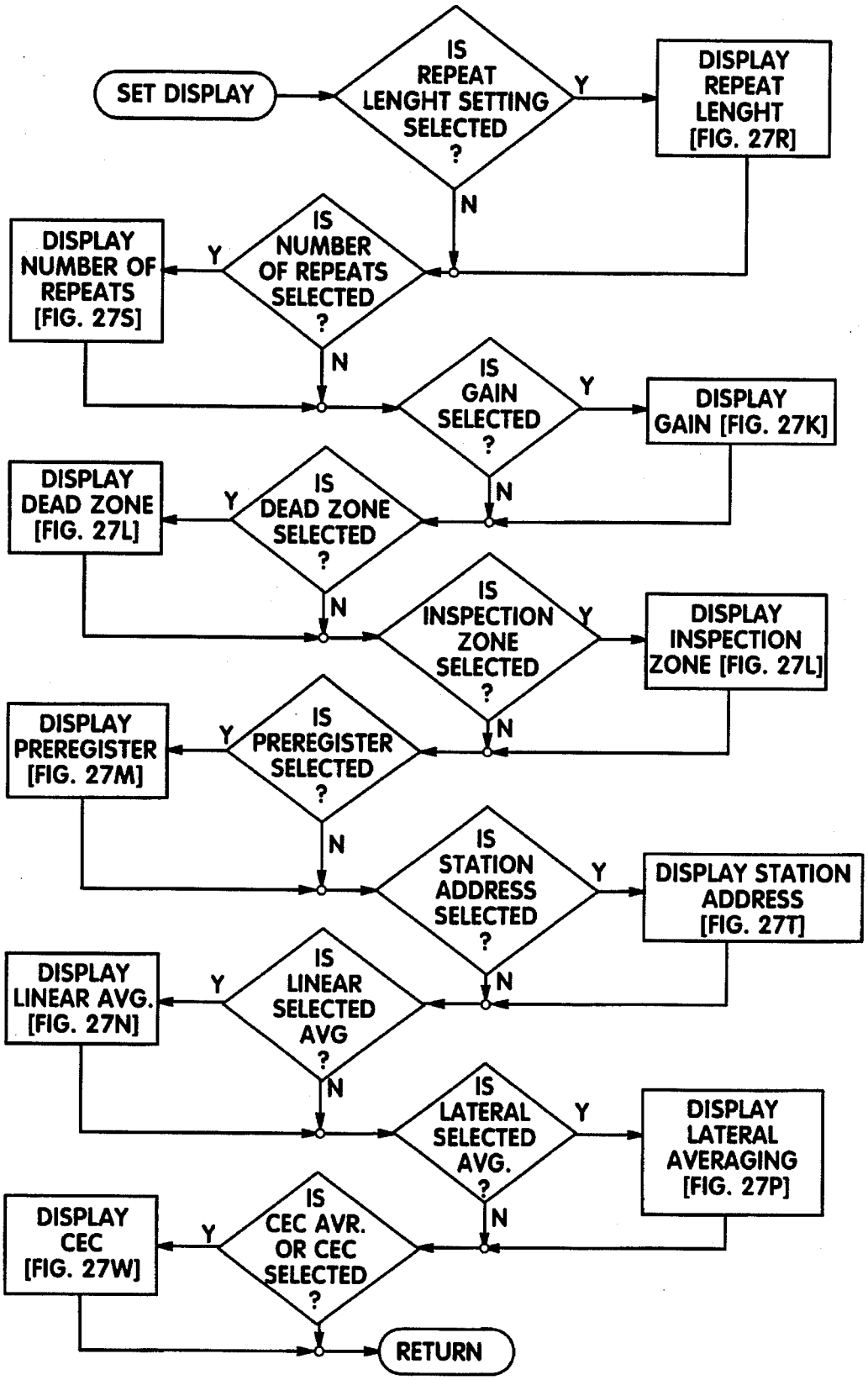
FIG. 27F is a flowchart of the display setting routine for selecting the display subroutine corresponding to the operation selected by the operator when called by the routine of FIG. 27E.
Figure 27G:
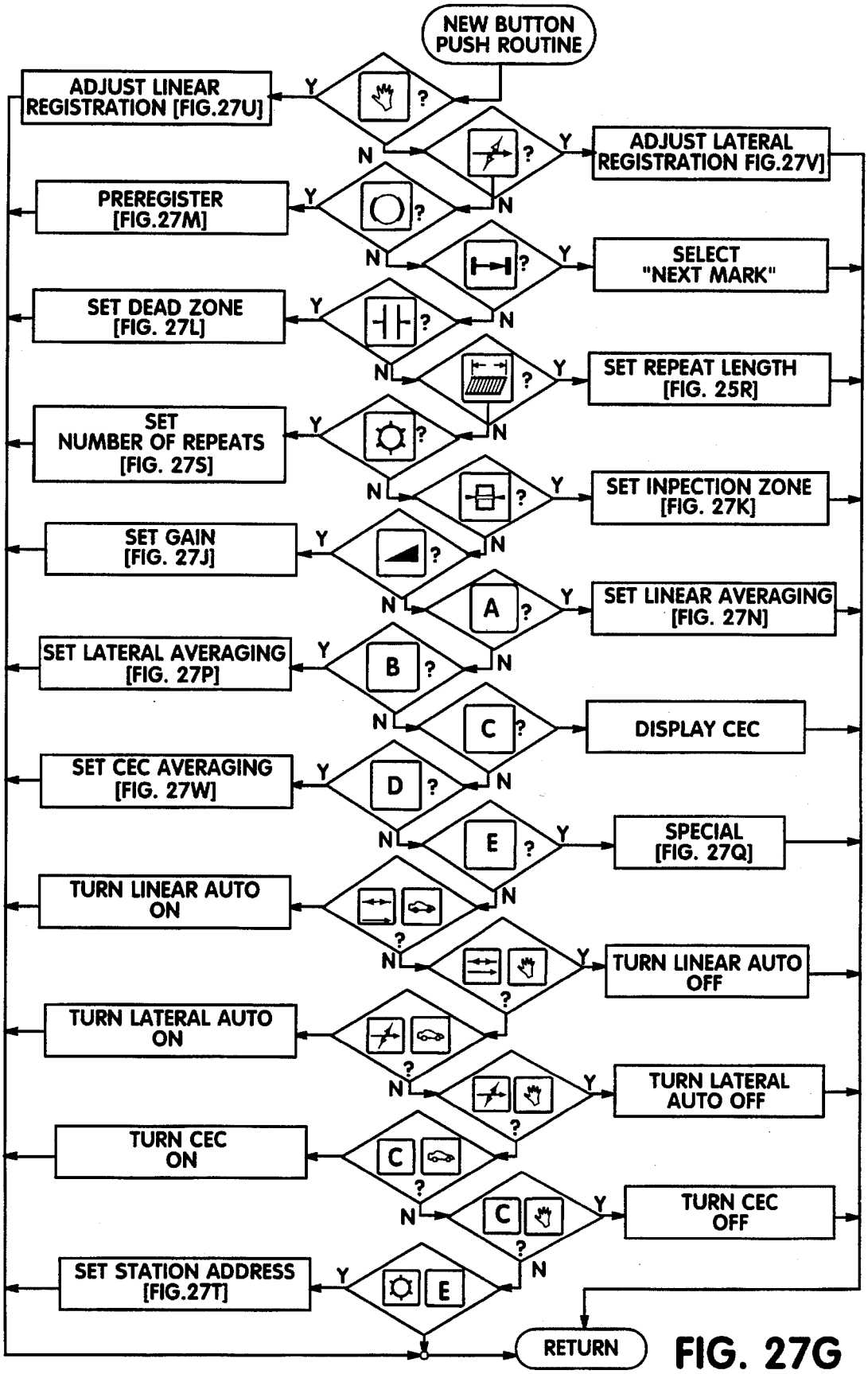
FIG. 27G is a flowchart of the button press interpretation routine for determining the operation selected by the operator when called by the routine of FIG. 27E.

The calling of the BUTTON-PRESS routine of FIG. 27E occurs at predetermined intervals of, for example, 1/50th of a second. During other times, the MAIN LOOP is executing and may be calling the automatic registration routines. Particularly, when the press 10 is running, the AUTO registration routines by which the program controls the registration of the press 10 are executed continuously. Accordingly, each of the routines that may be initiated by the button presses referred to in the flow chart of FIG. 27G will be interrupted every 1/50th of a second to test for another button press.

Preregistration

Following the setup of the printing mechanism 60 of the press 10 for a print job, as described in connection with the positioning control above, the operator will preregister the print roller 61 to the anticipated position of the web 11 for each of the stations 13. The preregistration is based on knowledge of the geometry of the machine 10, including the relative locations of the print stations 13 with respect to each other and to a length of web 11 extending through them. For example, with the first station registered at some arbitrary zero orientation, from the geometry of the overall press 10, the length of web 11 that extends from the nip of the print roll at the first station to that of each respective station may be predetermined and stored, preferably in non-volatile memory 264. This length is divided by the repeat length, or circumference, of the print roll 61 to produce a quotient, which is irrelevant, and a remainder, which represents the circumferential adjustment, and is the number of pulses to be sent to the harmonic drive 275 to preregister the print roll 61 of the respective station 13 with that of the first station 13*a*.

The preregistration is usually carried out without a web 11 in the machine 10. In preregistration, the print rollers 61 of each of the stations 13 to be used are rotated to predetermined orientations relative to their frames 36, by stepping the respective harmonic drives 275 a calculated number of pulses past the detection of a print roller mark 349 by the sensor 347.

Figure 27H:
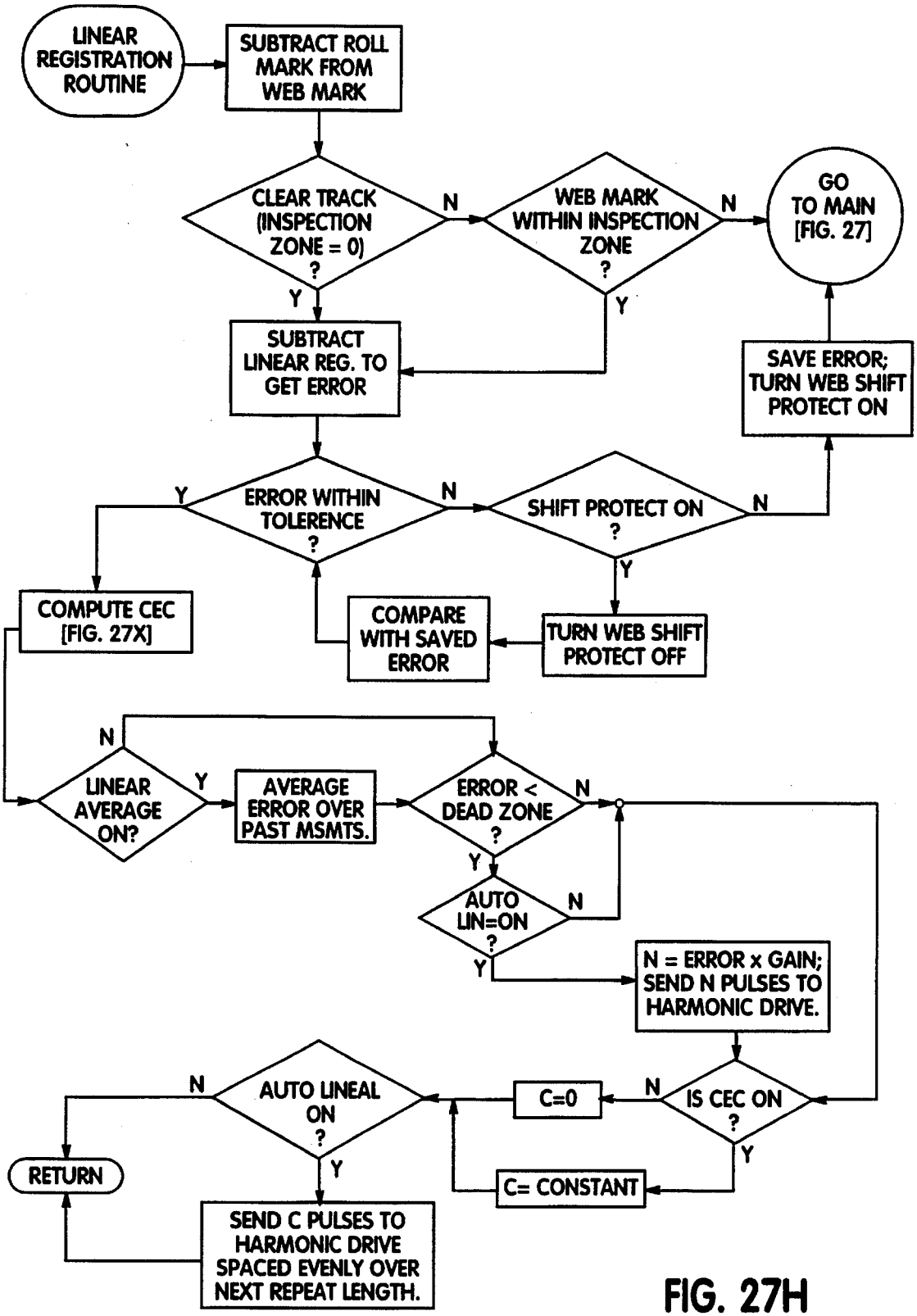
FIG. 27H is a flowchart of linear registration routine for determining and controlling the circumferential registration of the press when called by the MAIN LOOP of FIG. 27.
Figure 27J:
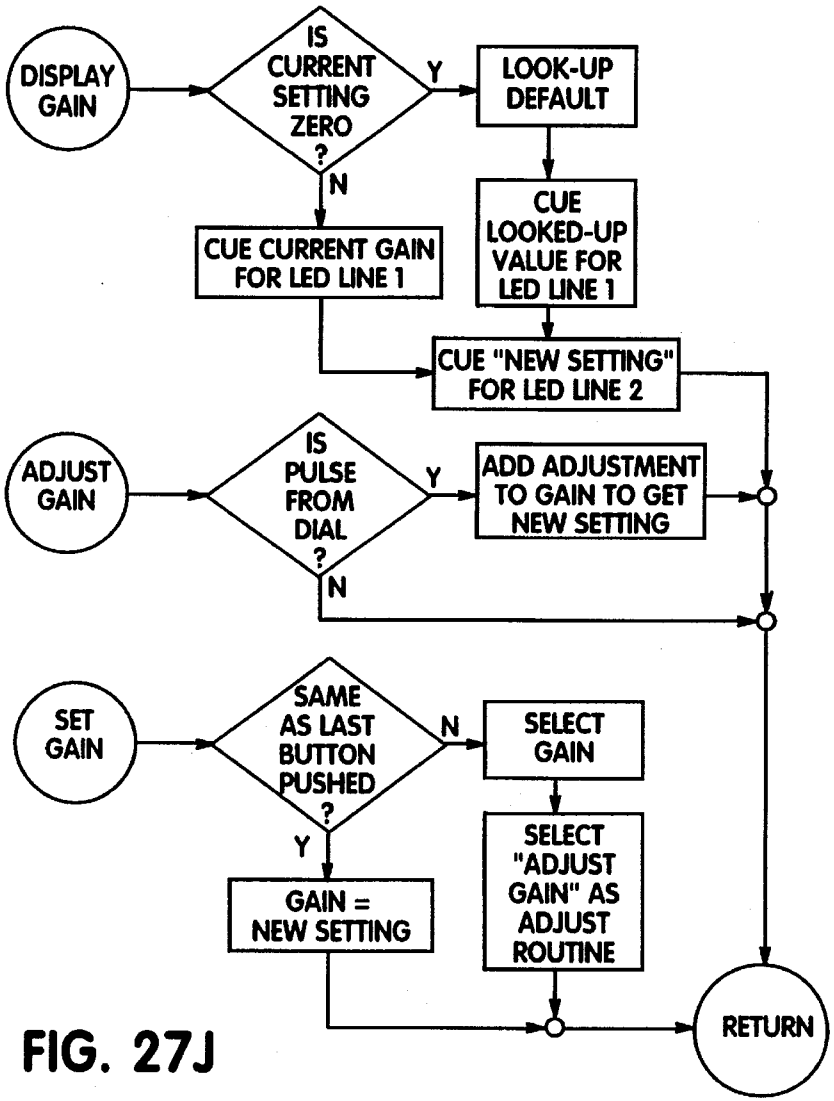
FIG. 27J is a flowchart of the GAIN displaying, adjusting and setting subroutines called by the routines of FIGS. 27C, 27F and 27G.
Figure 27I:
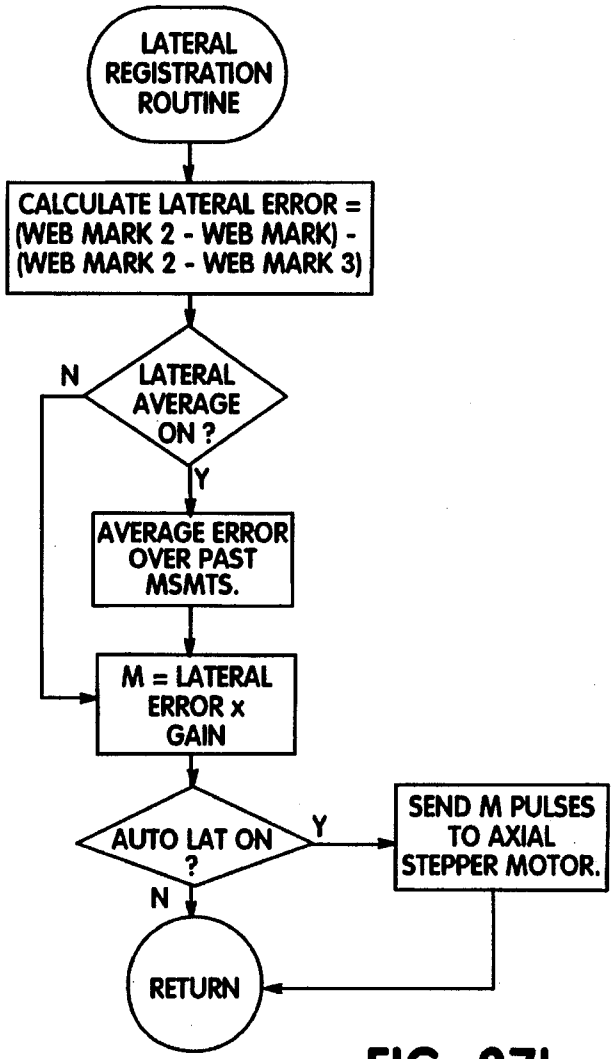
FIG. 27I is a flowchart of lateral registration routine for determining and controlling the axial registration of the press when called by the MAIN LOOP of FIG. 27.

To select circumferential preregistration, the operator presses the preregistration button 411*e*. As this function is usually desired when the press 10 is not running, the MAIN LOOP will generally be idling waiting for an event, which will usually be the time-out of the 1/50th second timer that causes the execution of the BUTTON-PRESS ROUTINE of FIG. 27E. In this routine, when preregistration is desired, typically no other setting routines will have been previously called, which will, by default, bypass the subroutine of FIG. 27F and cue the registration errors, which will probably be zeros, to the displays 413. The microprocessor 450 will then call the subroutine of FIG. 27G to scan the valid combinations of buttons 411 for a match and return the button or valid button combination that is pressed. The program in the microprocessor 450, as illustrated in FIG. 27, responds to the press of the preregistration selection button 411*e* by causing execution of the SET PREREGISTRATION routine of FIG. 27M, entering at the SELECT PREREGISTRATION entry point, to select the preregistration function. With the preregistration function selected, when the MAIN program tests for this selection, PREREGISTRATION is automatically executed to circumferentially preregister the rollers 61 by rotating the print roller 61 to the programmed relative orientation for the respective station. When preregistration is complete, the preregistration function is automatically deselected.

When preregistration is executed, the repeat length used in the determination of the respective station preregistration setting is that last stored in memory. Often, after set-up of the press and before preregistration is carried out, a new REPEAT LENGTH may have been set in the manner described in connection with the discussion of circumferential registration below.

Figure 18:
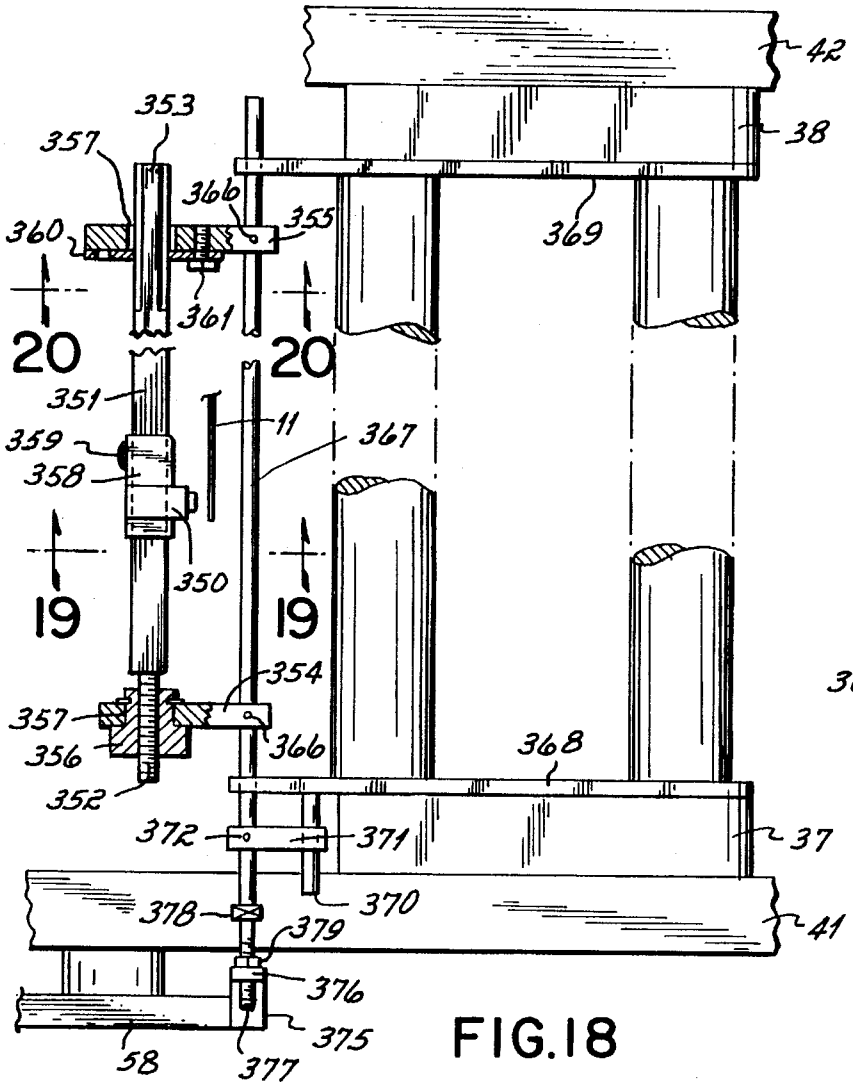
FIG. 18 is a top view taken on line 18—18 of FIG. 2 showing the structure for mounting the web mark sensor.
Figure 22:
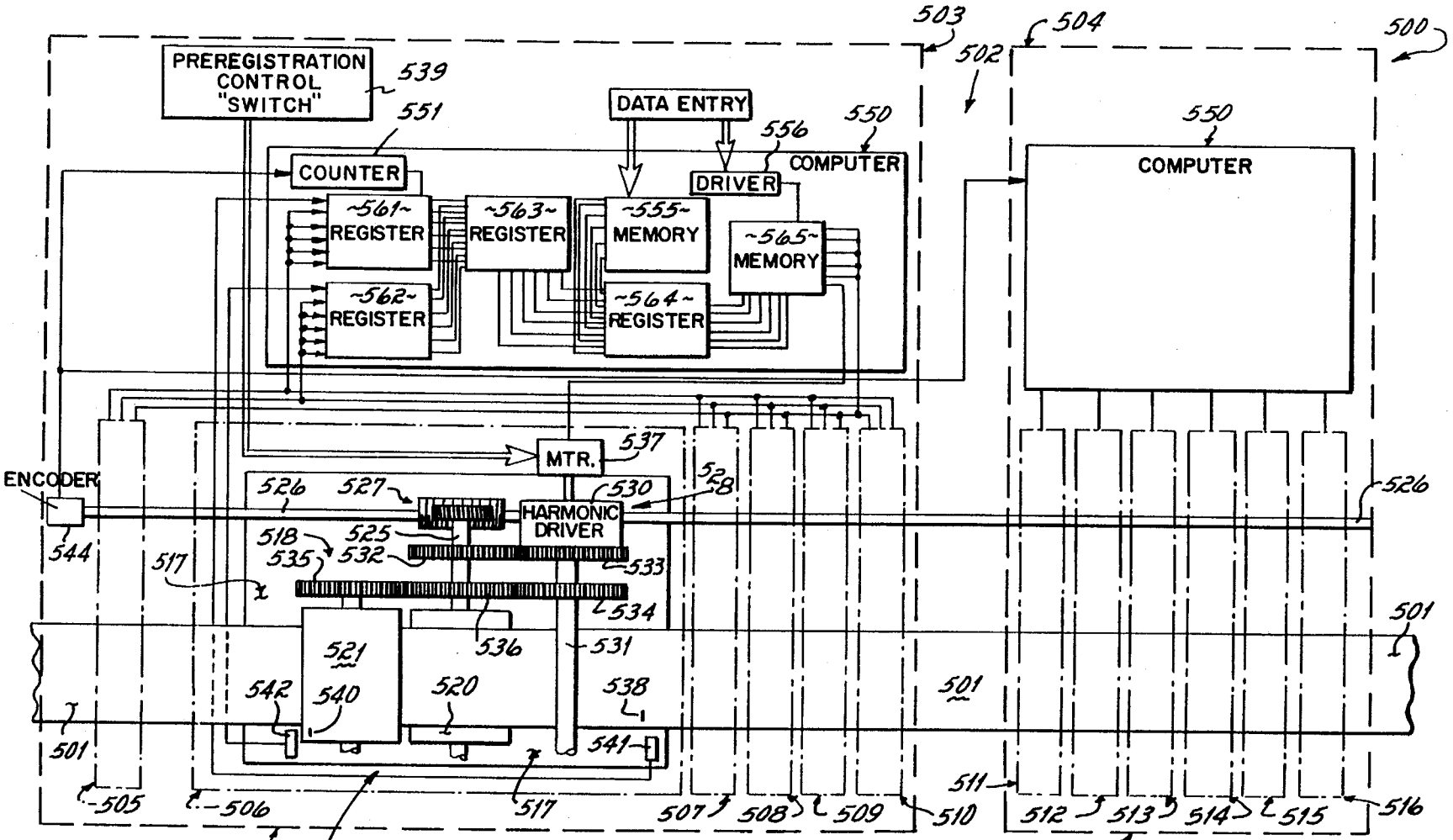
FIG. 22 is a block diagram of a prior circumferential registration control system of applicants' assignee.

Axial preregistration is not usually performed without a web. Rather, a gross adjustment of axial registration is implemented to center the roller transversely. This is accomplished by physically adjusting the transverse position of the sensor 350. In order to insure that the web sensor 350 is optimally centered on the web mark 350*a*, the sensor 350 is moved transversely on its support to align with the center of the mark 350*a*. The movement of sensor 350 may be made manually by adjusting knob 356 (see FIG. 18). Alternatively, automated movement of the sensor 350 on its support may be provided, using stepper motors or alternative devices under control of the microprocessor 350 or otherwise.

Circumferential Registration

Figure 16:
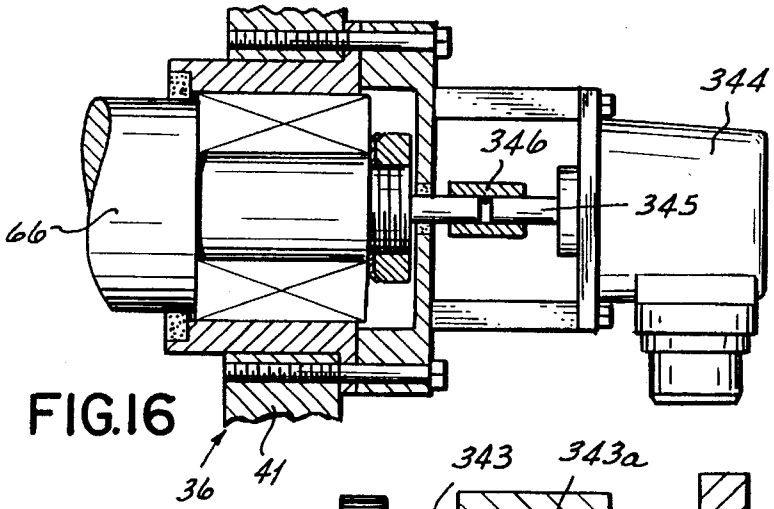
FIG. 16 is a sectional view of the impression roller encoder and the details of the attachment to the roller as seen on line 16—16 of FIG. 2.

As shown in FIG. 16, the front end of the impression roller 66 in each printing station 13 mounts the optical encoder 344, such as that manufactured by BEI Motion Systems Company, Carlsbad, Calif., model H25D. This encoder 344 generates pulses representative of fixed lengths of the web 11. By mounting each roller 66 with its own encoder 344, differences in web speed among stations 13 are less likely to affect the accuracy of circumferential registration control. Particularly, clearances in the gears, torsion of shafts and strain of the various drive train components and relative motion between such components is almost entirely eliminated. The optical encoder 344 has a shaft 345 which is coupled to a stub end at the front of impression roller 66 by a coupling 346 such as that manufactured by Rexnord, Mechanical Power Division, Warren, Pa., Part No. CC37.

The computer controlled circumferential registration system includes first optical sensor 347 (see FIG. 2) mounted to the front of stop plate 58. Sensor 347 has a fiber optic lens 348 mounted below the front end of printing roller 61 and in position to register each revolution of roller 61 by sensing a mark 349 (FIG. 3), in the shape of a transverse bar, formed on the surface of the front end of roller 61. Referring to FIGS. 2, 4, 5 and 18–21, second optical sensor 350 is mounted between vertical support panels 37 and 38 and positioned above the nip between printing roller 61 and impression roller 66 in order to register the passage of web mark 350*a* which was originally printed onto web 11 at the first printing station 13*a*.

The web sensor 350 is mounted on a square suspension bar 351 suspended from the print side of the web 11, above the nip and between the printing roller 61 and impression roller 66. Bar 351 has ends 352, 353 mounted to respective support brackets 354 and 355. End 352 of bar 351 is threadably disposed into an axial positioning knob 356 which is captured, but free to rotate, within a hole formed through one end of bracket 354. The squared cross-section of the other end 353 of bar 351 is beveled along each edge. One end of bracket 355 has a circular hole 357 formed therethrough. An angular adjustment plate 360 is fastened to the front side of bracket 355 with bolt 361. Bolt 361 is disposed through an arcuate semi-circular slot 362 formed in plate 360 and threaded into bracket 355. Plate 360 has a square hole 363 formed therethrough and aligned with circular hole 356. The square cross section of bar 351 is dimensioned to fit through hole 363 and the edges of end 353 are beveled to allow disposition through circular hole 356. The other ends of brackets 354 and 355 are fixed, such as by set screws 366, to a second support bar 367 having a circular cross section. Brackets 354 and 355 are sufficiently spaced transversely apart along bar 367 and suspend square bar 351 a sufficient distance from circular bar 367 to allow the passage of web 11 therewithin. Bar 367 is suspended generally perpendicularly out from the upline edge of vertical support panels 37 and 38 by support brackets 368 and 369. Bracket 368 is mounted to the back side of panel 37, and bracket 369 is mounted to the front side of panel 38. The rear end of bar 367 is disposed through and able to slide within a hole formed on the upline end of bracket 369. The front end of bar 367 is disposed through and free to slide within a hole formed through the upline end of bracket 368. The brackets 354 and 355 are disposed along bar 367 between the brackets 368 and 369. A pin 370 is fixed at one end to the bracket 368 downline from and parallel to bar 367. Pin 370 is slidably received by a hole formed through one end of a bracket 371. The other end of bracket 371 is fixed, such as by a set screw 372, to bar 367. Bracket 371 prevents the rotation of bar 367 about its central longitudinal axis. Bar 351, and therefore the web sensor 350, is thereby maintained in its suspended condition above web 11.

The web sensor 350 mounts a square channel bracket 358 which is mounted to the square bar 351 with a set screw 359. Screw 359 is loosened to allow gross adjustment of the transverse position of web sensor 350 along the length of bar 351. Fine adjustment of the transverse position of the web sensor 350 relative to web 11 can be manually accomplished by turning knob 356, thereby transversely moving bar 351. The angular orientation of the web sensor 350 relative to web 11 can be adjusted by loosening bolt 361 and turning bar 351. As bar 351 rotates, plate 360 likewise rotates and slot 362 moves by bolt 361 until a desired sensor orientation is obtained. Bolt 361 is then tightened to fix the web sensor 350 in place. When images are printed on the reverse or backside of web 11 (see the last printing station 13*n* in FIG. 1), the bar 351 must be repositioned downline from bar 367. This can be accomplished by loosening the set screws 366 and pivoting brackets 354 and 355 about bar 367 to reposition bar 351. The sensor bracket 358 is then removed and replaced to face upline. The relative angular orientation of the web sensor 350 to web 11 can be adjusted again in the same manner as previously described. (Compare solid line to phantom line illustration in FIG. 2).

Before automatic registration is implemented, certain parameters are set unless the default settings are desired. The setting of the parameters for registration is accomplished, from the operator's point of view, in the same manner that settings are made in the positioning procedures described above. The settings are initiated by the operator pressing a button on the panel 411 to select the setting to be made. When the controller 407 is energized, all values are defaulted to zero or to some standard default values programmed into the non-volatile memory 463, which is preferably an electrically erasable programmable read only memory (EEPROM), and thus reprogrammable by service personnel but read only to the operator.

To make settings affecting the operation of automatic registration, the operator may, for example, press the SET DEAD ZONE button 411*g*. The DEAD ZONE is a variable that defines the registration tolerance for both circumferential and axial registration. While the described embodiment provides for the same setting applicable to both circumferential and axial registration, separate settings may be provided for. As shown in the flowchart of FIG. 27G, when the SET DEAD ZONE button is pressed, the PAL interface 451 memory variable 452*g*, is set to a 1. From this variable setting, the program identifies the button as pressed after interrogation of PAL memory 452 by the subroutine of FIG. 27G when last called by the button press routine of FIG. 27E. This initializes the SET DEAD ZONE routine, which is illustrated in FIG. 27L.

Figure 27L:
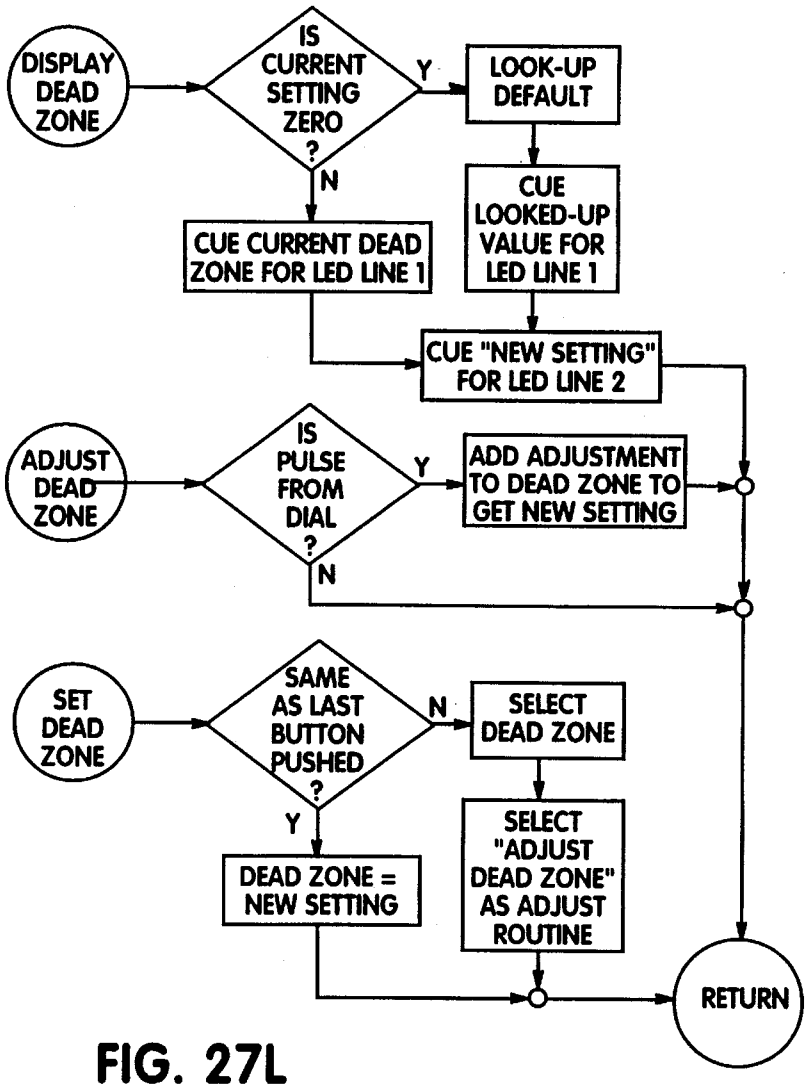
FIG. 27L is a flowchart of the DEAD ZONE displaying, adjusting and setting subroutines called by the routines of FIGS. 27C, 27F and 27G.

As illustrated in FIG. 27L, when the SET DEAD ZONE button is identified, the SET DEAD ZONE entry point of the routine is entered to check to determine whether the pressing of this button is the second of two consecutive presses of the SET DEAD ZONE button. Upon the first press of the button 411*g*, the dead zone setting function is selected, and the ADJUST DEAD ZONE entry point is selected as the adjustment subroutine to be called by the DIAL PULSE INTERRUPT handling routine of FIG. 27C. The BUTTON-PRESS routine then returns to its calling point in the main program to process any registration control operations that are running. Then, on the next 1/50th second time-out, the BUTTON-PRESS routine will call the display subroutine of FIG. 27F, which will note that SET DEAD ZONE has been selected, and will cue the current DEAD ZONE value for line 1 of the LED, 413*a*, and will cue the NEW SETTING, which will default to the current value, into line 2 of the LED, 413*b*.

The DEAD ZONE value represents the integral number of stepper motor pulses by which the dead zone size is defined, and is equal to 1/20,000ths times the impression roller circumference. Where, for example, the circumference equals 16.5 inches, each pulse represents 0.825 mils (i.e., 0.000825 inches or 0.00210 centimeters). The dead zone setting is the minimum error, in pulses, required to cause a correction to be made. Smaller errors are ignored. Alternatively, the DEAD ZONE values may be displayed and incremented by some value representative of a length in inches or centimeters of the web, as described in connection with the REPEAT LENGTH and INSPECTION ZONE settings below.

To change the setting from the initial value, the operator turns the dial 415, which causes pulses to be generated. These pulses trigger the intervention of the interrupt handling routine of FIG. 27C, which detects the direction of the dial rotation and increments a count, initially at zero, up or down in accordance with the rotational direction of the dial 415. The interrupt routine then calls the ADJUST DEAD ZONE routine of FIG. 27L, which adds the adjustment value to the previous setting to define the value of a NEW SETTING.

Upon the next 1/50th second time-out, the display 413*b* is updated with the value of the NEW SETTING, which has been incremented upward or downward by one digit for each click of the dial, corresponding to a respective increase or decrease of one pulse in the DEAD ZONE value over the current setting displayed in the display 413*a*. When the proper DEAD ZONE has been selected, the operator presses the button 411*g* again. This second button press is detected, at the next 1/50th second time-out, in the same manner as the first. The second consecutive press of the button 411*g* is detected by the SET DEAD ZONE subroutine of FIG. 27L, to cause the NEW SETTING to replace the previously current setting of the DEAD ZONE in the volatile memory 464. When the press next stops, this value will be written to variable 460*c* in non-volatile memory.

Figure 27K:
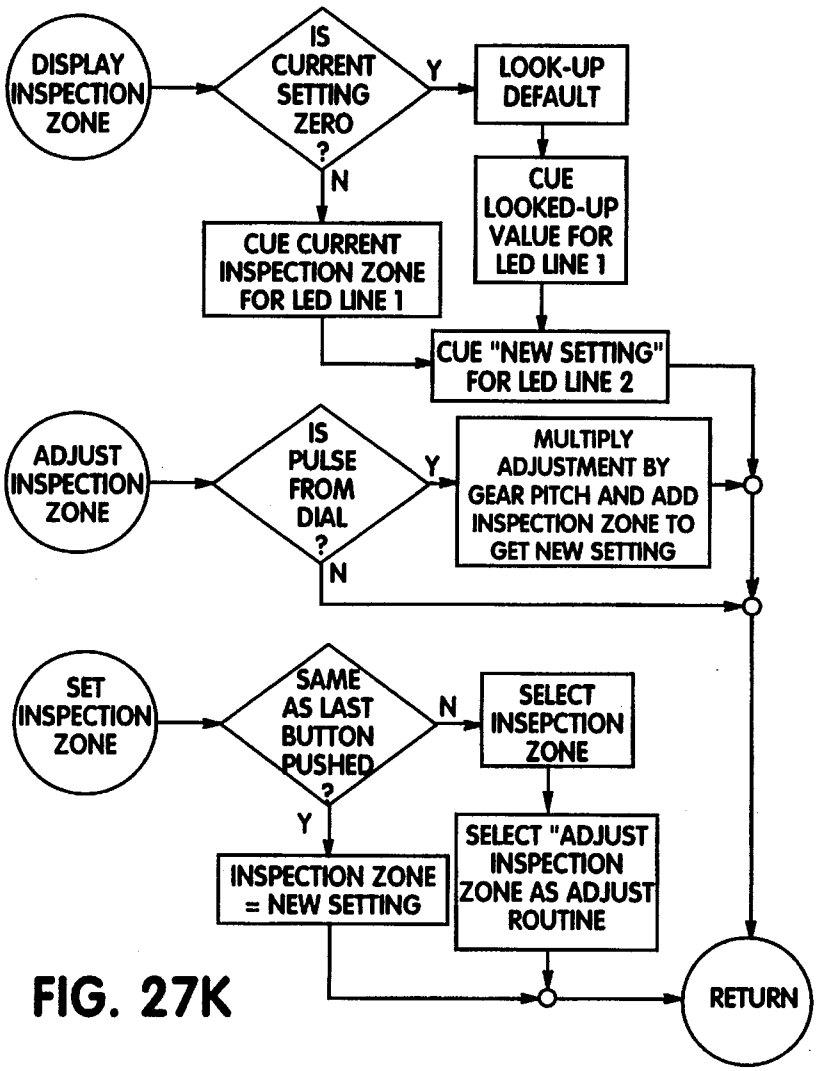
FIG. 27K is a flowchart of the INSPECTION ZONE WINDOW displaying, adjusting and setting subroutines called by the routines of FIGS. 27C, 27F and 27G.

As with the DEAD ZONE setting, the operator may also check and reset, if desired, the INSPECTION ZONE window. The INSPECTION ZONE window is the number of pulses before and after one repeat length from the previous detection count identifying the position of the web mark 350*a* during which the sensor 350 is activated. Providing for selective activation of the sensor 350 allows for printing on the web 11 in line with the sensor 350 outside of the inspection zone window. Preferably, when there is no need to print in the line of the web mark 350*a*, no inspection window limitation is used. This is accomplished by setting the inspection zone to zero, which is the default setting. The operator sets the inspection zone value by pressing the SET INSPECTION ZONE button 411*i*. As shown in the flowchart of FIG. 27G, when the SET INSPECTION ZONE button is pushed, the program will identify the button and initialize the SET INSPECTION ZONE routine, which is illustrated in FIG. 27K. The preset inspection zone value, if any, and if none the default inspection zone value, is initially loaded by the microprocessor 450 from memory variable 460*b*, which will be displayed to the operator on the display 413*a*, and also initially on the display 413*b*. The number displayed may be in inches or centimeters. The adjust routine is also set as the ADJUST INSPECTION ZONE routine that will be called by the dial interrupt routine of FIG. 27C, which is run when the operator turns the dial 415 to cause the display 413*b* to increment or decrement the displayed value by, for example, ¼ inch increments, or some other preprogrammed increments stored in the memory 463, producing the NEW SETTING that is displayed in the display 413*b*. When the inspection zone window size has been selected and the operator again presses the button 411*i*, the new setting value is stored into a variable in memory 464, which will be written to the non-volatile memory 460*c* if not further changed when the press is stopped.

The operator may also elect to change the GAIN setting. This is a setting that controls the amount of a detected registration error for which a correction is made. It is selected by the operator pressing the SET GAIN button 411*j*. As shown in the flowchart of FIG. 27G, when the SET GAIN button is pushed, the microprocessor 450 will identify the button and initialize the SET GAIN routine, which is illustrated in FIG. 27J. The preset gain value, if any, and if none the default gain setting of for example 5 (representing a value of 0.5 or one half of the error correction), is initially loaded from non-volatile memory variable 460*e* by the microprocessor 450 into volatile memory 464, which will be displayed to the operator on the display 413*a*, and also initially on display 413*b*, when the display routine of FIG. 27F is executed on the next 1/50th second time-out by the main loop program of FIG. 27. The gain value is on an arbitrary scale picked by the programmer, where 1 may equal, for example, about ten percent error correction, 9 equal 100 percent error correction, and the numbers 2–8 specify percentages spaced therebetween. To change the setting from the initial value, the operator then turns the dial 415, which causes the interrupt routine of FIG. 27C to execute the ADJUST GAIN subroutine of FIG. 27J, to update the adjustment value and the NEW SETTING that is cued to the display 413*b* by the display routine of FIG. 23F, incrementing upward or downward, for each click of the dial, by an amount that may correspond to a respective percentage increase or decrease in the gain setting. As illustrated in FIG. 27J, an integer number 1 through 9 is displayed. Alternatively, this may be converted to percentage for display. When the proper gain has been selected, which may be arrived at by the operator turning the dial 415, the operator presses the button 411*j* again to load the new value into volatile memory 464, thereby setting it. With the GAIN setting, as with other settings, the second button press does not deselect the setting routine. Thus, the operator can observe the performance of the press after making the setting effective with the second consecutive button press, and can move the dial 415 to make further adjustment, which can also be made effective by a third press of button 411*j*.

The SET REPEAT LENGTH function is identical in result to that described in connection with the positioning control above, but, when used from the registration controller 407, operates in the manner of the settings described above. The REPEAT LENGTH setting is not normally needed when the press is running, however. But in the event that a station 13 is brought on line when the press is running, which can be done with present press 10, the REPEAT LENGTH can be set, and the print roll 61 can even be changed, and then brought into registration without stopping the press.

The REPEAT LENGTH setting specifies the circumference of the print roller 61 rather than the length of actual images printed on the web 11, which may be more than one per print roller revolution. Should more than one plate 62 be spaced on the circumference of the print roller 61, or more than one web mark bearing image spaced around the same plate, a separate button 411*k* is provided on the registration control panel 411 for the convenience of the operator to enter the number of images per print roller revolution. The REPEAT LENGTH is stored in memory location 460*a*, which may be linked to memory location 440*a* (FIG. 24) of the positioning controller 408.

More particularly, the operator may elect to change the NUMBER OF REPEATS setting to allow the operator to specify the number of images per print roller revolution. This may be equal to the number of separate plates 62, spaced around the circumference of the print roller 61. This setting is used where each such image includes a registration mark 350, usually printed at the first station. In such a situation, the REPEAT LENGTH for the print roll in the calculations made by the registration control routines will be divided by the NUMBER OF REPEATS. However, where a plurality of images are formed on a single plate but only a single web mark is printed by the multiple image plate, the NUMBER OF REPEATS should be set equal to 1. The NUMBER OF REPEATS is therefore actually the number of web marks 350 per revolution of the print roller 61. The number is a positive integer from 1 to 9. The microprocessor 450 divides the set REPEAT LENGTH specified in pulses from the encoder 344 by this NUMBER OF REPEATS integer. The integer setting function is selected by the operator pressing the SET NUMBER OF REPEATS button 411*h*.

Figure 27N:
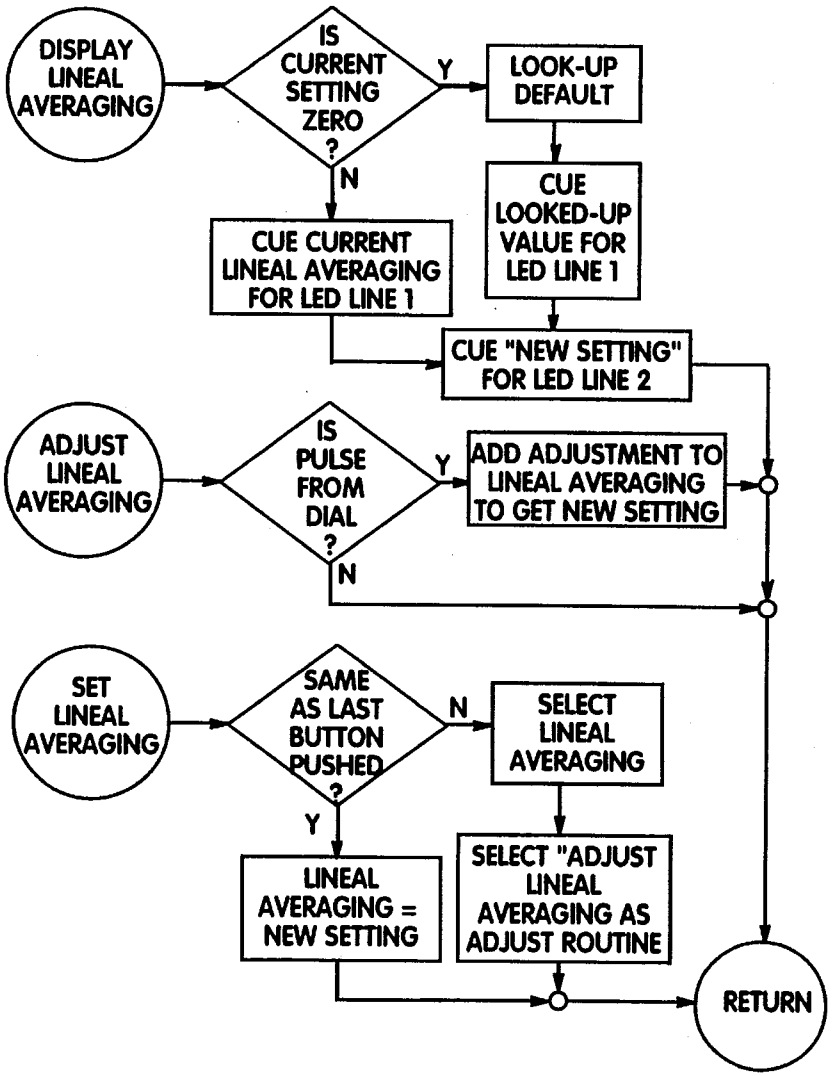
FIG. 27N is a flowchart of the LINEAR AVERAGE displaying, adjusting and setting subroutines called by the routines of FIGS. 27C, 27F and 27G.
Figure 27M:
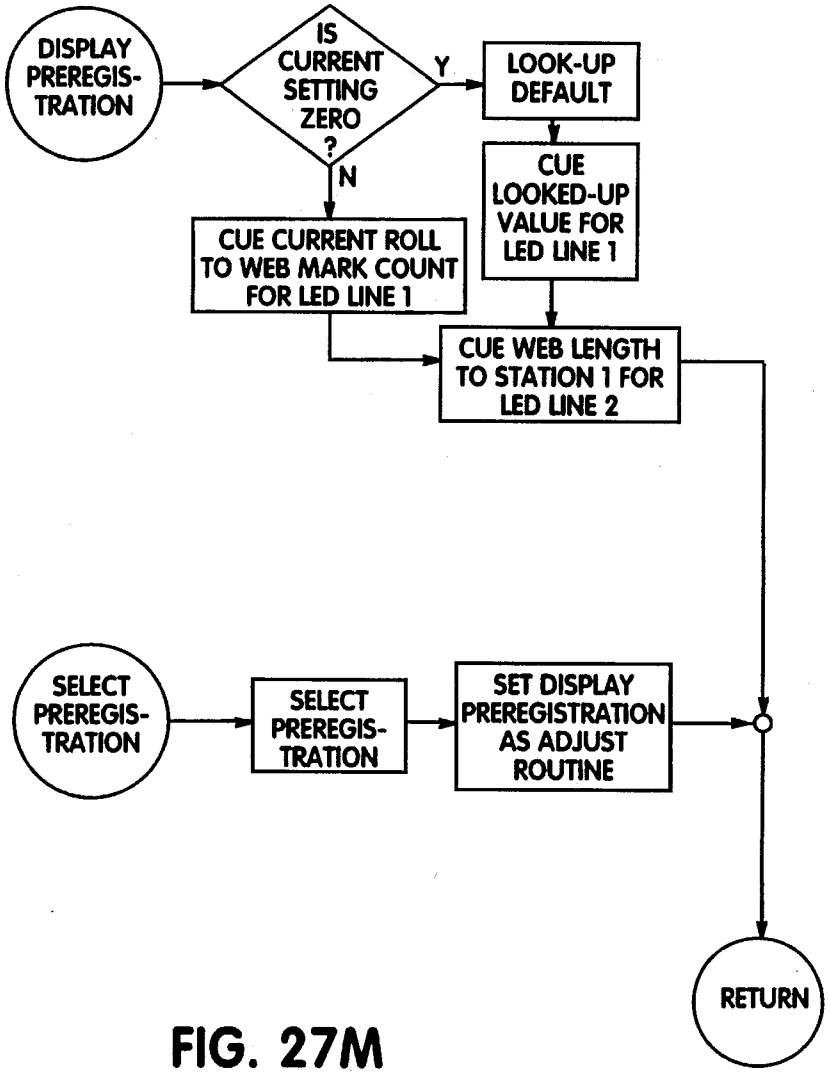
FIG. 27M is a flowchart of the PREREGISTRATION displaying and setting subroutines called by the routines of FIGS. 27F and 27G.
Figure 27R:
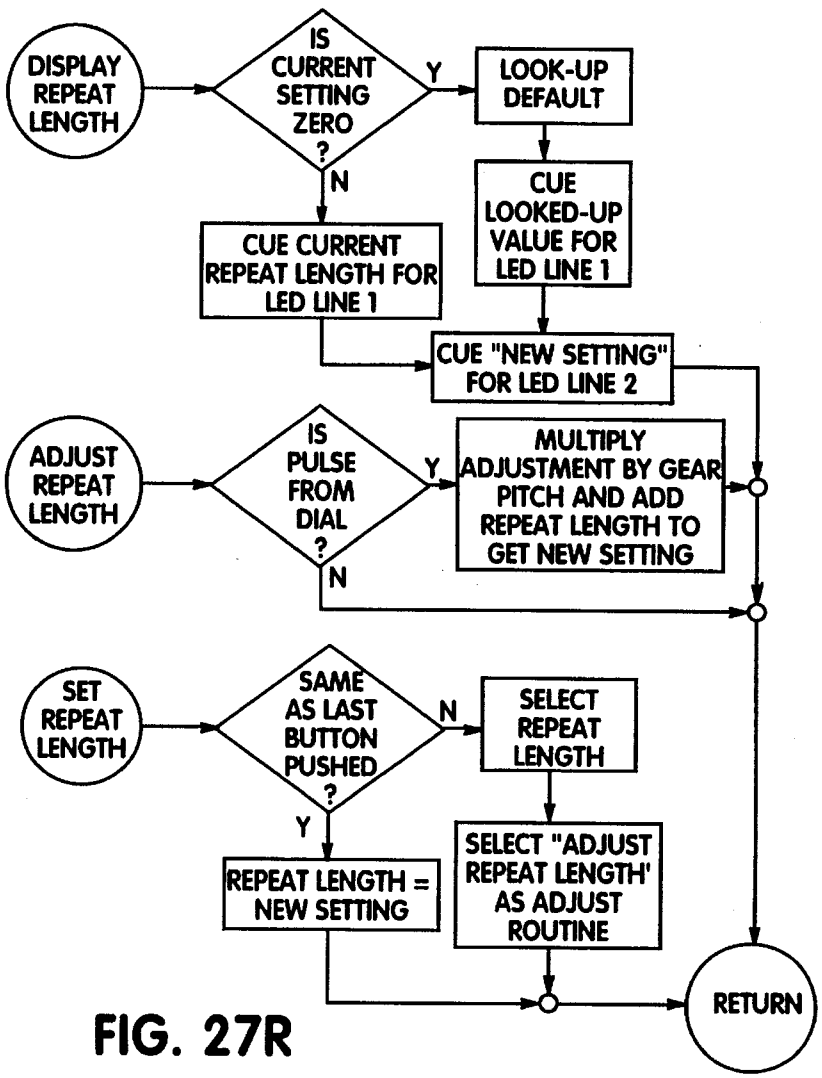
FIG. 27R is a flowchart of the REPEAT LENGTH displaying, adjusting and setting subroutines called by the routines of FIGS. 27C, 27F and 27G.
Figure 27P:
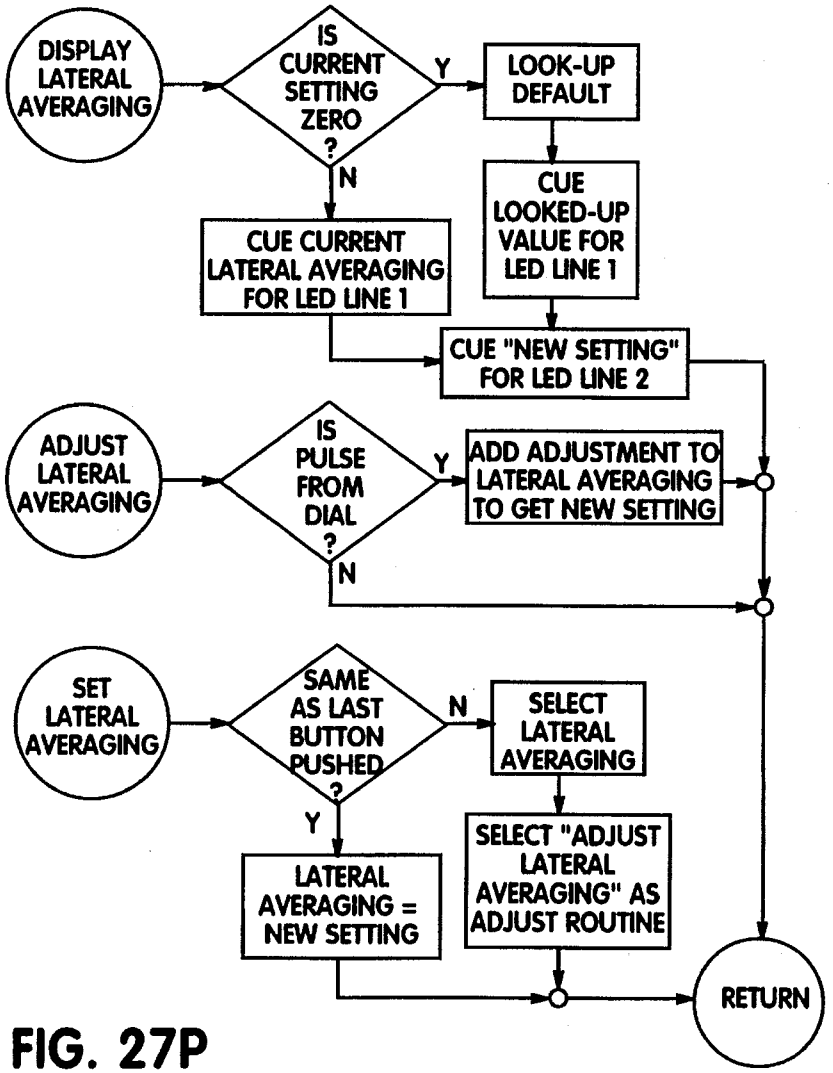
FIG. 27P is a flowchart of the LATERAL AVERAGE displaying, adjusting and setting subroutines called by the routines of FIGS. 27C, 27F and 27G.
Figure 27T:
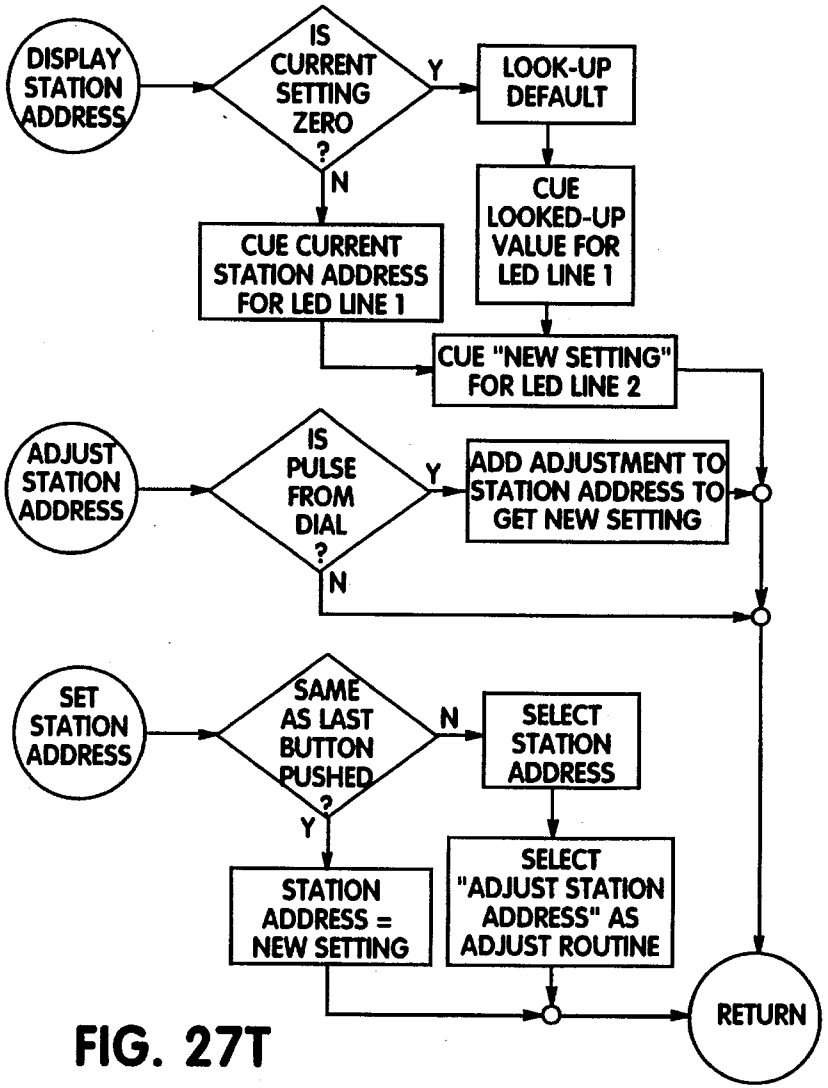
FIG. 27T is a flowchart of the STATION ADDRESS displaying, adjusting and setting subroutines called by the routines of FIGS. 27C, 27F and 27G.
Figure 27S:
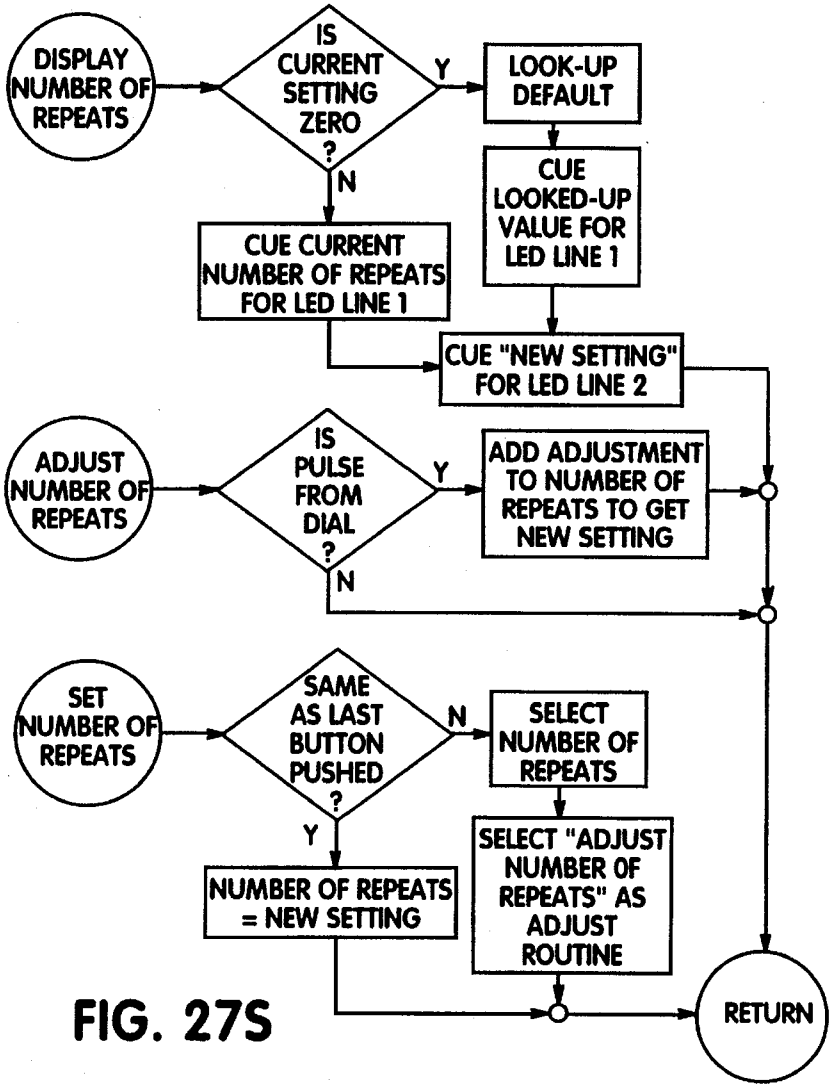
FIG. 27S is a flowchart of the NUMBER OF REPEATS displaying, adjusting and setting subroutines called by the routines of FIGS. 27C, 27F and 27G.

As shown in the flowchart of FIG. 27G, when the button 411*h* is pushed, the microprocessor 450 identifies the button and initializes the SET NUMBER OF REPEATS routine, which is illustrated in FIG. 27S. The preset number, if any, and if none the default setting of 1, is initially loaded by the microprocessor 450 from memory variable 460*d*, or, if it has been updated since the press was started from memory 464, which will be displayed to the operator on the display 413*a*, and also initially on display 413*b*. To change the setting from the initial value, the operator then turns the dial 415, which causes the interrupt routine of FIG. 27C to cue the display 413*b* to increment upward or downward by one integer for each click of the dial. When the proper number of repeats has been selected, the operator presses the button 411*h* again to load the new setting value into memory 464 where it is rendered effective, to be later stored in non-volatile memory variable 440*d* when the press is stopped. The changing of the NUMBER OF REPEATS occurs under circumstances similar to the changing of the REPEAT LENGTH setting described above.

The operator may further elect to set or change the LINEAL ERROR AVERAGING setting. This setting may be zero, which turns linear averaging off, or a non-zero positive integer less than 30, which controls the number of most recent consecutive circumferential registration error measurements to be averaged with the current registration error measurement being made, and upon which the correction amount is to be based. When the number is set, upon each reading, the oldest reading is discarded and the current one added to derive the correction to be made during execution of automatic linear registration. Preferably, a linear or other statistical curve fitting technique is used rather than simple arithmetic averaging. The selected values read are each stored in the temporary variable memory 464. The setting is made by the operator pressing the SET LINEAL AVERAGE button 411*l*. As shown in the flowchart of FIG. 27G, when the SET LINEAL AVERAGE button is pressed, the microprocessor will identify the button and initialize the SET LINEAL AVERAGE routine, which is illustrated in FIG. 27N. The preset lineal error averaging value, if any, and if none the default setting of one, is initially loaded by the microprocessor 450 from the memory variable 460*f*, which will be displayed to the operator on the display 413*a*, and also initially on display 413*b*. To change the setting from the initial value, the operator then turns the dial 415, which causes the interrupt routine of FIG. 27C to increment the number of measurements, represented by the LINEAR AVERAGING variable and displayed in the display 413*b*, over which the error will be averaged upward or downward by a count of one for each click of the dial. When the proper number has been selected, the operator presses the button 411*l* again to load the new value into memory 464, thereby setting it. This value will be stored, upon the stopping of the press, into variable 460*f* in non-volatile.

Figure 27V:
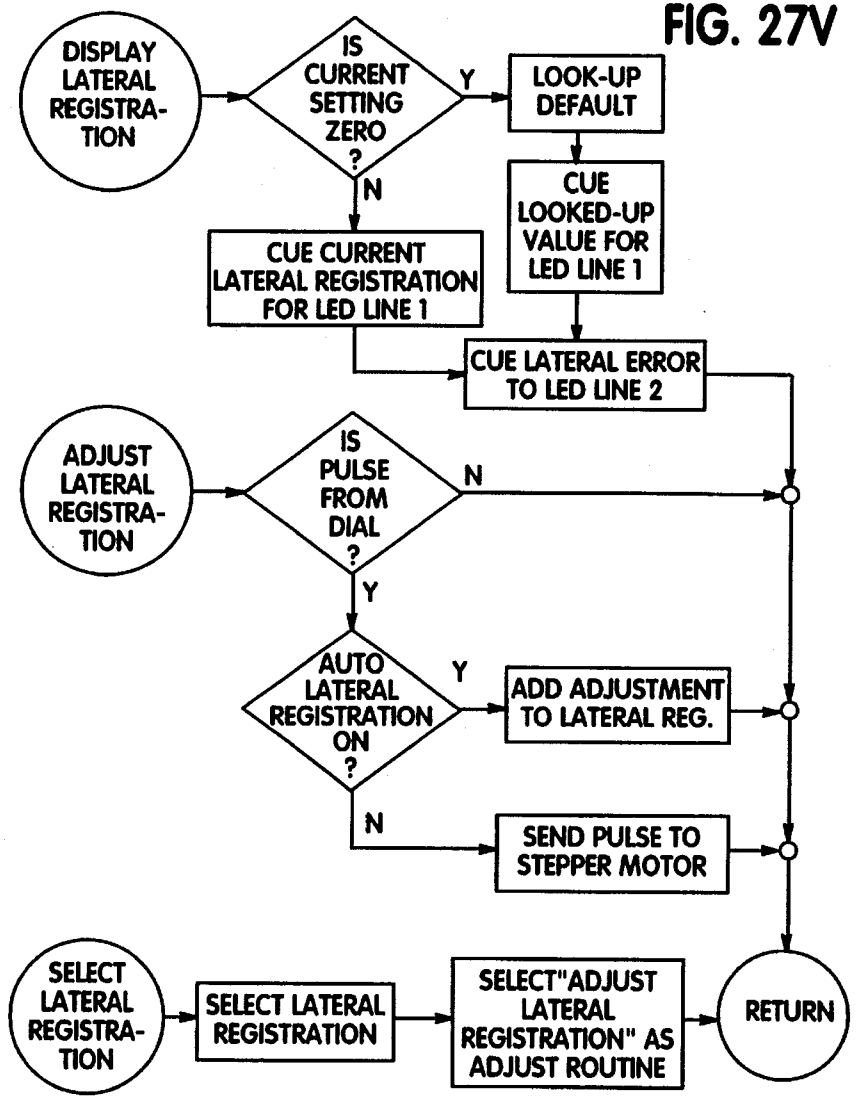
FIG. 27V is a flowchart of the LATERAL REGISTRATION displaying, adjusting and selecting subroutines called by the routines of FIGS. 27C, 27F and 27G.
Figure 27U:
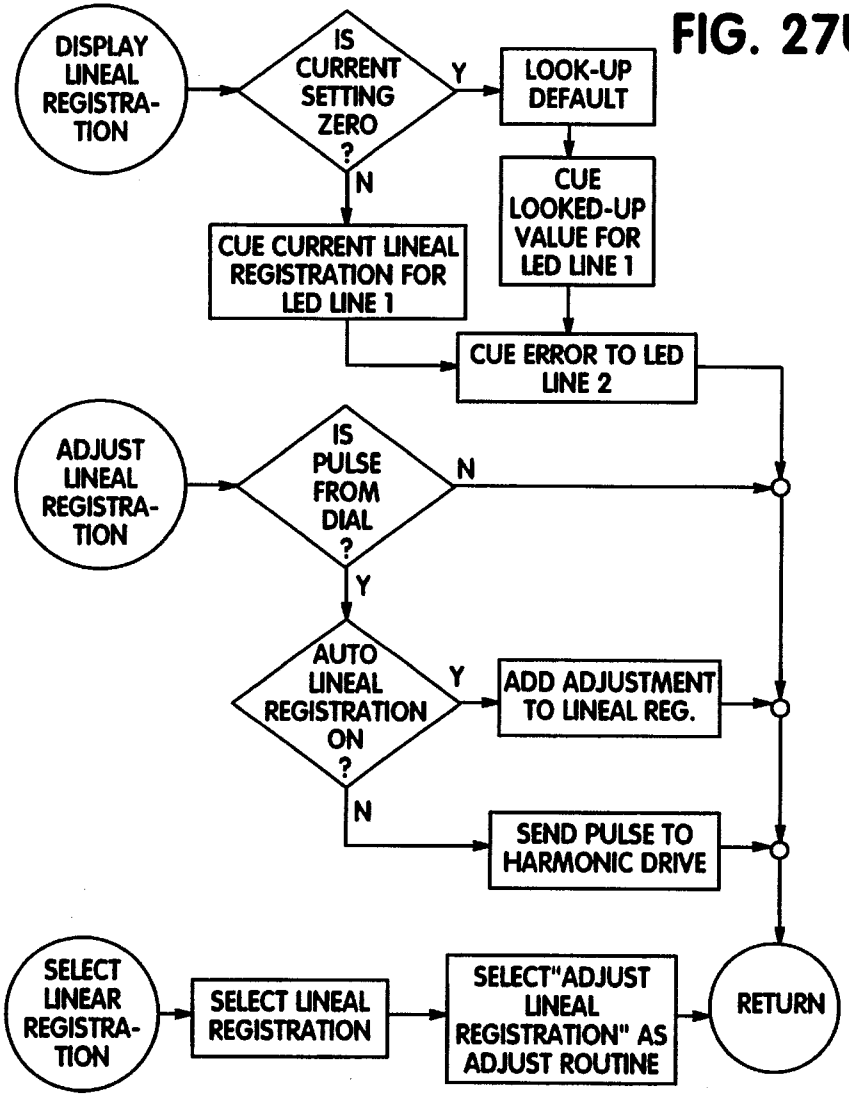
FIG. 27U is a flowchart of the LINEAL REGISTRATION displaying, adjusting and selecting subroutines called by the routines of FIGS. 27C, 27F and 27G.

In order for the registration to be carried out automatically, it is necessary for the operator to define the desired registration. This is accomplished by inspecting the printed product with the press 10 running very slowly and adjusting the lineal registration in manual lineal registration mode. With the press running, if automatic lineal registration is turned OFF and lineal registration is not selected, this mode is selected by pressing the LINEAL REGISTRATION button 411*a* alone. If automatic lineal registration is turned ON, it should be turned OFF by pressing both the LINEAL REGISTRATION button 411*a* and the MANUAL button 411*d*. The MANUAL routine allows the operator to roughly set the registration. As illustrated in FIG. 27U, when manual lineal registration mode is operating, clicks of the dial 415 directly result in pulses being sent to the stepper motor 327 of the harmonic drive 275. When the operator is satisfied with the registration, the NEXT MARK button 411*f* is pressed, causing NEXT MARK to be selected the next time the routine of FIG. 27G is executed. Once so selected, the next time the MAIN loop program of FIG. 27 is executed, the routine of FIG. 27D is called to set LINEAL REG., the circumferential registration setting, to the current count difference calculated by subtracting ROLL MARK count from the WEB MARK count. This sets the circumferential registration that will be maintained when LINEAL REGISTRATION is run in the AUTO mode.

More particularly, the routine of FIG. 27D, which is called when the NEXT MARK button is pushed, takes the ROLL MARK, which is the count from the impression roll counter 453 that is read when a signal from the sensor 347, indicating the passage of the leading edge of the print roller mark 349, and triggers the interrupt routine of FIG. 27A, and subtracts it from the WEB MARK, which is the count from the impression roll counter 453 that is read when a pulse from the sensor 350 detects the first leading edge of the web mark 350*a* and triggers the interrupt routine of FIG. 27B.

As can be seen from the MAIN LOOP flow chart of FIG. 27, when the web is moving and the ROLL MARK and WEB MARK have been read, the LINEAL REGISTRATION routine of the flowchart of FIG. 27H is executed. Upon its execution, if the inspection window has been set, the microprocessor 450 determines whether the DIFFERENCE between the WEB MARK and ROLL MARK counts is within plus or minus one half of the INSPECTION ZONE window of the LINEAR REG. setting. If not, the mark is ignored. The microprocessor 450 also checks to see if the DIFFERENCE has grossly changed, which could occur when noise is read as a web mark or when a paper tear and/or splice has occurred, in which case, the first such "shift" in reading is stored and checked against the next reading to see if the grossly changed reading repeats. Further, if LINEAL AVERAGING is on, the ERROR, which is determined by subtracting the DIFFERENCE from the LINEAL REG. value, is averaged with a number of past ERROR measurements equal to the LINEAR AVERAGING setting.

After the rough registration setting has been made in MANUAL mode, the operator goes to automatic mode to finely set the registration. This is the contemplated press running mode in which circumferential registration is continually automatically corrected.

To place the machine in automatic circumferential registration mode, the operator presses the AUTO button 411*a* in combination with the LINEAL REGISTRATION button 411*c*, which causes the button checking routine of FIG. 27G to set the AUTO LINEAL registration mode to ON. This causes the LINEAL REGISTRATION routine of FIG. 27H, the next time it is called by the MAIN LOOP, to multiply the ERROR or AVERAGED ERROR by the GAIN and send the number of pulses calculated thereby to the stepper harmonic drive 275.

The automatic linear registration mode is the RUN mode that implements the circumferential registration feature by automatically correcting the print roller 61 orientation relative to the web 11 such that the pulses from the sensors 347 and 350 tend to be separated by the number of pulses stored in the LINEAR REG variable 460*h*. In this mode, fine tuning of the LINEAL REG setting can be made by a turning of the dial 415 by the operator. This causes the interrupt routine of FIG. 27C to call the ADJUST LINEAL REGISTRATION routine of FIG. 27U. This has the effect of instantly increasing or decreasing the value in LINEAR REG in volatile memory, but not the value stored in non-volatile memory 460*h*. The value of LINEAR REG can be flagged to be permanently stored the next time the press is stopped by pressing of the NEXT MARK button 411*f*. The changing of LINEAL REG causes the ERROR to be calculated in relation to the new value the next time the LINEAL REGISTRATION routine of FIG. 27*h* is executed.

As automatic circumferential registration runs, the program routine of FIG. 27H is executed every time the MAIN LOOP loops, with the ERROR being sent in the form of a stream of pulses to the stepper motor 327 of the harmonic drive 275. If LINEAR AVERAGING had been selected, this ERROR is averaged with the past number of measurements indicated by the setting of LINEAR AVERAGE as discussed above. If the calculated linear ERROR is less than the DEAD ZONE setting stored in 460*c*, no pulses are sent to the harmonic drive 275. If the error is greater than the DEAD ZONE setting, the ERROR is scaled in accordance with the GAIN (such as by multiplying the ERROR by the 1/9-th of the GAIN, which may be a number from 1 to 9), with the scaled ERROR sent, in pulses, to the harmonic drive 275.

The selection of LINEAL REGISTRATION allows the operator to adjust the circumferential registration while automatic registration is in effect and whether only lineal or both lineal and lateral registration are currently turned on.

To turn off automatic circumferential registration, the operator presses the MANUAL and then LINEAL REGISTER buttons.

Axial Registration

When the axial adjustment mechanism 330 (see FIG. 17) is activated to make axial registration corrections between the web 11 and printing plate 62, the web sensor 350 needs to move along with the printing roller 61. That is, for axial registration, the axial position of the print roller 61 is directly related to the mark 350*a* on the web 11. In the circumferential registration described above, the relative circumferential position of the print roller 61 (i.e., mark 349) relative to the mark 350*a* on the web 11 was made indirectly, by measuring each relative to respective sensors 347 and 350 fixed to the frame 36. To accomplish axial, or lateral, registration, the base platform 48 is mechanically connected to bar 367 so that as platform 48 is moved by axial adjustment mechanism 330, bar 367 and therefore the web sensor 350 move in the same direction (see FIG. 18). This mechanical connection may be accomplished by fixing a vertical bracket 375 to the stop plate 58 of base platform 48. The upper end of bracket 375 mounts a threaded sleeve 376 having a threaded rod 377 disposed therein. The threaded rod 377 is oriented generally coaxial with bar 367. A magnet 378 is fixed to the free end of rod 377 and engageable with the front end of bar 367. The relative position between the web sensor 350 and the base platform 48 can be further adjusted by adjusting the depth of rod 377 in sleeve 376. Once a desired depth is obtained, a locking nut 379 disposed along rod 377 can be tightened against sleeve 376 to fix this relative position.

Thus, with the magnet 378 attached to the end of bar 367, transverse movement of the base platform 48 (i.e., printing roller 61) by the axial adjustment mechanism 330 likewise causes the same transverse movement of the web sensor 350 relative to the web 11. When the base platform 48 is moved from the operational position (see FIG. 4) to the stand-aside position (see FIG. 5), as previously described, bracket 354 is moved transversely into contact with bracket 368, stopping the transverse movement of bar 367 and causing the magnetic bond between magnet 378 and bar 367 to be broken as bracket 375 continues to move transversely with platform 48 to the stand-aside position. Because the relative position between threaded rod 377 and vertical bracket 375 is fixed by locking nut 379, when the base platform 48 is brought back into the operational position and magnet 378 reestablishes its connection with bar 367, the previous relative position between the base platform 48 (i.e., the printing roller 61) and the web sensor 350 is reestablished.

Figure 21:
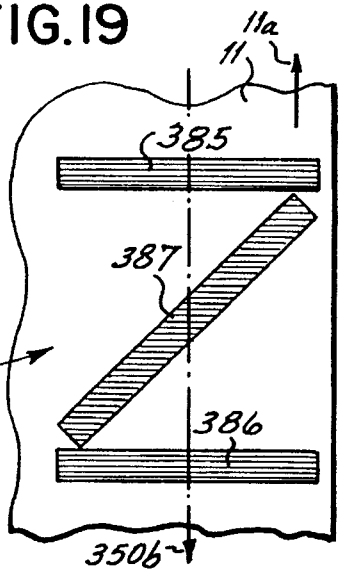
FIG. 21 is a view of the web mark to be sensed in a printing operation.
Figure 20:
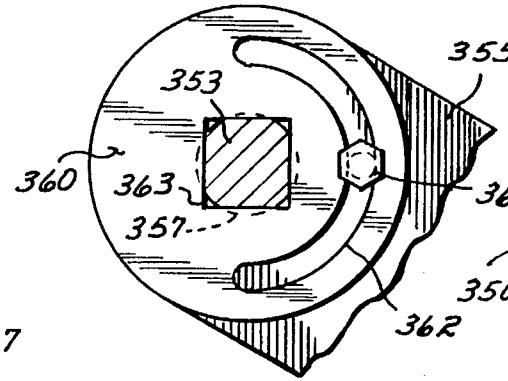
FIG. 20 is a sectional view taken on line 20—20 of FIG. 18.

The web mark 350*a* has two longitudinally spaced transversely aligned bars 385 and 386 with a diagonal bar 387 disposed therebetween (see FIG. 21). The intermediate diagonal bar 387 is positioned at an angle of about 45° from either transverse bar 385, 386. When the web sensor 350 registers the leading edge of the leading transverse bar 385, a counter is established in memory and pulses from the encoder 344 are counted upward from zero until the leading edge of the diagonal bar 387 is registered by the sensor 350. Then, the counter is counted downward until the leading edge of the trailing transverse bar 386 is registered. If the trailing transverse bar 386 is registered before the counter counts down to zero, the pertinent station computer 450 knows that there is an axial registration error in one transverse direction, and that the axial adjustment mechanism 330 is to be activated, as previously described, in order to affect the axial registration correction. If the trailing transverse bar 386 is registered after the counter counts down to zero, the pertinent station computer 450 knows that there is an axial registration error in the other transverse direction, and that the axial adjustment mechanism 330 is to be activated in the reverse, also as previously described, in order to affect the axial registration correction.

Implementation of axial registration requires the settings of certain of the parameters described in connection with the circumferential registration above. These are the DEAD ZONE and GAIN parameters, and the INSPECTION ZONE parameter, which function the same as with the circumferential registration. If the inspection zone window is being used, that is, is set other than zero, REPEAT LENGTH and NUMBER OF REPEATS also are relevant to axial registration, since the web mark 350*a* being read for axial registration is the same mark that is read for circumferential registration. These are set as described above. Additionally, LATERAL AVERAGE is set. The lateral averaging function performs an averaging of the current axial error with the set number of past measurements in the same manner that the lineal averaging function performed the averaging of circumferential error averaging described above.

The LATERAL AVERAGING setting is set by pressing the SET LATERAL AVERAGE button 411*m*. As illustrated in FIG. 27G, this causes the execution of the SET LATERAL AVERAGE routine illustrated in FIG. 27P. This setting may be zero, which turns lateral averaging off, or a non-zero positive integer less than 30, which controls the number of most recent consecutive axial registration error measurements to be averaged with the current measurement being made, and upon which the correction amount is to be based. When the number is set to, for example 5, a running total of the last five measurements of axial error is stored in memory. Upon each subsequent error measurement, the oldest reading is discarded and the current one added to the total, which is then divided by 5 to derive the correction to be made. As with the linear averaging, preferably a linear or other statistical curve fitting technique may be used rather than simple arithmetic averaging. The selected number of values read are each stored in the temporary variable memory 464.

The setting is made by the operator pressing the SET LATERAL AVERAGE button 411*m*. As shown in the flowchart of FIG. 27G, when the SET LATERAL AVERAGE button is pressed, the program will identify the button and initiate the SET LATERAL AVERAGE routine, which is illustrated in FIG. 27P. If the button is not the same as the immediate previously pressed button, the routine selects LATERAL AVERAGING and selects the ADJUST LATERAL AVERAGING routine as the adjust subroutine to be called by the interrupt handler routine of FIG. 27C that responds to pulses from the operator adjustment dial 415.

Once the LATERAL AVERAGING is selected, the next time the button-press routine of FIG. 27F is executed, the DISPLAY LATERAL AVERAGE routine of FIG. 27P is executed, which looks up the preset lateral error averaging setting, if any. The default setting of zero indicates that LATERAL AVERAGING is turned off. The looked up or default value is cued to line 1 of the display, 413*a*, and also initially to line 2 of the display, 413*b*. To change the setting from the initial value, the operator turns the dial 415. Pulses from the dial are interpreted by the interrupt routine of FIG. 27C, which calls the adjustment subroutine of FIG. 27P for LATERAL AVERAGING. Then, the next time the display routine FIG. 27F is executed, the NEW SETTING is displayed in display 413*b*, incremented by the cumulative net pulses from the dial 415. When the proper number has been selected, the operator presses the button 411*m* again. This is read by the routine of FIG. 27G, which causes the SET LATERAL AVERAGE routine of FIG. 27P to be executed. This identifies the second consecutive button press of button 411*m*, which sets the LATERAL AVERAGING number to the NEW SETTING. This setting is stored in non-volatile memory variable 460*g* when the press stops.

In order for the axial registration to be carried out automatically, it is necessary for the operator to define the desired lateral registration. The LATERAL REGISTRATION is the difference in impression roll decoder pulse counts between the diagonal bar portion of the web mark 350*a* and the respective leading and trailing transverse segments of the web mark. The setting is accomplished by inspecting the printed product with the press 10 running slowly and adjusting the lateral registration in manual lateral registration mode. With the press running, if automatic lateral registration is turned OFF and lateral registration is not selected, this mode is selected by pressing the LATERAL REGISTRATION button 411*b*. If automatic lineal registration is turned ON, it should be turned off by pressing both the LINEAL REGISTRATION button 411*b* and the MANUAL button 411*d*. The MANUAL routine allows the operator to roughly set the registration. As illustrated in FIG. 27V, when manual lateral registration is operating, turning of the dial 415 directly results in pulses being sent to the transverse stepper motor 340. When the operator is satisfied with the registration, the NEXT MARK button 411*f* is pressed, causing a value to be stored in volatile memory for the variable LATERAL REG, which is stored as the non-volatile memory variable 460*i* when the press is next stopped. LATERAL REG is the lateral registration that will be maintained when lateral registration is run in the AUTO mode.

As can be seen from the MAIN LOOP flow chart of FIG. 27, when the web is moving and the ROLL MARK and WEB MARK have been read, the LINEAL REGISTRATION routine of the flowchart of FIG. 27H is executed. Following its execution, if a full Z-mark has been read, the LATERAL REGISTRATION routine of FIG. 27I is executed. This routine calculates the LATERAL ERROR. It also averages it with previous error measurements if the LATERAL AVERAGING function is selected.

After the rough lateral registration setting has been made in MANUAL mode, the operator goes to automatic mode to finely set the registration. This is the contemplated press running mode in which axial registration is continually automatically corrected.

To place the machine in automatic axial registration mode, the operator presses the AUTO button 411*a* in combination with the LATERAL REGISTRATION button 411*d*, which causes the button checking routine of FIG. 27G to execute set the AUTO LATERAL registration mode to ON. This causes the LATERAL REGISTRATION routine of FIG. 27I, the next time it is called by the MAIN LOOP, to multiply the ERROR or AVERAGED ERROR by the GAIN and send the number of pulses calculated thereby to the stepper motor 340.

The automatic lateral registration mode is the RUN mode that implements the axial registration feature by automatically correcting the print roller 61 transverse position relative to the web 11 such that the pulse count of the LATERAL ERROR tends to equal LATERAL REG. In this mode, fine tuning of the LATERAL REG setting can be made by a turning of the dial 415 by the operator. This causes the interrupt routine of FIG. 27C to call the ADJUST LATERAL REGISTRATION routine of FIG. 27V. This has the effect of instantly increasing or decreasing the value in LATERAL REG in volatile memory, but not the value stored in non-volatile memory 460*h*. The value of LATERAL REG can be flagged to be permanently stored, the next time the press is stopped, by pressing of the NEXT MARK button 411*f*. The changing of LATERAL REG causes the LATERAL ERROR to be calculated in relation to the new value the next time the LATERAL REGISTRATION routine of FIG. 27I is executed.

As automatic axial registration runs, the program routine of FIG. 27I is executed every time the MAIN LOOP loops as described above, with the LATERAL ERROR being sent in the form of a stream of pulses to the stepper motor 340. If LATERAL AVERAGING had been selected, this LATERAL ERROR is averaged with the past number of measurements indicated by the setting of LATERAL AVERAGE as discussed above. If calculated lateral ERROR is less than the DEAD ZONE setting stored in 460*c*, no pulses are sent to the stepper motor 340. If the lateral error is greater than the DEAD ZONE setting, the LATERAL ERROR is scaled in accordance with the GAIN (such as by multiplying the ERROR by the 1/9-th of the GAIN, which is a number from 1 to 9), with the scaled LATERAL ERROR sent, in pulses to the stepper motor 340.

The selection of lateral registration allows the operator to adjust the axial registration while automatic registration is in effect and whether only lateral or both lineal and lateral registration are currently turned on.

To turn off automatic axial registration, the operator presses the MANUAL and then LATERAL REGISTER buttons.

Unlike the circumferential registration feature in which both the orientation of print roller mark 249 and the position of the web mark 350*a* are sensed relative to the stationary frame with two sensors 347 and 350 respectively, axial registration is measured only with the sensor 350, which is mounted to move transversely with the print roller 61 as the transverse registration adjustment takes place. The transverse position of the roller 61 with respect to the web 11 is measured by interpreting the position of the sensor 350 relative to the asymmetrical web mark 350*a*. This is illustrated in FIG. 21.

Referring to FIG. 21, the web mark 350*a* is illustrated on the web 11, with the arrow 350*b* illustrating the direction of relative travel of the sensor 350 over the web 11 as the web moves in the opposite relative direction indicated by the arrow 11*a*. As the print roller 61 is axially adjusted, it moves transversely relative to the web 11 and the mark 350*a*, and the position of the scan line 350*b* moves similarly relative to the mark 350*a*. In FIG. 21, the scan line 350*b* is illustrated in its preferred adjusted position in the center of the mark 350*a*. This position is preferred so that the sensor 350 is less likely to travel off the side of the mark 350*a* when the print roller 61 is out of registration, which would cause loss of axial registration control. This position is approximately set mechanically by positioning the sensor 350 on its mount, as described in connection with the preregistration feature above.

When the scan line 350*b* is thus approximately centered in position over the mark 350*a*, the sensor 350 will first detect the leading edge of the leading transverse bar 385 of the mark 350*a*. The lineal position of this edge is recorded by storing the content of the counter 453*a*. This is the WEB MARK position described above and used for circumferential registration. It is not affected by axial registration adjustments since the bar 385 is transverse the web 11. In addition to WEB MARK, the content of the counter 453*a* is stored as a variable WEB MARK 2 as the leading edge of the diagonal bar 387 is sensed by the sensor 350. Additionally, the content of the counter 453*a* is further stored as the variable WEB MARK 3 as the sensor encounters the leading edge of the transverse bar 386. The microprocessor 350 may then calculate the ratio of the differences between successive leading edges by dividing (WEB MARK minus WEB MARK 2) by (WEB MARK 2 minus WEB MARK 3), then converting to an equivalent axial error pulse count. Preferably, however, the difference between the pulse count between the pairs of marks, i.e (WEB MARK–WEB MARK 2) and (WEB MARK 2–WEB MARK 3) are subtracted. The LATERAL REG. adjustment is then also subtracted. The difference will then be used to define the axial error or LATERAL ERROR, which is (WEB MARK–WEB MARK 2)–(WEB MARK 2–WEB MARK 3).

The calculation of LATERAL ERROR may be made simply by counting the pulses from the encoder 344 on the impression roller 66 beginning with the detection of the WEB MARK, and then reversing the count, that is subtracting pulses, beginning with the detection of WEB MARK 2 and ending with the detection of WEB MARK 3. The remaining count may then be taken as the difference.

If, prior to selecting AUTO–LATERAL REGISTER, the operator has turned on automatic circumferential registration by depression of the AUTO and LATERAL REGISTER buttons, lineal registration will be executed every cycle, or repeat length, even though lateral automatic registration is currently selected. The selection of lateral registration allows the operator to adjust the axial registration while automatic registration is in effect and whether only lateral or both lineal and lateral registration are being automatically performed.

To turn off automatic axial registration, the operator presses the MANUAL and then LATERAL REGISTER buttons.

With both the circumferential and axial registration adjustment, the stepper motors 327 and 340 are sent pulses under the control of the microprocessor 450 at a rate as fast the stepper motors can respond.

Computer Controlled Reinsertion Compensation

In accordance with principles of the present invention, computer controlled registration, particularly circumferential registration, is provided with a special reinsertion feature for situations in which the web 11 is subjected to multiple printing runs. It is often desirable to run a web 11 through one form of printing press 10 (e.g. flexographic), remove the web 11 from the press 10 and insert it into another form of press (e.g. rotary screen) in which it is subjected to an intermediate printing operation, and then reinsert the web 11 through the flexographic printer 10 for another printing run. When a web 11 is subjected to such multiple printing runs, the web 11 is likely to go through varying dimensional changes, such as stretching and/or shrinking. Such dimensional changes may be uniform along the length of the web 11; however, it is more likely that these dimensional changes will vary along the length of the web 11.

Such dimensional changes may also occur when no intermediate printing operation is performed. Storing the web 11, in its rolled form, between printing runs on the same press 10 may also result in similar distortion of the web 11 due to changes in humidity, the weight of the web 11 itself, and other ambient factors. As the web changes dimensionally, so do the images previously printed on the affected areas of the web 11. When new component images are printed onto the previously printed web 11, the reinsertion feature makes corrections for the dimensional changes to the web 11, and therefore to the old composite image printed during the preceding run, to bring the new component images printed during the subsequent run into closer circumferential registration with the old composite images. As the web 11 (and old composite images) stretch or shrink, so does the distance between successive web marks 350*a*.

The present computer controlled reinsertion feature is able to recognize changes in the web mark to web mark distances relative to the original repeat length, which is generally the repeat length of the plates on the press 10 into which the web 11 is being reinserted. The computer controlled reinsertion control is capable of controlling the press 10 to change the shape of the new component images to thereby compensate for changes in the shape of the old composite images due to distortion of the web 11.

The shape of the new component images are changed (i.e., their length increased or decreased) by varying the speed at which the printing roller 61 is rotated relative to the traveling speed of the web 11. Rotation of the printing roller 61 is slowed down in order to lengthen or stretch the new component image and speeded up in order to shorten or shrink the new component image. While this reinsertion feature helps to compensate for dimensional changes in such old composite images (i.e., when the web has been printed on, removed from, and reinserted in the press 10), this reinsertion feature is generally not necessary, and can in some circumstances be detrimental, if used during initial printing runs of the web 11 through press 10. Reinsertion control may unnecessarily introduce another variable where dimensional changes to the web 11 during the first run are mostly consistent over the entire length of the web 11. Accordingly, the present invention provides for the selective enabling and disabling of reinsertion control, the constant monitoring of reinsertion error and the response of the control thereto, and the adjustment of the operation of the reinsertion control between setups and during the printing runs.

With the computer controlled reinsertion feature of the present invention, the originally printed web marks 350*a* are reused during subsequent runs through press 10. The computer controlled registration described above is also provided with additional parameter settings that cooperate to affect what is referred to here as a constant error correction in the registration control described above. This constant error correction feature operates to analyze the error corrections made over a preset number of repeat lengths, and to predict a constant component of total correction to be made. This constant error correction is then made in advance of the circumferential registration error measurement on the next repeat length. The error correction that would otherwise be made to the circumferential registration will be made based upon a measurement that has already been corrected by the constant correction factor, and the circumferential registration correction is then superimposed over the constant error correction.

The constant error correction in effect is responsive to the actual repeat lengths of the web 11 (i.e., the actual distance between successive web marks 350*a* originally printed on the web 11). The actual repeat length may not be the same as the repeat length to which the press 10 has been set, due to dimensional changes in the web 11 since the original printing. With the reinsertion feature and its error correction provision, compensation is made for the dimensional changes in the actual repeat length. Such changes are made by slightly changing the rotational speed of the printing roller 61 and evenly distributing correction pulses over each actual repeat length of the web 11 in equal intervals and at the frequency that is necessary to make the constant error correction.

While referred to as a "constant" error correction, the predictive correction is not literally constant over all repeat lengths. Rather, the "constant" is reevaluated periodically, preferably for each repeat length, and adjusted.

Implementation of the reinsertion feature requires the settings of those parameters described in connection with the registration above, and in addition the settings of CEC AVERAGE or the number of repeat lengths over which the errors are analyzed for computation of the constant error correction, by averaging, error regression analysis, or other statistical method. The CEC error regression number is the number of repeat lengths over which the error is analyzed to predict the constant error correction to be made at a particular station 13 when the next repeat length is printed. The correction is not necessarily the same at each station, but may be based on an independent analysis at each station 13, or an analysis at the host computer 400 that may consider data from each of the registration computers 450. The reinsertion number may vary from 1 to 29 in the described embodiment.

The linear regression method of the embodiment referred to above best fits a straight line to the error value points as a function of consecutive measurements and establishes a trend, extrapolating or predicting the error value for the next measurement. The best fit statistical method employed may be, for example, a least square method by which the line is derived that minimizes the sum of the square of the distances of each of the points from the line.

When implemented solely from the individual stations 13, the microprocessors 450 will independently collect data based on the measurements made locally at the station. In this way, the reinsertion control may be run without the need for interaction with the host computer. Also, in this way, distortions of the web 11 that may occur during the current printing run will be independently accounted for at each station 13. Furthermore, the CEC error may be found to vary over lengths of the web 11, of for example, fifty or one hundred feet. With a twelve station press, the amount of web 11 extending through the press 10 from the first station 13*a* to the last station 13*n* may be four or five hundred feet. Thus, the correction to be made at station 13*a* will differ from that to be made at station 13*n* and the stations 13 therebetween.

Interaction between the individual microprocessors 450 and the host computer 400 may provide particular advantages with the reinsertion control. Dimensional changes that occur in the web 11, as a function of the length of the web 11, progress successively through the stations 13 as the web 11 is advanced through the press 10. Thus, errors that are due to web distortion occurring prior to reinsertion into the press 10 will be detected first at the first station 13*a*, then at the station b, and progressively through the stations 13 to the last station 13*n*. By communication between the host computer 400 and the individual computers 450, the data read at an upstream station, such as station 13*a*, can be of benefit in predicting the "constant" error for which correction must be made at the downstream stations, such as the station 13*n*.

Figure 27W:
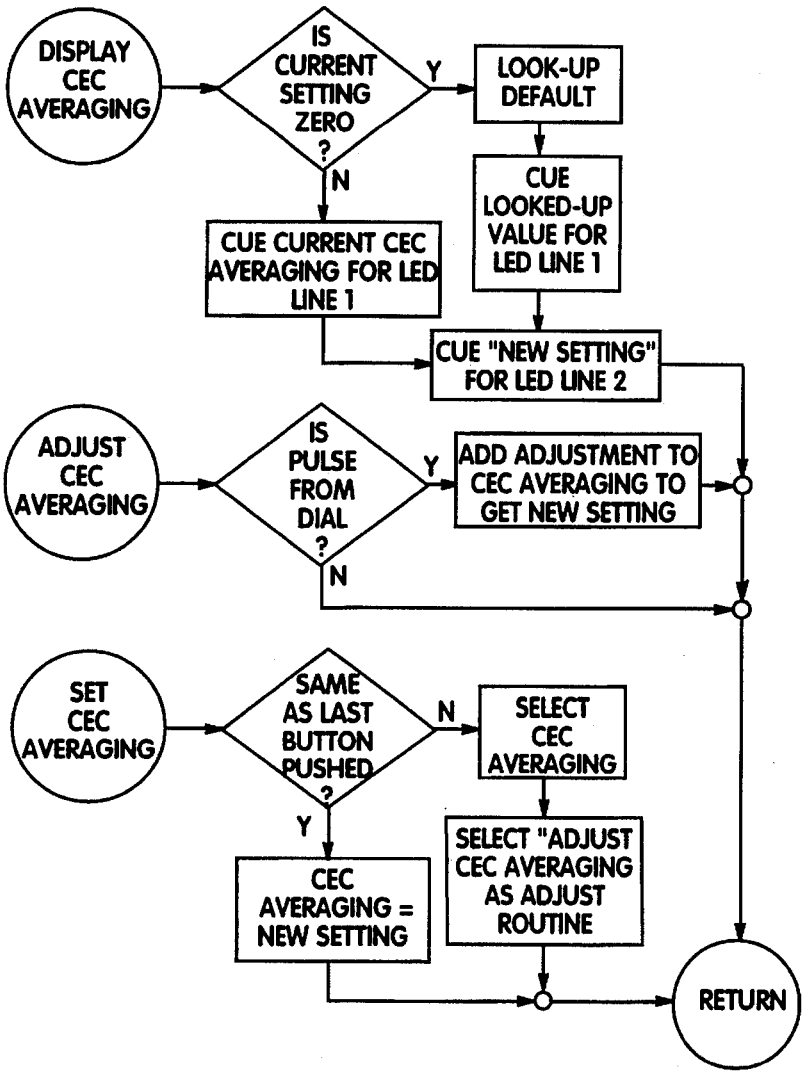
FIG. 27W is a flowchart of the CEC displaying, adjusting and selecting subroutines called by the routines of FIGS. 27C, 27F and 27G.

To use the CEC feature, the CEC regression number must be set, which is accomplished by pressing the CEC AVERAGING button 411*o*. As illustrated in FIG. 27G, the detection of this button by the button press routine causes the execution of the SET CEC AVERAGING routine illustrated in FIG. 27W. This causes the CEC AVERAGING function to be selected and the ADJUST CEC AVERAGING to be set as the adjustment subroutine for the dial pulse interrupt routine of FIG. 27C. Then, upon the next execution of the display routine of FIG. 27F, the DISPLAY CEC AVERAGING routine of FIG. 27W is run, which ques the current CEC averaging or regression number setting to line 1 of the display, 413*a*, and also initially to line 2, 413*b*. This regression number setting, or CEC setting, may be one, which implies that reinsertion correction, or constant error correction, is off, which is the preferred setting when reinsertion of a preprinted web 11 has not been made in the setup of the print run but the web 11 is being printed upon for the first time. When set to a positive integer greater than 1 but less than 30, the CEC setting controls the number of most recent consecutive registration error measurements to be analyzed to arrive at a constant error correction to be imposed in the next cycle. In the illustrated embodiment, CEC is carried out with respect to circumferential registration.

In general, this CEC feature has utility whenever error is predictable based on prior error measurements, or when the next error is likely to vary from the previous error rather than an absolute value. The CEC function performs a progressive average or other regression analysis with each measurement over the past number of measurements that are set by the CEC. Upon each subsequent error measurement, the oldest reading is discarded and the current one considered in the total. Preferably, a linear or other statistical curve fitting technique is used rather than simple arithmetic averaging. The selected number of values read are each stored in the temporary variable memory 464.

To change the setting from the initial value, the operator then turns the dial 415, which causes the interrupt routine of FIG. 27C to increment or decrement the pulse count and execute the ADJUST CEC AVERAGING subroutine of FIG. 27W. The next time the display routine 27F is executed, the display 413*b* will be loaded with the NEW SETTING, which is the current setting in line 1 of the display, 413*a*, modified by the cumulative adjustment, or net sum of pulses from the dial 415. When the proper number has been selected, which may be arrived at by the operator turning the dial 415, the operator presses the button 411*n* again. When the routine of FIG. 27G identifies the button, it executes the SET CEC AVERAGING routine of FIG. 27W again, which detects the second consecutive press of the button and sets the CEC AVERAGING to the NEW SETTING. When the press stops, this is loaded into the new value into variable 460*j* in non-volatile memory, thereby setting it.

To run constant error correction for reinsertion applications, the operator presses the CEC button 411*n* along with the AUTO button 411*c*, as illustrated in FIG. 27G. To turn CEC off, the operator presses the CEC button 411*n* and the MANUAL button 411*d*. Pressing of the CEC button 411*n* alone while the press is printing will, display to the operator on display 413 the constant errors being measured and the corrections being made or being calculated to be made.

Figure 27X:
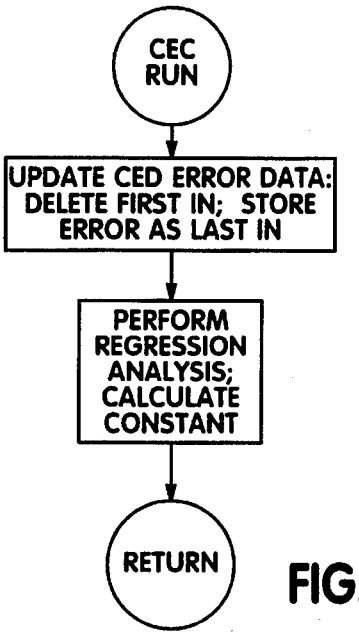
FIG. 27X is a flowchart of the CEC determining subroutine called by the routine of FIG. 27H.

FIG. 27H includes the program steps for making of the constant error correction in the course of automatic registration by calling the subroutine of FIG. 27X. With this routine, the analysis is performed on the past error measurements equal to the set regression number, with the oldest stored error being discarded and the latest stored as each error is read. Further, as illustrated in FIG. 27, whenever the press 10 is stopped, AVERAGING ARRAYS are RESET. This includes a resetting of the stored regression number of errors, which involves either setting the series of measurements to zeros or to some other default value or values. This step is taken because, due to the stresses and other causes of dimensional changes affecting the web 11 during the stopping and starting of the press 10 or the mere immobility of the web 11, or to possible manual repositioning of the web 11, the past error readings of the errors lack validity. The clearing of the error values may be linked to any of a number of controls of the machine 10 that would indicate web immobility.

Additional servicing functions may be provided, for example, by provision of a SPECIAL key, such as the button 411*p*, to be used in combination with other keys to initiate less frequently used adjustments, or to provide functions not normally available to the operator. Additionally, combinations of the other keys may be assigned a program code to perform such additional functions. Preferably, the key 411*p*, when pressed alone, functions as an ESCAPE or CANCEL key, clearing all button pushes and adjustment values. Such a cancel key may also return the selection to a default mode in which all selections are cancelled and the display is returned to a default selection in which lineal and axial registration errors are displayed in the display lines 413*a* and 413*b*.

One such special function that is provided is the SET STATION ADDRESS function which is selected by the pressing of key 411*p* in combination with key 411*n*. This function provides for the entry of an address so that the microprocessors at the stations 13 may be put into selective communication with the host computer 400. This setting is made in the manner of the other settings described above, wherein the detection of the button combination executes the SET STATION ADDRESS routine of FIG. 27T, thereby selecting the SELECT STATION ADDRESS function and the ADJUST STATION ADDRESS subroutine for the interrupt handler routine of FIG. 27C, with the second pressing of the button combination causing the STATION ADDRESS to be changed to the NEW SETTING made in accordance with the adjustment of the dial 415.

From the above it will be apparent to those skilled in the art that various modifications and additions can be made without departing from the principles of the present invention. Therefore, what is claimed is:

1. A flexographic printing press having a plurality of printing stations wherein each of the printing stations comprises:

a frame;

an impression roller rotatably mounted to the frame;

a drive gear mounted to said impression roller;

a print carriage having a print roller rotatably mounted thereon, the print carriage being movably mounted to the frame to advance the print roller in a direction toward the impression roller and to retract the print roller in a direction away from the impression roller;

a drive gear mounted to said print roller;

a gear train driveably interconnecting the impression roller and the print roller and including a swing gear assembly having a housing and first and second gears mounted for rotation to the housing and in driving engagement with one another, wherein said housing is pivotal about the first gear to accommodate relative movement of said print roller and impression roller toward and away from one another, said swing gear assembly including an output gear having teeth engageable with one of said drive gears;

a pivoting and biasing mechanism coupled to said housing and operative to pivot said housing such that said output gear maintains biased engagement with said one of said drive gears; and a first bearer ring rotatable with and separate from said output gear and a second bearer ring rotatable with and separate from said one of said drive gears, said first and second bearer rings engaging one another during biased engagement of said output gear and said one of said drive gears such that said output gear is maintained a fixed distance from said one of said drive gears.

2. The flexographic printing press of claim 1 wherein:

the print carriage is moveable on the frame between a print position at which the print roller is in printing contact with a substrate between the print roller and the impression roller and a throw-off position at which the print roller is out of printing contact with a substrate between the print roller and the impression roller; and, said pivoting and biasing mechanism together with said first and second bearer rings maintain the fixed distance between said output gear and said drive gear during movement of the print roller between the print position and throw-off position.

3. The flexographic printing press of claim 1 wherein:

said pivoting and biasing mechanism comprises a rotary actuator which is operative to rotate said housing between a position in which said output gear is engaged with said drive gear and a position in which said output gear is disengaged from said drive gear.

4. The flexographic printing press of claim 3 further comprising:

a curved gear rack fastened to said housing; and a pinion gear in engagement with said rack and connected for rotation with an output shaft of said rotary actuator.

5. The flexographic printing press of claim 1 wherein:

said second gear is operatively coupled for rotation with said output gear and said output gear is engageable with the drive gear of said print roller.

6. The flexographic printing press of claim 1 wherein:

said pivoting and biasing mechanism swings said housing along a path of movement toward and away from said drive gear, said path including movement generally tangential to said drive gear and including a first position in which said output gear is engaged with said drive gear and a second position in which said output gear is disengaged from said drive gear.

7. The flexographic printing press of claim 6 wherein:

the print carriage is moveable on the frame between a print position at which the print roller is in printing contact with a substrate between the print roller and the impression roller and a backed-off position at which the print roller is out of printing contact with a substrate between the print roller and the impression roller; and the pivoting and biasing mechanism maintains the output gear in the first position when the print carriage is in the print position and in the second position when the print carriage is in the backed-off position.

8. The flexographic printing press of claim 1 further comprising:

a carriage positioning motor connected between the print carriage and the frame to advance and retract the print roller a controlled distance respectively toward and away from the impression roller in response to control information carried by a control signal; and, a controller having an output connected to the carriage positioning motor and having a programmable memory configured to cause the controller to generate the control signal carrying control information representing the controlled distance from the print roller to a selected one of a plurality of different positions of the print roller relative to the impression roller.

9. The flexographic printing press of claim 1 wherein:

the gear train further includes a harmonic drive unit connected between the impression roller and the print roller, the harmonic drive unit being operative to circumferentially adjust the print roller relative to the impression roller.

10. The flexographic printing press of claim 9 wherein:

said harmonic drive unit further includes a differential for changing the phase between an input and an output of said harmonic drive unit and therefore between said print roller and said impression roller; and, the press further includes a servo motor connected to said differential to drive said differential in response to a circumferential adjustment control signal.

11. The flexographic printing press of claim 10 further comprising:

a registration system that includes a controller operable to supply the circumferential adjustment control signal to the servo motor in accordance with circumferential registration differences between printing stations to maintain circumferential registration of the print and impression rollers of multiple printing stations.

12. An automated flexographic printing press having a plurality of printing stations wherein each of the printing stations comprises:

a frame;

an impression roller rotatably mounted to the frame;

a print carriage having a print roller rotatably mounted thereon, the print carriage being movably mounted to the frame to advance in a direction toward the impression roller to a printing position at which the print roller is in printing contact with a substrate between the print roller and the impression roller and to retract in a direction away from the impression roller to at least one non-printing position, including a throw-off position, at which the print roller is out of printing contact with the substrate;

a swing gear assembly driveably interconnecting the print roller and the impression roller, the assembly including mating gears maintained in a precise mating tolerance when the assembly is in a fully engaged condition, the assembly being swingably mounted so as to be maintainable in the fully engaged condition when the print roller is in the printing position, in the throw-off position, or in a position therebetween, so as to maintain synchronized motion and circumferential registration between the print and impression rollers when in such positions;

at least one print carriage servo motor connected between the frame and the print carriage and operable to advance and retract the carriage in response to a print roller position control signal;

a memory having information stored therein of printing position and non-printing position settings of the servo motor representing locations of the respective positions of the rollers on the frame;

an operator interface having operator command inputs thereon, including a non-printing position command input to select the movement of the carriage to the non-printing position, a print position command input to select the movement of the carriage to the printing position, and incremental adjustment command inputs; and, a processor programmed to:

selectively adjust the information stored in the memory in response to the incremental adjustment command inputs, and generate the print roller control signal to:

cause the carriage to move to the print position in response to the print position command input and the stored information, as adjusted, and cause the carriage to move to the non-printing position in response to the non-printing position command input and the stored information, as adjusted.

13. The flexographic printing press of claim 12 wherein:

the memory has information stored therein of print roller size and of substrate thickness;

the operator interface has operator command inputs thereon that include data inputs for changing the information stored in the memory of print roller size and of substrate thickness; and the processor is programmed to generate the print roller control signal at least partially in response to the print roller size and substrate thickness information in the memory to adjust at least the print position to accommodate changes in at least one of substrate thickness and print roller size;

the mating gears of the assembly being maintained in a precise mating tolerance when the assembly is in a fully engaged condition with an adjusted print position.

14. The flexographic printing press of claim 12 further comprising:

a central computer connected in data communication with the processors of the printing stations to remotely monitor and operate the operator interface at each printing station.

15. The flexographic printing press of claim 12 wherein:

the processor is programmed to generate the print roller control signal to cause the carriage to move to the print position in response to the print position command and the stored information if and only if the substrate is moving, and to cause the carriage to move to the throw-off position when the substrate is not moving, while maintaining the synchronized motion and circumferential registration.

16. The flexographic printing press of claim 12 wherein each station comprises:

at least two servo motors connected between the frame and the print carriage, one to each side of the carriage, and operable in synchronism to advance and retract the carriage, each in response to a separate print roller position control signal, while maintaining constant an angle between the print roller and the impression roller, and operable differentially to change the angle between the print roller and the impression roller;

the memory having information stored therein of separate printing position and non-printing position settings of the servo motors representing the locations of the printing position and non-printing position on the frame; and, the operator interface having operator command inputs thereon by which to select simultaneous and separate operation of the servo motors.

17. The flexographic printing press of claim 12 wherein each station comprises:

an inking carriage having an anilox roller and a metering element mounted thereon, the inking carriage being movably mounted to the printing carriage to advance in a direction toward the print roller to an inking position at which the print roller is in ink transferring contact with the anilox roller and to retract in a direction away from the print roller to at least one idle position at which the anilox roller is out of inking contact with the print roller;

at least one anilox carriage servo motor connected between the inking carriage and the print carriage and operable to advance and retract the inking carriage on the print carriage in response to an anilox roller position control signal;

the anilox roller being operatively connected with the print roller to be driven with the print roller when the print roller is in the print position;

an inking assembly drive connected to the anilox roller and operable to independently rotate the anilox roller when the anilox carriage is in the idle position;

the memory having information stored therein of inking position and idle position settings of the servo motor representing locations of the respective positions of the anilox roller on the print carriage; and the processor being programmed to generate the anilox roller control signal in response to operator commands from the inputs and the stored information.

18. The flexographic printing press of claim 17 wherein:

the servo motors are each digital control signal responsive stepper motors and the stored information corresponds to pulse counts of control signals to the stepper motors.

19. An automated flexographic printing press comprising:

a plurality of distinct printing stations each for transferring at least one component part of a series of composite images at spaced apart locations along the length of a continuous substrate running therethrough, each of printing stations comprising, located thereat:

(a) a frame;

(b) an impression roller mounted for rotation on the frame to back the substrate;

(c) a print roller rotatably mounted with respect to the frame to print one component part of the image on the substrate being backed by the impression roller;

(d) a gear train driveably interconnecting the impression roller and the print roller and including a harmonic drive unit connected between the impression roller and the print roller, said harmonic drive unit having a differential input and being operable in response to the differential input to vary the circumferential motion of the print roller relative to the impression roller;

(e) a stepper motor having an output connected to the differential input of the harmonic drive to drive the differential input in response to a digital control signal to circumferentially incrementally adjust the print roller relative to the impression roller;

(f) a digital encoder responsive to the angular position of the impression roller at the respective station, the encoder being configured and mounted to produce a signal representing the angular position of the impression roller to an accuracy of within 1/5000 of a revolution thereof;

(g) an optical sensor operative to produce a signal responsive to the location relative to the impression roller of a previously printed component part of the image on substrate;

(h) a print roller position sensor operative to produce a signal responsive to the angular position of the print roller relative to the frame; and (i) a registration controller operable in response to the signals from the encoder and the sensors to calculate a circumferential registration difference between the web and the print roller, to generate, as a result of the calculation, the control signal, and to supply the control signal in the form of a pulse stream to the stepper motor in accordance with circumferential registration difference to maintain circumferential registration among component parts of the images.

20. The printing press of claim 19, the registration controller includes:

a counter having an input connected to the encoder and operable to count pulses from the encoder;

logic responsive to each of the sensors for sampling the content of the counter in response to a signal from each sensor; and the controller being operable to calculate the circumferential registration difference by subtracting one sampled counter content from the other.

21. The printing press of claim 20 wherein the logic is interrupt logic.

22. The printing press of claim 19, wherein:

the registration controller includes program logic to spread correction pulses over the revolution of the print roller.

23. The printing press of claim 19, wherein:

the registration controller includes program logic to implement an entire correction over one revolution of the print roller.

24. The printing press of claim 19, further comprising:

a servo motor connected to move the print roller axially relative to the frame and transverse to the substrate;

the optical sensor being further responsive to the transverse position of a previously printed component of the image on the substrate; and the controller being operable to actuate the servo motor in response to the optical sensor to axially move the print roller transverse of the web to correct axial registration errors of component parts being applied.

25. The printing press of claim 19, wherein:

the previously printed component part of the image includes a mark that includes with a first bar disposed relative at an angle relative to at least one second bar; and the optical sensor is operative to produce information to the controller of the relative distance between points on the first and second bars.

26. The printing press of claim 25, wherein:

the mark is generally "Z"-shaped including two second bars interconnected by the first bar.

27. The printing press of claim 25 further comprising:

an optical sensor positioned adjacent the web so as to sense the points on each of the bars; and wherein the controller is operable, in response to a signal from the optical sensor, to determine the transverse position of the web by calculating the distance between the sensed points.

28. The printing press of claim 19 wherein the digital encoder at each station is responsive to the angular position of the impression roller at the respective station and is configured and mounted to produce a signal representing the angular position of the impression roller to an accuracy of within 1/20000 of a revolution of the impression roller.

29. The printing press of claim 19 wherein each impression roller has an axial shaft fixed thereto and the digital encoder at each station is mounted to the shaft so as to produce the signal representing the angular position of the impression roller to the recited accuracy.

30. An automated flexographic printing press having a plurality of distinct printing stations each for transferring at least one component part of a series of composite images at spaced apart locations along the length of a continuous substrate running therethrough, each of printing stations comprising:

a frame;

an impression roller mounted for rotation on the frame to back the substrate;

a print roller rotatably mounted with respect to the frame to print one component part of the image on the substrate being backed by the impression roller;

a servo motor connected to move the print roller axially relative to the frame and transverse to the substrate;

a transverse position sensor operative to generate a timed sensing signal in response to the transverse position of a previously printed component of the image on the substrate; and a controller operable to actuate the servo motor, in response to the timing of the sensing signal to calculate the transverse position of the substrate and to axially move the print roller transverse of the substrate.

31. The printing press of claim 30, wherein:

the previously printed component part of the image includes a mark that includes a first bar disposed at an angle relative to at least one second bar;

the transverse position sensor being operative to produce information to the controller of the relative distance between points on the first and second bars.

32. The printing press of claim 31, wherein:

the mark is generally "Z"-shaped including two second bars interconnected by the first bar.

33. The printing press of claim 32 wherein:

the sensor is positioned adjacent the web so as to sense points on each of the first bar and the two second bars and is operative to send signals to the controller containing information of the relative distances between different pairs of the first and second bars; and the controller is operable, in response to the signals from the sensor, to determine the transverse position of the web by calculating the relative distances between the sensed points.

34. An automated printing press comprising:

a plurality of printing stations each for transferring one component part of at least one composite image at spaced locations along the length of a continuous substrate when the substrate is extended along a path through the stations, each of the stations having a frame, an impression roller rotatably mounted to the frame and a print roller rotatably mounted on a carriage adjustably supported on the frame to contact the substrate at a print position along the path;

the path between print positions having more than one possible length;

a memory having stored therein digital information corresponding to the length of the paths from each print position to at least one other print position;

each station having a drive train drivably connected to the print roller and the impression roller thereof to drive the rollers at a circumferential speed that corresponds to the lineal speed of the substrate at the station, the drive train including a differential gear unit having a motor connected to a differential input thereof and operative to differentially move the print roller in relation to the substrate in response to a control signal;

each station having associated therewith a memory having stored therein data relating to the size of the print roller at the respective station; and each station having located thereat a registration controller operative to supply the control signal to the motor to alter the registration of the print roller relative to the substrate, the controller being operative, in response to a preregistration command, to obtain the path length information relating to the respective station and the data relating to the size of the print roller at the respective station, to calculate therefrom a preregistration angle of orientation of the print roller for the station, and to generate the control signal to cause the differential gear unit to move the print roller of the station to the preregistration angle of orientation.

35. A method of preregistering the print rollers of a flexographic press having a plurality of printing stations each for transferring one component part of at least one composite image at spaced locations along the length of a continuous substrate extending along a path through the stations, wherein each of the stations includes an impression roller and print roller pair located at a position along the path that is spaced from the positions of other roller pairs by distances that may vary, the method comprising the steps of, at a each of a plurality of the stations:

receiving and storing in a memory location for the station digital information relating to the distance along the path of the position of the roller pair of the station from the position of the roller pair of another station;

receiving and storing in a memory at each respective station data relating to the size of the print roller at the station;

from the information of relative position and the data of a print roller size stored for the station, calculating a preregistration angle corresponding to a remainder that would result by dividing a distance along the path between roller pair positions by a print roller circumference at the respective station;

sensing a reference moveable with the print roller and determining thereby the angular orientation of the print roller at the station; and rotating the print roller at the station to the calculated preregistration angle.

36. A method of controlling the registration of a plurality of component parts of each of a plurality of composite images printed along the length of a continuous substrate, the method comprising the steps of:

providing a printing press having a plurality of printing stations, each station having a rotatably mounted printing element thereat having a fixed repeat length on the circumference thereof;

inserting in the printing press and consecutively through the plurality of printing stations a continuous substrate having a plurality of copies of at least one component part of a composite image preprinted along the length thereof, each copy of the preprinted at least one component part being located on a lineal repeat length of the continuous substrate that tends to vary from the fixed repeat length of the printing element;

running the inserted continuous substrate consecutively through the plurality of stations at a predetermined lineal speed while rotating the printing elements at each of the stations at a respective circumferential speed to print a respective additional component part of the composite image onto each of the preprinted at least one component parts along the substrate;

measuring a series of the lineal repeat lengths along the continuous substrate running through the stations, and generating a measurement signal representative of a plurality of lineal repeat length measurements;

calculating separately, for each station, in response to the measurement signal, a correction value representing the predicted difference between the fixed repeat length and the lineal repeat length of the next preprinted at least one component part to be run through the respective station, and generating a control signal carrying a separately calculated correction value for each station; and separately controlling the actuation of circumferential adjustment means at each station in response to the control signal and in accordance with the respective correction value, so as to automatically change the circumferential speed of the respective printing element relative to the lineal speed of the continuous substrate in order to correct for variations between the lineal repeat lengths of the preprinted at least one component parts and component parts being printed by the printing element at the respective station.

37. The method of claim 36 wherein:

the measurement step includes the step of sensing at each station the relative lineal positions of preprinted at least one component parts relative to the circumferential position of the printing element at the respective station;

the calculating step includes the step of separately calculating for each station from the sensed relative lineal positions a circumferential registration error; and the controlling step includes the step of separately controlling at each respective station the actuation of the respective circumferential adjustment means to automatically change the relative circumferential position of the printing element at the respective station relative to the sensed lineal position of the preprinted at least one component part so as to correct for the respective circumferential registration error.

38. The method of claim 36 wherein:

the measuring step includes the step of separately measuring at each station, the lineal repeat lengths of component parts running through each respective station and generating a respective one of a plurality of separate measurement signals in response thereto, each corresponding to a respective series of component parts run through the respective station; and the calculating step includes the step of separately calculating each correction value in response to the respective measurement signal.

39. The method of claim 36 wherein:

the measuring step includes the step of digitally representing each of the measurements in discrete measurement data; and the controlling step includes the step of incrementally controlling the actuation of circumferential adjustment means at each station in response to the respective control signal so as to automatically change the average circumferential speed of the respective printing element relative to the lineal speed of the continuous substrate by a series of discrete rotational movements spaced over a rotation of the printing element.

40. The method of claim 36 wherein:

the calculating step includes the step of calculating from the plurality of measurements, a recurring portion of each of the measurements of the series, and statistically deriving the predicted difference from the calculated recurring portion.

41. An automated printing press for printing a series of composite images at longitudinally spaced locations along a web by sequentially applying a component of the composite image, each at one of a plurality of printing stations spaced along the web, as the web is advanced through the plurality of printing stations at a controlled web speed, wherein:

each printing station includes:

(a) a fixed frame, (b) a printing element rotatably mounted with respect to the frame, (c) printing element drive linkage connected to the printing element so as to rotate the printing element with respect to the frame at a circumferential speed having a controlled relationship to the controlled web speed, (d) an adjustment mechanism coupled to the linkage so as to change the circumferential position of the rotatable printing element relative to the web, the mechanism having an adjustment mechanism actuator responsive to a control signal, and (e) at least one sensor having a first output responsive to the circumferential position of the printing element of the respective station and a second output responsive to the position of an image on the continuous web relative to the respective station; and a computer control configured to derive a measurement error value from the outputs of the sensor, to store a plurality of derived measurement error values, to separately calculate therefrom a correction value for each respective station, and to send to the adjustment mechanism actuator at such station a control signal carrying the calculated correction value.

42. The press of claim 41 wherein:

the computer control includes a processor at each station programmed to calculate the correction value for the respective station.

43. The press of claim 42 wherein:

the processor at each station includes memory for storing a plurality of measurement error values and is programmed to calculate from the stored measurement error values the correction value for the respective station.

44. The press of claim 43 wherein:

the processor at each station includes memory for storing a plurality of measurement error values derived by the sensor at the respective station and is programmed to calculate the corresponding correction value from the measurement error values derived thereby.

45. The press of claim 41 wherein:

the computer control includes a circumferential registration controller at each station configured to control the actuator of the adjustment mechanism so as to automatically change the circumferential position of the rotatable printing element relative to the continuous web in response to the outputs from the sensor.

46. The press of claim 45 wherein:

the computer control includes a central computer and the circumferential registration controller is at least partly responsive to signals from the central computer to control the actuation of the adjustment mechanism in accordance with the calculated correction value corresponding to the respective station.

47. An automated printing press having a plurality of printing stations for transfer at least one component of a composite image formed of transferable image forming fluid at spaced locations longitudinally along a continuous substrate being advanced through said plurality of printing stations and a web feed operable to advance the continuous substrate consecutively through each of the printing stations at a selected substrate speed, wherein:

each of said printing stations includes:

(a) a fixed frame;

(b) a printing element rotatably mounted with respect to the frame, (c) printing element drive linkage connected to the printing element so as to rotate the printing element with respect to the frame at a circumferential speed having a controlled relationship to the controlled web speed, (d) a discrete adjustment mechanism coupled to the linkage so as to incrementally change the circumferential position of the rotatable printing element relative to the web, the mechanism having an adjustment mechanism actuator responsive to a digital control signal, and (e) at least one sensor having a first output responsive to the circumferential position of the printing element of the respective station and a second output responsive to the position of an image on the continuous web relative to the respective station; and a computer control configured to derive a measurement error value from the outputs of the sensor, to store a plurality of derived measurement error values, to predict from the stored values error values to be derived at each of the respective stations, to separately calculate therefrom a number of discrete correction pulses required to control the actuation of the adjustment mechanism to compensate for the predicted error values.

48. The press of claim 47 wherein:

the adjustment mechanism is responsive to discrete control pulses for incrementally changing the circumferential position of said rotatable printing element relative to the substrate position at the station; and each of said printing stations further includes a circumferential registration control programmed to generate, in response to the measurement error values derived at the respective station, discrete pulses in a number proportional to the predicted error value for the respective station.

49. The press of claim 48 wherein:

the registration controller is at least partly responsive to the discrete correction pulses required to control the actuation of said circumferential adjustment means of the respective stations in accordance with predicted error values.

50. The press of claim 47 wherein:

each image has a given repeat length value; and the controller is programmed to calculate, from the repeat length value and the number of discrete correction pulses, the spacing of pulses over the next image to be printed, and to generate the discrete correction pulses required to produce the calculated spacings.

51. The press of claim 47 wherein:

each image has a given repeat length value; and the controller is programmed to approximately divide the repeat length value by the number of discrete correction pulses to calculate approximate equal spacing of pulses over the next image to be printed, and to generate the discrete correction pulses to produce the calculated spacings.

52. An automated printing press comprising:

a plurality of printing stations for transferring at least one composite image at spaced apart locations along the length of a continuous substrate being run through said plurality of printing stations, each of said plurality of printing stations comprising:

(a) a frame;

(b) a rotatable printing element mounted rotatable to apply at least one component image of transferable image forming fluid at spaced apart locations along the length of the continuous substrate;

(c) a circumferential adjustment mechanism operable to adjust the rotational speed of the rotatable printing element relative to the speed of the continuous substrate running through said printing station;

(d) a registration controller operable to measure registration errors between images on the web and the rotatable printing elements at each of the stations;

(e) a computer control responsive to previously measured registration errors, the control including a processor programmed to derive a recurring trend in said previously measured registration errors, to predict a correction component to be made to registration at respective stations, and to control, in response to the predicted correction component and a measured registration error, the actuation of the circumferential adjustment mechanism to automatically change the circumferential orientation of the rotatable printing element relative to the continuous substrate to a desired circumferential orientation in order to correct for circumferential registration errors of the component images being applied by the printing element while the continuous substrate is being run through said printing station.

53. An automated printing press comprising:

a plurality of printing stations for transferring at least one composite image at spaced apart locations along the length of a continuous substrate being run through said plurality of printing stations, an unwinding station operable to enable a roll of the continuous substrate to be fed into the plurality of printing stations and a winding station for winding the continuous substrate into a roll after exiting the last of said plurality of printing stations, each of said printing stations comprising:

(a) a main frame having two sides;

(b) a rotatable printing element mounted for rotation on the main frame and having image applying surface thereon for applying at least one component image of transferable image forming fluid to the continuous substrate every revolution of said rotatable printing element, a fluid dispenser for dispensing transferable image forming fluid to the image applying surface, and a fluid supply for supplying transferable image forming fluid to the fluid dispenser, the rotatable printing element having a gear mounted thereon;

(c) an auxiliary frame including a base platform transversely movable from side to side across the main frame, at least the rotatable printing element and the fluid dispenser being carried by said base platform;

(d) an impression element carried by said frame, the impression element including a backing face for backing the continuous substrate while a component image is being applied thereon;

(e) a substrate guide carried between the sides of the frame for directing the path of the continuous substrate through the printing station and between the rotatable element and the backing face;

(f) a gear train for driving the rotation of the rotatable printing element, the gear train including a shiftable gear movable in and out of position to engage and drive the gear mounted to the rotatable printing element;

(g) a first positioning device operable to move the rotatable printing element to desired positions relative to the backing face, the positions including:

an image applying position where the rotatable printing element is in position to apply at least one component image of the transferable image forming fluid to the continuous substrate every revolution of the rotatable printing element at which position the shiftable gear in driveable engagement with the gear mounted to the rotatable printing element, and a backed off position where the rotatable printing element is not in position to apply a component image to the continuous substrate at which position the shiftable gear is out of driveable engagement with the gear mounted to the rotatable printing element;

(h) a positioning controller programmed to control actuation of the first positioning device in order to automatically move the rotatable printing element to and from the image applying position and to and from the backed off position;

(i) a circumferential adjustment mechanism for adjusting the rotational speed of the rotatable printing element independent of the speed of the continuous substrate running through the printing station;

(j) a sensor for generating at least one measurement signal representative of the position of the printing element relative to an image on the substrate at the station;

(k) a processor responsive to a plurality of previously generated measurement signals at the respective station for predicting a recurring component of the next measurement signal to be made at the station;

(l) a circumferential registration controller programmed to control actuation of the circumferential adjustment mechanism in response to the predicted component and the measurement signal to automatically change the circumferential orientation of the rotatable printing element relative to the continuous substrate to a desired circumferential orientation in order to correct for circumferential registration errors of the component images being applied by the printing element while the continuous substrate is being run through the printing station; and (m) an off-line adjustment device for automatically moving the base platform to a desired transverse position including an operational position in which the rotatable printing element and fluid dispenser are within the frame, and to a stand-aside position in which a sufficient portion of the base platform extends out beyond one side of the frame to enable at least the rotatable printing element and the fluid dispenser to be serviced, the base platform being self-supportive when in the stand-aside position.

54. The press of claim 53 further comprising:

a pre-registration control for controlling the actuation of the circumferential adjustment mechanism in order to automatically rotate the rotatable printing element to a pre-programmed circumferential orientation which brings the rotatable printing element into approximate circumferential registration with the rotatable printing elements of the other of the plurality of printing stations, before the printing press begins a printing run.

55. The press of claim 53 further comprising:

an axial adjustment mechanism for simultaneously adjusting the transverse position of the rotatable printing element and the fluid dispenser within the frame; and an axial registration control for controlling the actuation of the axial adjustment mechanism in order to automatically and simultaneously move transversely the rotatable printing element and the fluid dispenser to a desired transverse position between opposite sides of the frame to correct for axial registration errors of the component images being applied by the printing element while the continuous substrate is being run through the printing station.

* * * * *